US006224182B1

(12) United States Patent
Nagoshi et al.

(10) Patent No.: US 6,224,182 B1
(45) **Date of Patent: *May 1, 2001**

(54) RECORDING APPARATUS CONTROLLED WITH HEAD CHARACTERISTICS AND RECORDING METHOD

(75) Inventors: Shigeyasu Nagoshi, Kawasaki; Hiromitsu Hirabayashi, Yokohama; Noribumi Koitabashi, Yokohama; Hitoshi Sugimoto, Yokohama; Miyuki Matsubara, Tokyo; Hitoshi Nishikori; Masaya Uetuki, both of Kawasaki, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/250,509

(22) Filed: May 27, 1994

(30) Foreign Application Priority Data

May 27, 1993 (JP) ..... 5-126390
Aug. 20, 1993 (JP) ..... 5-206688
Aug. 20, 1993 (JP) ..... 5-206689

(51) Int. Cl.[7] ..... B41J 29/393
(52) U.S. Cl. ..... 347/19
(58) Field of Search ..... 347/5, 14, 17, 347/19, 49, 86; 400/175, 86

(56) References Cited

U.S. PATENT DOCUMENTS

| | | | | |
|---|---|---|---|---|
| 4,313,124 | | 1/1982 | Hara | 347/57 |
| 4,345,262 | | 8/1982 | Shirato et al. | 347/57 |
| 4,459,600 | | 7/1984 | Sato et al. | 347/47 |
| 4,463,359 | | 7/1984 | Ayata et al. | 347/56 |
| 4,558,333 | | 12/1985 | Sugitani et al. | 347/47 X |
| 4,608,577 | | 8/1986 | Hori | 347/66 |
| 4,723,129 | | 2/1988 | Endo et al. | 347/56 |
| 4,740,796 | | 4/1988 | Endo et al. | 347/56 |
| 4,910,528 | * | 3/1990 | Firl et al. | 347/17 |
| 5,166,699 | | 11/1992 | Yano et al. | 347/17 |
| 5,235,251 | * | 8/1993 | Koizumi | 347/19 |
| 5,235,351 | | 8/1993 | Koizumi | 347/14 |
| 5,265,315 | * | 11/1993 | Holsington et al. | 29/25.35 |
| 5,289,210 | | 2/1994 | Takayanagi | 347/14 |
| 5,363,134 | * | 11/1994 | Barbehenn et al. | 347/49 |
| 5,576,745 | * | 11/1996 | Matsubara | 347/14 |

FOREIGN PATENT DOCUMENTS

| | | | | |
|---|---|---|---|---|
| 3405164 | * | 8/1985 | (DE) | 347/86 |
| 0169337 | | 1/1986 | (EP) . | |
| 0274435 | | 7/1988 | (EP) . | |
| 0393602 | | 10/1990 | (EP) . | |
| 0444579 | | 9/1991 | (EP) . | |
| 0541064 | | 5/1993 | (EP) . | |
| 54-56847 | | 5/1979 | (JP) . | |
| 59-14967 | | 1/1984 | (JP) . | |
| 59-123670 | | 7/1984 | (JP) . | |
| 59-138461 | | 8/1984 | (JP) . | |
| 59-190873 | * | 10/1984 | (JP) | 347/211 |
| 60-71260 | | 4/1985 | (JP) . | |
| 61-098542 | | 5/1986 | (JP) . | |
| 3-208657 | | 9/1991 | (JP) . | |
| 4-255361 | | 9/1992 | (JP) . | |
| 5-31906 | | 2/1993 | (JP) . | |
| 5-31918 | | 2/1993 | (JP) . | |
| 5-64890 | | 3/1993 | (JP) . | |
| WO 8903768 | | 5/1989 | (WO) . | |

* cited by examiner

*Primary Examiner*—Benjamin R. Fuller
(74) *Attorney, Agent, or Firm*—Fitzpatrick, Cellla, Harper & Scinto

(57) ABSTRACT

A recording apparatus wherein a recording head which has been mounted can be identified more precisely by measuring characteristics of the recording head to obtain information for defining a drive condition of the head and storing the characteristics as ID information of the recording head.

73 Claims, 37 Drawing Sheets

FIG. 3

| RANK | 1 | 2 | 3 | 4 | 5 | 6 | 7 | 8 | 9 | 10 | 11 | 12 | 13 |
|---|---|---|---|---|---|---|---|---|---|---|---|---|---|
| R(Ω) | 225.3 ~ 233.1 | 233.1 ~ 240.9 | 240.9 ~ 248.7 | 248.7 ~ 256.5 | 256.5 ~ 264.3 | 264.3 ~ 272.1 | 272.1 ~ 279.9 | 279.9 ~ 287.7 | 287.7 ~ 295.5 | 295.5 ~ 303.3 | 303.3 ~ 311.1 | 311.1 ~ 318.9 | 318.9 ~ 326.7 |

$P_1$ : PRE-PULSE ($=T_1$) (PWM)
$P_2$ : INTERVAL ($=T_2-T_1$)
$P_3$ : MAIN PULSE ($=T_3-T_2$)
Vop : OPERATIONAL VOLTAGE

FIG. 19

| AMBIENT TEMP | TARGET TEMP | AMBIENT TEMP | TARGET TEMP | AMBIENT TEMP | TARGET TEMP | AMBIENT TEMP | TARGET TEMP |
|---|---|---|---|---|---|---|---|
| 0.0 ℃ | 35.5 ℃ | 17.5 ℃ | 26.0 ℃ | 35.0 ℃ | 15.0 ℃ | 52.5 ℃ | 15.0 ℃ |
| 0.5 ℃ | 35.5 ℃ | 18.0 ℃ | 26.0 ℃ | 35.5 ℃ | 15.0 ℃ | 53.0 ℃ | 15.0 ℃ |
| 1.0 ℃ | 35.5 ℃ | 18.5 ℃ | 25.5 ℃ | 36.0 ℃ | 15.0 ℃ | 53.5 ℃ | 15.0 ℃ |
| 1.5 ℃ | 35.5 ℃ | 19.0 ℃ | 25.5 ℃ | 36.5 ℃ | 15.0 ℃ | 54.0 ℃ | 15.0 ℃ |
| 2.0 ℃ | 35.5 ℃ | 19.5 ℃ | 25.0 ℃ | 37.0 ℃ | 15.0 ℃ | 54.5 ℃ | 15.0 ℃ |
| 2.5 ℃ | 35.5 ℃ | 20.0 ℃ | 24.5 ℃ | 37.5 ℃ | 15.0 ℃ | 55.0 ℃ | 15.0 ℃ |
| 3.0 ℃ | 35.5 ℃ | 20.5 ℃ | 24.5 ℃ | 38.0 ℃ | 15.0 ℃ | 55.5 ℃ | 15.0 ℃ |
| 3.5 ℃ | 35.5 ℃ | 21.0 ℃ | 24.0 ℃ | 38.5 ℃ | 15.0 ℃ | 56.0 ℃ | 15.0 ℃ |
| 4.0 ℃ | 35.5 ℃ | 21.5 ℃ | 24.0 ℃ | 39.0 ℃ | 15.0 ℃ | 56.5 ℃ | 15.0 ℃ |
| 4.5 ℃ | 35.5 ℃ | 22.0 ℃ | 23.5 ℃ | 39.5 ℃ | 15.0 ℃ | 57.0 ℃ | 15.0 ℃ |
| 5.0 ℃ | 35.5 ℃ | 22.5 ℃ | 23.5 ℃ | 40.0 ℃ | 15.0 ℃ | 57.5 ℃ | 15.0 ℃ |
| 5.5 ℃ | 35.0 ℃ | 23.0 ℃ | 23.0 ℃ | 40.5 ℃ | 15.0 ℃ | 58.0 ℃ | 15.0 ℃ |
| 6.0 ℃ | 34.5 ℃ | 23.5 ℃ | 22.5 ℃ | 41.0 ℃ | 15.0 ℃ | 58.5 ℃ | 15.0 ℃ |
| 6.5 ℃ | 34.0 ℃ | 24.0 ℃ | 22.5 ℃ | 41.5 ℃ | 15.0 ℃ | 59.0 ℃ | 15.0 ℃ |
| 7.0 ℃ | 34.0 ℃ | 24.5 ℃ | 22.0 ℃ | 42.0 ℃ | 15.0 ℃ | 59.5 ℃ | 15.0 ℃ |
| 7.5 ℃ | 33.5 ℃ | 25.0 ℃ | 21.5 ℃ | 42.5 ℃ | 15.0 ℃ | 60.0 ℃ | 15.0 ℃ |
| 8.0 ℃ | 33.0 ℃ | 25.5 ℃ | 21.5 ℃ | 43.0 ℃ | 15.0 ℃ | 60.5 ℃ | 15.0 ℃ |
| 8.5 ℃ | 32.5 ℃ | 26.0 ℃ | 21.0 ℃ | 43.5 ℃ | 15.0 ℃ | 61.0 ℃ | 15.0 ℃ |
| 9.0 ℃ | 32.0 ℃ | 26.5 ℃ | 20.5 ℃ | 44.0 ℃ | 15.0 ℃ | 61.5 ℃ | 15.0 ℃ |
| 9.5 ℃ | 32.0 ℃ | 27.0 ℃ | 20.5 ℃ | 44.5 ℃ | 15.0 ℃ | 62.0 ℃ | 15.0 ℃ |
| 10.0 ℃ | 31.5 ℃ | 27.5 ℃ | 20.0 ℃ | 45.0 ℃ | 15.0 ℃ | 62.5 ℃ | 15.0 ℃ |
| 10.5 ℃ | 31.0 ℃ | 28.0 ℃ | 19.5 ℃ | 45.5 ℃ | 15.0 ℃ | 63.0 ℃ | 15.0 ℃ |
| 11.0 ℃ | 30.5 ℃ | 28.5 ℃ | 19.0 ℃ | 46.0 ℃ | 15.0 ℃ | 63.5 ℃ | 15.0 ℃ |
| 11.5 ℃ | 30.5 ℃ | 29.0 ℃ | 19.0 ℃ | 46.5 ℃ | 15.0 ℃ | 64.0 ℃ | 15.0 ℃ |
| 12.0 ℃ | 30.0 ℃ | 29.5 ℃ | 18.5 ℃ | 47.0 ℃ | 15.0 ℃ | 64.5 ℃ | 15.0 ℃ |
| 12.5 ℃ | 29.5 ℃ | 30.0 ℃ | 18.0 ℃ | 47.5 ℃ | 15.0 ℃ | 65.0 ℃ | 15.0 ℃ |
| 13.0 ℃ | 29.0 ℃ | 30.5 ℃ | 18.0 ℃ | 48.0 ℃ | 15.0 ℃ | 65.5 ℃ | 15.0 ℃ |
| 13.5 ℃ | 28.5 ℃ | 31.0 ℃ | 17.5 ℃ | 48.5 ℃ | 15.0 ℃ | 66.0 ℃ | 15.0 ℃ |
| 14.0 ℃ | 28.5 ℃ | 31.5 ℃ | 17.0 ℃ | 49.0 ℃ | 15.0 ℃ | 66.5 ℃ | 15.0 ℃ |
| 14.5 ℃ | 28.0 ℃ | 32.0 ℃ | 17.0 ℃ | 49.5 ℃ | 15.0 ℃ | 67.0 ℃ | 15.0 ℃ |
| 15.0 ℃ | 27.5 ℃ | 32.5 ℃ | 16.5 ℃ | 50.0 ℃ | 15.0 ℃ | 67.5 ℃ | 15.0 ℃ |
| 15.5 ℃ | 27.0 ℃ | 33.0 ℃ | 16.0 ℃ | 50.5 ℃ | 15.0 ℃ | 68.0 ℃ | 15.0 ℃ |
| 16.0 ℃ | 27.0 ℃ | 33.5 ℃ | 16.0 ℃ | 51.0 ℃ | 15.0 ℃ | 68.5 ℃ | 15.0 ℃ |
| 16.5 ℃ | 26.5 ℃ | 34.0 ℃ | 15.5 ℃ | 51.5 ℃ | 15.0 ℃ | 69.0 ℃ | 15.0 ℃ |
| 17.0 ℃ | 26.5 ℃ | 34.5 ℃ | 15.0 ℃ | 52.0 ℃ | 15.0 ℃ | 69.5 ℃ | 15.0 ℃ |

FIG. 22

| HEAT SOURCE / THERMAL TIME CONSTANT | EJECTION HEATER | | SUB-HEATER | |
|---|---|---|---|---|
| | SHORT | LONG | SHORT | LONG |
| REQUIRED CALCULATION INTERVAL | 0.05sec | 1.00sec | 0.05sec | 1.00sec |
| DATA HOLD TIME | 0.80sec | 512sec | 0.80sec | 512sec |

FIG. 23

| | 0.0% ~ | 2.5% ~ | 5.0% ~ | 7.5% ~ | 10.0% ~ | 12.5% ~ | 87.5% ~ | 90.0% ~ | 92.5% ~ | 95.0% ~ | 97.5% ~ |
|---|---|---|---|---|---|---|---|---|---|---|---|
| 0.05sec~ | 0.00 | 0.89 | 1.56 | 2.22 | 2.89 | 3.66 | 14.11 | 14.21 | 14.32 | 14.42 | 14.53 |
| 0.10sec~ | 0.00 | 0.43 | 0.62 | 0.41 | 1.01 | 1.24 | 4.89 | 4.93 | 4.97 | 5.00 | 5.04 |
| 0.15sec~ | 0.00 | 0.20 | 0.25 | 0.30 | 0.35 | 0.42 | 1.70 | 1.71 | 1.72 | 1.74 | 1.75 |
| 0.20sec~ | 0.00 | 0.09 | 0.10 | 0.11 | 0.12 | 0.14 | 0.59 | 0.59 | 0.60 | 0.60 | 0.61 |
| 0.25sec~ | 0.00 | 0.04 | 0.05 | 0.07 | 0.08 | 0.09 | 0.17 | 0.17 | 0.17 | 0.17 | 0.17 |
| 0.30sec~ | 0.00 | 0.04 | 0.05 | 0.07 | 0.08 | 0.09 | 0.17 | 0.17 | 0.17 | 0.17 | 0.17 |
| 0.35sec~ | 0.00 | 0.04 | 0.05 | 0.07 | 0.08 | 0.09 | 0.17 | 0.17 | 0.17 | 0.17 | 0.17 |
| 0.40sec~ | 0.00 | 0.04 | 0.05 | 0.07 | 0.08 | 0.09 | 0.17 | 0.17 | 0.17 | 0.17 | 0.17 |
| 0.45sec~ | 0.00 | 0.04 | 0.05 | 0.07 | 0.08 | 0.09 | 0.17 | 0.17 | 0.17 | 0.17 | 0.17 |
| 0.50sec~ | 0.00 | 0.04 | 0.05 | 0.07 | 0.08 | 0.09 | 0.17 | 0.17 | 0.17 | 0.17 | 0.17 |
| 0.55sec~ | 0.00 | 0.04 | 0.05 | 0.07 | 0.08 | 0.09 | 0.17 | 0.17 | 0.17 | 0.17 | 0.17 |
| 0.60sec~ | 0.00 | 0.04 | 0.05 | 0.07 | 0.08 | 0.09 | 0.17 | 0.17 | 0.17 | 0.17 | 0.17 |
| 0.65sec~ | 0.00 | 0.04 | 0.05 | 0.07 | 0.08 | 0.09 | 0.17 | 0.17 | 0.17 | 0.17 | 0.17 |
| 0.70sec~ | 0.00 | 0.04 | 0.05 | 0.07 | 0.08 | 0.09 | 0.17 | 0.17 | 0.17 | 0.17 | 0.17 |
| 0.75sec~ | 0.00 | 0.04 | 0.05 | 0.07 | 0.08 | 0.09 | 0.17 | 0.17 | 0.17 | 0.17 | 0.17 |
| 0.80sec~ | 0.00 | 0.04 | 0.05 | 0.07 | 0.08 | 0.09 | 0.17 | 0.17 | 0.17 | 0.17 | 0.17 |
| 0.85sec~ | 0.00 | 0.00 | 0.00 | 0.00 | 0.00 | 0.00 | 0.00 | 0.00 | 0.00 | 0.00 | 0.00 |

FIG. 24

| | 0.0% ~ | 2.5% ~ | 5.0% ~ | 7.5% ~ | 10.0% ~ | 12.5% ~ | 87.5% ~ | 90.0% ~ | 92.5% ~ | 95.0% ~ | 97.5% ~ |
|---|---|---|---|---|---|---|---|---|---|---|---|
| 1sec ~ | 0.00 | 0.15 | 0.27 | 0.39 | 0.52 | 0.62 | 2.65 | 2.68 | 2.75 | 2.75 | 2.79 |
| 3sec ~ | 0.00 | 0.08 | 0.16 | 0.24 | 0.32 | 0.37 | 0.79 | 0.80 | 0.81 | 0.81 | 0.82 |
| 5sec ~ | 0.00 | 0.07 | 0.09 | 0.11 | 0.13 | 0.17 | 0.48 | 0.49 | 0.49 | 0.50 | 0.50 |
| 7sec ~ | 0.00 | 0.12 | 0.14 | 0.16 | 0.18 | 0.20 | 0.70 | 0.70 | 0.71 | 0.71 | 0.72 |
| 9sec ~ | 0.00 | 0.06 | 0.11 | 0.15 | 0.20 | 0.22 | 0.43 | 0.43 | 0.43 | 0.44 | 0.44 |
| 11sec ~ | 0.00 | 0.05 | 0.07 | 0.09 | 0.11 | 0.13 | 0.38 | 0.39 | 0.39 | 0.39 | 0.40 |
| 21sec ~ | 0.00 | 0.04 | 0.05 | 0.06 | 0.07 | 0.08 | 0.17 | 0.17 | 0.17 | 0.17 | 0.17 |
| 41sec ~ | 0.00 | 0.03 | 0.04 | 0.05 | 0.06 | 0.06 | 0.17 | 0.17 | 0.17 | 0.17 | 0.17 |
| 61sec ~ | 0.00 | 0.02 | 0.03 | 0.04 | 0.05 | 0.05 | 0.10 | 0.10 | 0.10 | 0.11 | 0.11 |
| 81sec ~ | 0.00 | 0.01 | 0.02 | 0.03 | 0.04 | 0.04 | 0.06 | 0.06 | 0.06 | 0.06 | 0.06 |
| 101sec ~ | 0.00 | 0.02 | 0.02 | 0.02 | 0.03 | 0.03 | 0.06 | 0.06 | 0.06 | 0.06 | 0.06 |
| 151sec ~ | 0.00 | 0.01 | 0.01 | 0.01 | 0.02 | 0.02 | 0.03 | 0.03 | 0.03 | 0.03 | 0.03 |
| 301sec ~ | 0.00 | 0.01 | 0.01 | 0.01 | 0.01 | 0.01 | 0.02 | 0.02 | 0.02 | 0.02 | 0.02 |
| 512sec ~ | 0.00 | 0.00 | 0.00 | 0.00 | 0.00 | 0.00 | 0.00 | 0.00 | 0.00 | 0.00 | 0.00 |

FIG. 25

| | 0.0% ~ | 20.0% ~ | 40.0% ~ | 60.0% ~ | 80.0% ~ |
|---|---|---|---|---|---|
| 0.05sec~ | 3.57 | 7.00 | 6.26 | 10.10 | 11.64 |
| 0.10sec~ | 2.25 | 4.20 | 4.10 | 6.24 | 7.16 |
| 0.15sec~ | 1.45 | 2.52 | 2.69 | 3.85 | 4.40 |
| 0.20sec~ | 0.93 | 1.51 | 1.76 | 2.38 | 2.71 |
| 0.25sec~ | 0.10 | 0.23 | 0.06 | 2.14 | 2.10 |
| 0.30sec~ | 0.15 | 0.24 | 0.24 | 0.55 | 0.68 |
| 0.35sec~ | 0.00 | 0.24 | 0.24 | 0.55 | 0.68 |
| 0.40sec~ | 0.00 | 0.24 | 0.24 | 0.55 | 0.68 |
| 0.45sec~ | 0.00 | 0.24 | 0.24 | 0.55 | 0.68 |
| 0.50sec~ | 0.00 | 0.24 | 0.24 | 0.55 | 0.68 |
| 0.55sec~ | 0.00 | 0.24 | 0.24 | 0.55 | 0.68 |
| 0.60sec~ | 0.00 | 0.24 | 0.24 | 0.55 | 0.68 |
| 0.65sec~ | 0.00 | 0.24 | 0.24 | 0.55 | 0.68 |
| 0.70sec~ | 0.00 | 0.24 | 0.24 | 0.55 | 0.68 |
| 0.75sec~ | 0.00 | 0.24 | 0.24 | 0.55 | 0.68 |
| 0.80sec~ | 0.00 | 0.24 | 0.24 | 0.55 | 0.68 |
| 0.85sec~ | 0.00 | 0.00 | 0.00 | 0.00 | 0.00 |

FIG. 26

| | 0.0% ~ | 2.5% ~ | 5.0% ~ | 7.5% ~ | 10.0% ~ | 12.5% ~ | 15.5% ~ | 87.5% ~ | 90.0% ~ | 92.5% ~ | 95.0% ~ | 97.5% ~ |
|---|---|---|---|---|---|---|---|---|---|---|---|---|
| 1sec~ | 0.00 | 0.11 | 0.14 | 0.18 | 0.21 | 0.27 | 0.33 | 1.74 | 1.83 | 1.91 | 2.00 | 2.08 |
| 3sec~ | 0.00 | 0.14 | 0.13 | 0.12 | 0.12 | 0.16 | 0.20 | 0.66 | 0.67 | 0.67 | 0.68 | 0.68 |
| 5sec~ | 0.00 | 0.02 | 0.04 | 0.06 | 0.08 | 0.09 | 0.10 | 0.40 | 0.41 | 0.41 | 0.41 | 0.42 |
| 7sec~ | 0.00 | 0.03 | 0.07 | 0.10 | 0.13 | 0.14 | 0.15 | 0.51 | 0.54 | 0.56 | 0.58 | 0.60 |
| 9sec~ | 0.00 | 0.06 | 0.07 | 0.08 | 0.08 | 0.11 | 0.13 | 0.35 | 0.36 | 0.36 | 0.36 | 0.37 |
| 11sec~ | 0.00 | 0.04 | 0.04 | 0.05 | 0.06 | 0.07 | 0.08 | 0.30 | 0.31 | 0.32 | 0.32 | 0.33 |
| 21sec~ | 0.00 | 0.02 | 0.03 | 0.04 | 0.04 | 0.05 | 0.06 | 0.14 | 0.14 | 0.14 | 0.14 | 0.14 |
| 41sec~ | 0.00 | 0.02 | 0.02 | 0.03 | 0.04 | 0.04 | 0.04 | 0.13 | 0.13 | 0.13 | 0.14 | 0.14 |
| 61sec~ | 0.00 | 0.02 | 0.02 | 0.02 | 0.03 | 0.03 | 0.04 | 0.08 | 0.08 | 0.09 | 0.09 | 0.09 |
| 81sec~ | 0.00 | 0.01 | 0.01 | 0.02 | 0.02 | 0.02 | 0.03 | 0.06 | 0.05 | 0.05 | 0.05 | 0.05 |
| 101sec~ | 0.00 | 0.01 | 0.01 | 0.02 | 0.02 | 0.02 | 0.02 | 0.04 | 0.04 | 0.05 | 0.05 | 0.05 |
| 151sec~ | 0.00 | 0.01 | 0.01 | 0.01 | 0.01 | 0.01 | 0.01 | 0.02 | 0.02 | 0.02 | 0.02 | 0.02 |
| 301sec~ | 0.00 | 0.00 | 0.00 | 0.01 | 0.01 | 0.01 | 0.01 | 0.01 | 0.01 | 0.01 | 0.01 | 0.01 |
| 512sec~ | 0.00 | 0.00 | 0.00 | 0.00 | 0.00 | 0.00 | 0.00 | 0.00 | 0.00 | 0.00 | 0.00 | 0.00 |

FIG. 27

| TEMP DIFFERENCE | SET-UP | PRE-HEAT | INTERVAL | MAIN | WEIGHT |
|---|---|---|---|---|---|
| -52.5℃～ | 0.905μsec | 0.000μsec | 0.000μsec | 4.525μsec | 60% |
| -49.5℃～ | 0.905μsec | 0.000μsec | 0.000μsec | 4.525μsec | 60% |
| -46.5℃～ | 0.905μsec | 0.000μsec | 0.000μsec | 4.525μsec | 60% |
| -43.5℃～ | 0.905μsec | 0.000μsec | 0.000μsec | 4.525μsec | 60% |
| -40.5℃～ | 0.905μsec | 0.000μsec | 0.000μsec | 4.525μsec | 60% |
| -37.5℃～ | 0.905μsec | 0.000μsec | 0.000μsec | 4.525μsec | 60% |
| -34.5℃～ | 0.905μsec | 0.000μsec | 0.000μsec | 4.525μsec | 60% |
| -31.5℃～ | 0.905μsec | 0.000μsec | 0.000μsec | 4.525μsec | 60% |
| -28.5℃～ | 0.905μsec | 0.000μsec | 0.000μsec | 4.887μsec | 64% |
| -25.5℃～ | 0.905μsec | 0.000μsec | 0.000μsec | 5.068μsec | 68% |
| -22.5℃～ | 0.905μsec | 0.000μsec | 0.000μsec | 5.249μsec | 72% |
| -19.5℃～ | 0.905μsec | 0.000μsec | 0.000μsec | 5.611μsec | 76% |
| -16.5℃～ | 0.905μsec | 0.000μsec | 0.000μsec | 5.972μsec | 80% |
| -13.5℃～ | 0.905μsec | 0.000μsec | 0.000μsec | 5.973μsec | 84% |
| -10.5℃～ | 0.905μsec | 0.000μsec | 0.000μsec | 6.335μsec | 88% |
| -7.5℃～ | 0.905μsec | 0.000μsec | 0.000μsec | 6.516μsec | 92% |
| -4.5℃～ | 0.905μsec | 0.000μsec | 0.000μsec | 6.697μsec | 96% |
| -1.5℃～ | 0.905μsec | 0.000μsec | 0.000μsec | 7.059μsec | 100% |
| 1.5℃～ | 0.905μsec | 1.991μsec | 0.543μsec | 5.068μsec | 100% |
| 4.5℃～ | 0.905μsec | 1.991μsec | 0.905μsec | 5.068μsec | 100% |
| 7.5℃～ | 0.905μsec | 1.991μsec | 1.448μsec | 5.068μsec | 100% |
| 10.5℃～ | 0.905μsec | 1.991μsec | 1.991μsec | 5.068μsec | 100% |
| 13.5℃～ | 0.905μsec | 1.991μsec | 1.991μsec | 5.068μsec | 100% |
| 16.5℃～ | 0.905μsec | 1.991μsec | 1.991μsec | 5.068μsec | 100% |
| 19.5℃～ | 0.905μsec | 1.991μsec | 1.991μsec | 5.068μsec | 100% |
| 22.5℃～ | 0.905μsec | 1.991μsec | 1.991μsec | 5.068μsec | 100% |
| 25.5℃～ | 0.905μsec | 1.991μsec | 1.991μsec | 5.068μsec | 100% |
| 28.5℃～ | 0.905μsec | 1.991μsec | 1.991μsec | 5.068μsec | 100% |
| 31.5℃～ | 0.905μsec | 1.991μsec | 1.991μsec | 5.068μsec | 100% |
| 34.5℃～ | 0.905μsec | 1.991μsec | 1.991μsec | 5.068μsec | 100% |
| 37.5℃～ | 0.905μsec | 1.991μsec | 1.991μsec | 5.068μsec | 100% |

FIG. 30

$P_1$ TABLE

UNIT (nSEC)

| RANK | RANK R (Ω) \ TEMP DIFFERENCE | ~-6 | -6~-3 | -3~0 | 0~3 | 3~6 | 36~39 | 39~42 | 42~45 | 45~ |
|---|---|---|---|---|---|---|---|---|---|---|
| 1 | 229.2 | 1120 | 1120 | 1060 | 1060 | 1000 | 400 | 400 | 400 | 400 |
| 2 | 237. | 1180 | 1180 | 1120 | 1120 | 1060 | 460 | 400 | 400 | 400 |
| 3 | 244.8 | 1180 | 1180 | 1120 | 1120 | 1060 | 460 | 400 | 400 | 400 |
| 4 | 252.6 | 1240 | 1240 | 1180 | 1180 | 1120 | 520 | 460 | 460 | 460 |
| 5 | 260.4 | 1240 | 1240 | 1180 | 1180 | 1120 | 520 | 460 | 460 | 460 |
| 6 | 268.2 | 1300 | 1300 | 1240 | 1240 | 1180 | 580 | 520 | 520 | 520 |
| 7 | 276. | 1300 | 1300 | 1240 | 1240 | 1180 | 580 | 520 | 520 | 520 |
| 8 | 283.8 | 1360 | 1360 | 1300 | 1300 | 1240 | 640 | 580 | 580 | 520 |
| 9 | 291.6 | 1420 | 1420 | 1360 | 1360 | 1300 | 700 | 640 | 640 | 580 |
| 10 | 229.4 | 1420 | 1420 | 1360 | 1360 | 1300 | 700 | 640 | 640 | 580 |
| 11 | 307.2 | 1480 | 1480 | 1420 | 1420 | 1360 | 700 | 700 | 640 | 640 |
| 12 | 315. | 1480 | 1480 | 1420 | 1420 | 1360 | 700 | 700 | 640 | 640 |
| 13 | 322.8 | 1540 | 1540 | 1480 | 1480 | 1420 | 700 | 700 | 640 | 640 |

FIG. 31

WEIGHT TABLE

UNIT (%)

| RANK | RANK R(Ω) \ TEMP DIFFERENCE | ~-6 | -6~-3 | -3~0 | 0~3 | 3~6 | 36~39 | 39~42 | 42~45 | 45~ |
|---|---|---|---|---|---|---|---|---|---|---|
| 1 | 229.2 | 95.735 | 95.735 | 94.313 | 94.313 | 92.891 | 78.673 | 78.673 | 78.673 | 78.673 |
| 2 | 237. | 98.354 | 98.354 | 96.956 | 96.956 | 95.558 | 81.574 | 80.175 | 80.175 | 80.175 |
| 3 | 244.8 | 97.928 | 97.928 | 96.574 | 96.574 | 95.221 | 81.682 | 80.328 | 80.328 | 80.328 |
| 4 | 252.6 | 97.528 | 97.528 | 96.216 | 96.216 | 94.904 | 81.784 | 80.472 | 80.472 | 80.472 |
| 5 | 260.4 | 97.153 | 97.153 | 95.88 | 95.88 | 94.607 | 81.88 | 80.607 | 80.607 | 80.607 |
| 6 | 268.2 | 96.799 | 96.799 | 95.563 | 95.563 | 94.327 | 81.97 | 80.734 | 80.734 | 80.734 |
| 7 | 276. | 96.264 | 95.264 | 94.063 | 94.063 | 92.862 | 80.854 | 79.653 | 79.653 | 79.653 |
| 8 | 283.8 | 94.981 | 94.981 | 93.813 | 93.813 | 92.646 | 80.968 | 79.8 | 79.8 | 78.632 |
| 9 | 291.6 | 94.714 | 94.714 | 93.577 | 93.577 | 92.44 | 81.075 | 79.938 | 79.938 | 78.802 |
| 10 | 229.4 | 93.353 | 93.353 | 92.246 | 92.246 | 91.139 | 80.07 | 78.963 | 78.963 | 77.856 |
| 11 | 307.2 | 93.14 | 93.14 | 92.062 | 92.062 | 90.983 | 79.115 | 79.115 | 78.037 | 78.037 |
| 12 | 315. | 91.886 | 91.886 | 90.834 | 90.834 | 89.782 | 78.209 | 78.209 | 77.156 | 77.156 |
| 13 | 322.8 | 91.719 | 91.719 | 90.693 | 90.693 | 89.666 | 77.345 | 77.345 | 76.319 | 76.319 |

FIG. 32

| RANK | RANK RESIST | P3 (μs) | P1 (μs) |
|---|---|---|---|
| 1 | 225.3 ~ 233.1 | 2.92 (2.58) | 1.06 (0.72) |
| 2 | 233.1 ~ 240.9 | 3.04 (2.70) | 1.12 (0.78) |
| 3 | 240.9 ~ 248.7 | 3.16 (2.82) | 1.12 (0.78) |
| 4 | 248.7 ~ 256.5 | 3.22 (2.88) | 1.18 (0.84) |
| 5 | 256.5 ~ 264.3 | 3.34 (3.00) | 1.18 (0.84) |
| 6 | 264.3 ~ 272.1 | 3.40 (3.06) | 1.24 (0.90) |
| 7 | 272.1 ~ 279.9 | 3.46 (3.12) | 1.24 (0.90) |
| 8 | 279.9 ~ 287.7 | 3.52 (3.18) | 1.30 (0.96) |
| 9 | 287.7 ~ 295.5 | 3.58 (2.24) | 1.36 (1.02) |
| 10 | 295.5 ~ 303.3 | 3.64 (3.30) | 1.36 (1.02) |
| 11 | 303.3 ~ 311.1 | 3.70 (3.36) | 1.42 (1.08) |
| 12 | 311.1 ~ 318.9 | 3.76 (3.42) | 1.42 (1.08) |
| 13 | 318.9 ~ 326.7 | 3.82 (3.48) | 1.48 (1.14) |

| ΔTs | 24~26 (24 OR MORE AND BELOW 26) | 26~28 | 28~30 | 30~32 | 32~34 | 34~36 | 36~38 |
|---|---|---|---|---|---|---|---|
| NUMBER OF IDLE EJECTIONS | 5450 | 5300 | 5150 | 5000 | 4850 | 4700 | 4550 |

FIG. 43

| HEAD RANK | 1 | 2 | 3 | 4 | 5 | 6 | 7 | 8 | 9 | 10 | 11 | 12 | 13 |
|---|---|---|---|---|---|---|---|---|---|---|---|---|---|
| $b_{HR}$ | 6.2 | 5.3 | 4.8 | 4.2 | 3.7 | 3.3 | 3.0 | 2.5 | 2.1 | 1.8 | 1.4 | 1.1 | 0.7 |

FIG. 44

| CORRECTION VALUE | -1 | ±0 | +1 |
|---|---|---|---|
| POWER SOURCE VOLTAGE | BELOW 18.99V | 18.99V OR HIGHER AND BELOW 19.23V | 19.23V OR HIGHER |

RECORDING APPARATUS CONTROLLED WITH HEAD CHARACTERISTICS AND RECORDING METHOD

BACKGROUND OF THE INVENTION

1. Field of the Invention

This invention relates to a recording apparatus and a recording method for attaining stable recording by use of head characteristics. More particularly this invention relates to a recording apparatus adapted to exalt image quality and ejection reliability by stabilizing the ejection behavior of a recording head and a recording method for use with the recording apparatus.

2. Related Background Art

Recording apparatuses such as printers, copying machines, or facsimiles are constructed so as to record an image of dot pattern on a recording material such as of paper or plastic film sheet in accordance with image data.

The recording apparatuses can be divided in terms of the manner of recording into the ink jet type, wire dot type, thermal type, laser beam type, etc. The recording apparatus of the ink jet type (ink jet recording apparatus), among other types mentioned above, is constructed to effect required recording by causing a recording head to eject ink (recording liquid) drops via nozzles thereof and allowing the ejected ink drops to land on and adhere to the recording material.

In recent years, a large number of recording apparatuses have been finding customers. These recording apparatuses are expected to satisfy the demand for high operational speed, high resolution, high image quality, or low noise. An example of the recording apparatus which answers the demand, the ink jet recording apparatus mentioned above may be adduced. One version of the ink jet recording apparatus attains recording by exerting thermal energy on the ink in the nozzles thereby inducing the ink to effervesce (or bubble) and utilizing the force of effervescence to eject the ink from the recording head. For the stabilization of the operation of ink ejection and the stabilization of the amount of ink to be ejected which are necessary for the accomplishment of the demand mentioned above, it is very important to control the temperature of the recording head and adjust the drive means used for the ink ejection.

For the conventional ink jet recording apparatus, therefore, it has been customary to adopt the so-called closed loop system which effects the detection of the head temperature by means of a temperature sensor incorporated in the recording head part or the method which, by means of a temperature calculating system capable of arithmetically estimating a change in the head temperature from the magnitude of the energy imparted to the head, detects the head temperature and controls the temperature of the recording head within a desired range on the basis of the detected recording head temperature or both of them.

As a means to allow compensation in the operation of the temperature detecting system mentioned above, JP-A-05-31,906 discloses a method which effects correction of the numerical data (stored as in a table) for use in the arithmetic operation on the basis of the difference to be found between the arithmetically estimated temperature and the temperature to be detected by the temperature sensor on the recording head while the recording head is in a thermally stable state. JP-A-05-31,918 teaches to effect the correction of the temperature of the temperature sensor on the recording head on the basis of the temperature which the environmental temperature sensing means built in the recording apparatus proper detects while the recording apparatus is not operating or not causing any change of temperature. Further, JP-A-05-64,890 teaches to use for the correction of the temperature of arithmetic estimation the difference between the arithmetically estimated temperature mentioned above and the temperature detected by the temperature sensor on the recording head. The methods of the inventions cited hereinabove by way of example aim to correct the head characteristics associated with such faulty factors attendant on the recording head of the exchangeable type as inconsistency among temperature sensors, error of heat time constant inherent in the recording head, and error of thermal efficiency of the recording head during the ink ejection, for example.

Generally, the aforementioned means for the arithmetic temperature estimation operate to estimate the temperature behavior (temperature increase) of a given object by measuring in advance the graduation of descent of the temperature of the object from the level to which the object has been heated by clocked supply of energy and calculating the sum of temperature required actually by the object in descending from the level elevated in the past per unit time to the existent level.

As a means to supply heat for the temperature control mentioned above, a heater member which is joined to the recording head is used. An ejection heater is used in the ink jet type recording apparatus which records an image with ink droplets ejected by means of thermal energy, specifically the apparatus adapted to obtain the ejection of ink droplets by means of growing bubbles by ink film boiling. When the ejection heater is adopted, it is kept energized to such an extent as to avoid spontaneously foaming.

The recording head which serves the purpose of generating ejection of ink particularly by virtue of the effervescence of the ink may be driven by a method of feeding electric current in the form of a single pulse or a double pulse or other similar multiple pulse to the ejection heater. Particularly in the drive using the double pulse waveform, the practice of controlling the waveform in accordance with the magnitude of the temperature of the recording head described above proves favorable because it permits easy control of the conditions of ejection such as the amount of ink to be ejected.

In order to set the drive conditions of the recording head, the drive conditions measured in advance are registered in the form of an incision on the head or storing them in a memory. An operator reads the data and sets the drive conditions.

To drive aptly the exchangeable recording head, recognition of the recording head operatively mounted in the recording apparatus is indispensable. For the sake of this recognition, a technique capable of causing the recording head to memorize identification data (ID) is available. This technique, however, demands time and labor for the work of memorization and, because of the necessity for providing each head with memory means (such as, for example, ROM), proves highly expensive. Then, for the purpose of enabling the ink jet recording apparatus to effect stable ejection of ink, the method for controlling the temperature of the recording head and the method for driving the recording head to eject ink constitute themselves important factors. Various methods have been developed and proposed. The method for driving the recording head in particular requires the driving conditions thereof to be optimized to counter various forms of inconstancy attendant on the head.

When the optimum driving conditions of the recording head are measured in advance and the data consequently obtained are stored in the memory, the operation of measurement and the work of incorporating the memory in the head result in exalting the overall cost of the head.

The fact that the aforementioned inconstancy found among individual heads depends particularly on the characteristics of the recording head has come to demand recognition. In the case of the ink jet recording head so adapted as to effect ejection of ink droplets by energizing the ejection heater and, by virtue of the heat consequently generated, inducing the ink to effervesce, for example, possible inconstancy of the magnitude of resistance of the ejection heater affects the energy to be imparted to the head and the manner of effervescence caused in the ink.

Further, the characteristics of the recording head which are manifested in the storage or release of heat possibly vary the characteristics of the effervescence and affect the driving conditions of the recording head, depending on the manner of conduction of the heat to be used for the effervescence of ink.

The recording head of the ink jet recording apparatus possibly fails to eject the ink normally as when it is left standing idly for a long time such that the ink gains in viscosity in the ink conduit particularly near the outlet of the nozzle. Besides, when the ink ejection is continued as when the recording is performed at a relatively high printing duty, the normal ink ejection is possibly obstructed eventually because minute bubbles occurring in the ink inside the ink conduit mentioned above grow in consequence of the continued ejection and the enlarged bubbles persist in the conduit and affect the ejection itself. These bubbles include those which enter the ink in the ink supply system, specifically through the joints used in the ink supply conduit, as well as those which are generated in consequence of the continued ejection mentioned above.

More often than not, the obstructed ink ejection mentioned above not only degrades the reliability of the recording apparatus but also damages the recording head itself and impairs the durability thereof possibly because the temperature of the recording head rises to an unduly high level from the normal one when the printing is continued at a high duty while the recording head remains in a state incapable of normal ink ejection.

To counter the obstructed ink ejection caused by the various factors mentioned above, the ink jet recording apparatus is subjected to various treatments for restoration of normal ink ejection such as, for example, a capping treatment which precludes the ink from gaining in viscosity by keeping the ink outlet mouth of the recording head covered while the ink ejection is not proceeding, an ink suction treatment which extracts the part of the ink of enhanced viscosity by aspirating the ink from the outlet mouth kept in the capped state, and a dry or idle ejection treatment which likewise eliminates the ink of enhanced viscosity by causing the ink to be discharged in much the same manner as during the normal recording onto a prescribed ink receptacle formed of an ink absorbent.

The treatment for restoration of the normal ink ejection has been automatically carried out at a prescribed interval as during the power connection to the apparatus or during the recording operation. Otherwise, it has been manually carried out by the user depressing a recovery button as occasion demands.

In the case of the ink jet recording apparatus adapted to undergo the treatment for restoration of the ink ejection during the power connection thereto, when the apparatus happens to be operated by a user who frequently turns on and off the power source, the number of occasions of his performing this treatment will excessively increase and the amount of the ink consumed and the amount of ink wastefully aspirated through the outlet will increase. In the case of the apparatus destined to undergo the manual treatment for restoration of the ink ejection performed by the user manipulating the restoration button at his own discretion, the treatment itself is at a disadvantage in lacking reliability because the user has no way of deciding whether the recording head is in the normal state or in the state incapable of ink ejection until he actually sets the recording head to action.

Regarding this problem, JP-A-04-255,361 which has issued to the present applicant for patent discloses a technique which is capable of deciding whether or not the recording head is ready to eject ink, depending on the rise of temperature caused in the recording head by dry ejection or the drop of temperature caused therein subsequently to the dry ejection. To be specific, when the recording head is in a state incapable of ejection, the rate of rise of the temperature or the rate of drop of the temperature is larger than when the recording head normally produces the ejection. When the rate of change of the rising and the dropping temperature (the sum of such rates, for example) exceeds a prescribed magnitude, therefore, it can be decided that the recording head has developed a state of allowing no normal ink ejection. (Hereinafter, this treatment will be referred to as an "ink failure detecting treatment.")

The rise of temperature which is caused in the recording head by dry ejection and utilized by the conventional technique for the detection of failure of ejection, however, is liable to fluctuate because of the characteristics of the recording head manifested in generation and storage of heat and the individual error of the recording apparatus proper manifested in voltage of the power supply. If the inconstancy in question is not inconspicuous, the detection of failure of the ink ejection cannot be obtained with high accuracy.

SUMMARY OF THE INVENTION

An object of this invention is to provide a recording apparatus which allows recognition of the existent state of a recording head with exalted accuracy and a recording method for use with the recording apparatus.

A further object of this invention is to provide a recording apparatus which allows a recording head to be driven for stable ejection of ink droplets in spite of possible inconstancy of the characteristics of the recording head and a recording method for use with the recording apparatus.

Another object of this invention is to provide a recording apparatus which is capable of imparting addition to the service life of a heater of the recording head and a recording method for use with the recording apparatus.

Yet another object of this invention is to provide a recording apparatus which is capable of detecting failure of ink ejection with high accuracy and a recording method for use with the recording apparatus.

To accomplish the objects described above, one aspect of the present invention provides a recording apparatus on which a recording head will be mounted to record images by using thermal energy, including a means for measuring a characteristic of the recording head to obtain information for defining a drive condition of the recording head which has been mounted, and a means for storing characteristics of the recording head measured by the measuring means as ID information of the recording head.

In another aspect of the present invention, a recording head recognizing method, including the steps of measuring and digitizing respective head characteristics of the recording head to be mounted, and storing the values as information for discriminating the recording head.

According to yet another aspect of the present invention, an ink jet recording apparatus on which recording heads are mounted, including a measuring means for measuring resistance characteristics of ejection heaters of the recording head as head characteristic information, and a drive condition setting means for setting a drive condition of the recording head according to the head characteristic information measured by the measuring means.

According to other aspect of the present invention, an ink jet recording apparatus, including an unejection detecting means for determining unejection of a recording head on the basis of a temperature change due to a temperature rise caused by ink ejection from the recording head, a temperature change due to a temperature fall after the ink ejection, or a relationship between both temperature changes, and a means for changing a drive condition for ejection to detect the unejection, according to characteristic information for a recording head or the recording apparatus.

BRIEF DESCRIPTION OF THE DRAWINGS

FIG. 3 is a diagram illustrating correspondence between head rank and the magnitude of ejection heater resistance.

FIG. 19 is a target temperature—environmental temperature conversion table.

FIG. 22 is a table showing the division of time for the arithmetic computation of temperature.

FIG. 23 is a table showing the short-range arithmetic computation of an ejection heater.

FIG. 24 is a table showing the long-range arithmetic computation of an ejection heater.

FIG. 25 is a table showing the short-range arithmetic computation of a sub-heater.

FIG. 26 is a table showing the long-range arithmetic computation of a sub-heater.

FIG. 27 is a table of PWM values representing pulse widths relative to the difference between the target temperature and the head temperature.

FIGS. 30 and 31 are tables showing basic waveforms corresponding to head ranks.

FIG. 32 is a table showing data for decision of pulse widths for the PWM drive.

FIG. 43 is a table showing the data for decision of b by head rank in Example 9.

FIG. 44 is a diagram illustrating the correspondence between the heater drive voltage and the correction value of the recording apparatus in FIG. 10.

DETAILED DESCRIPTION OF THE PREFERRED EMBODIMENTS

EXAMPLE 1

Figure 8:
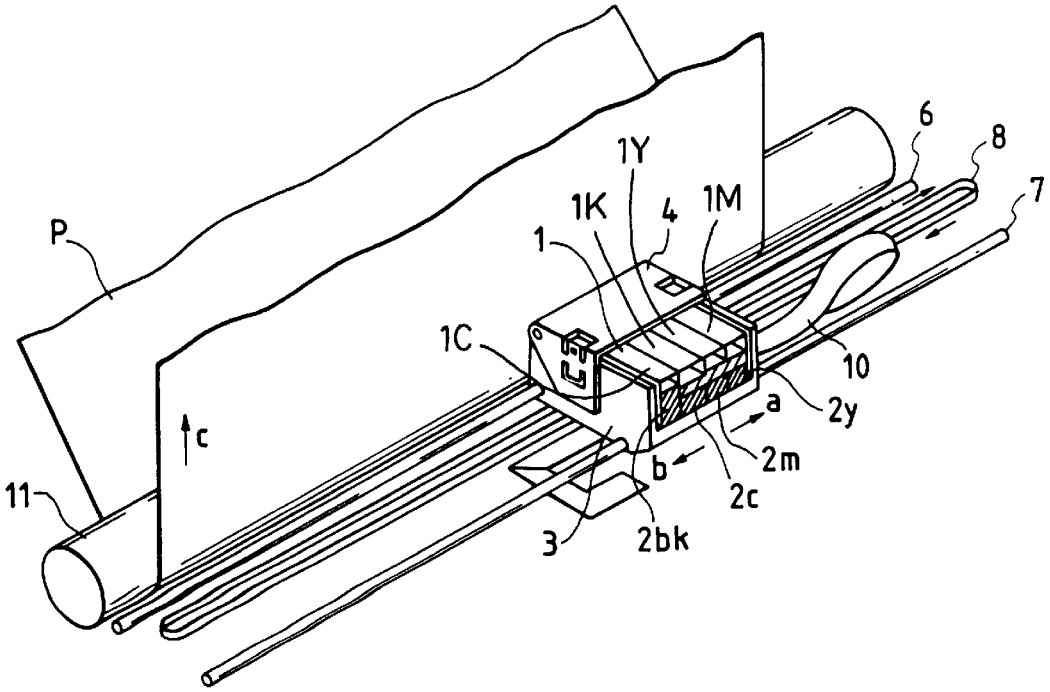
FIG. 8 is a perspective view illustrating wholly a recording apparatus.

FIG. 8 illustrates a serial type ink jet color printer using the present example. Recording heads 1 are each a device which is provided with a plurality of nozzle rows and adapted to record an image by ejecting ink droplets through the nozzle rows and causing the ink droplets to land on a recording medium 8 and form ink dots thereon. (In the diagram, the components mentioned are covered by a recording head fixing lever and are not directly indicated.) In the present example, a plurality of printing heads jointly form each of the recording heads 1 so as to permit ejection of ink droplets of a plurality of colors as will be described more specifically hereinbelow. Inks of different colors are ejected from different printing heads and a color image is formed on the recording medium P owing to the mixture of such different colors of the ink droplets.

Print data are transmitted from an electric circuit of the printer proper to the printing heads through the medium of a flexible cable 10. Printing head rows 1K (black), 1C (cyan), 1M (magenta), and 1Y (yellow), in the construction of this diagram, are formed by the collection of recording heads severally assigned to the four colors. The recording heads 1 are freely attachable or detachable to a carriage 3. In the forward scan, the inks of different colors mentioned above are ejected in the order mentioned. In the formation of red (hereinafter referred to as R), for example, magenta (hereinafter referred to as M) is ejected to land on the recording medium P first and then yellow (hereinafter referred to as Y) is ejected to land on the previously formed dots of M, with the result that red dots will consequently appear. Likewise, green (hereinafter referred to as G) is formed by causing C and Y to land on the recording medium P and blue (hereinafter referred to as B) C and M to land thereon respectively in the order mentioned. The printing heads are arrayed at a fixed interval (P1). The formation of a solid G print, therefore, requires Y to land on the recording medium with a time lag of 2*P1 following the landing of C thereon. Thus, a solid Y print is superposed on a solid C print.

The carriage 3 has the motion thereof in the direction of main scan controlled by unshown position sensing means detecting continuously the scanning speed and the printing position of the carriage. The power source for the carriage 3 is a carriage drive motor. The carriage 3, with the power transmitted thereto through the medium of a timing belt 8, is moved on guide shafts 6 and 7. The impression of prints proceeds during the motion of the carriage 3 for main scan. The printing action in the vertical direction selectively effects unidirectional printing and bidirectional printing. Generally the unidirectional printing produces a print only during the motion of the carriage away (the forward direction) from the home position thereof (hereinafter referred to as HP) and not during the motion thereof toward the HP (the backward direction). Thus, it produces a print of high accuracy. In contrast thereto, the bidirectional printing produces a printing action in both the forward and the backward direction. It, therefore, permits high-speed printing.

In the sub-scan direction, the recording medium P is advanced by a platen roller 11 which is driven by a paper feed motor not shown in the diagram. After the paper fed in the direction indicated by the arrow C in the diagram has reached the printing position, the printing head rows start a printing action.

Figure 9:
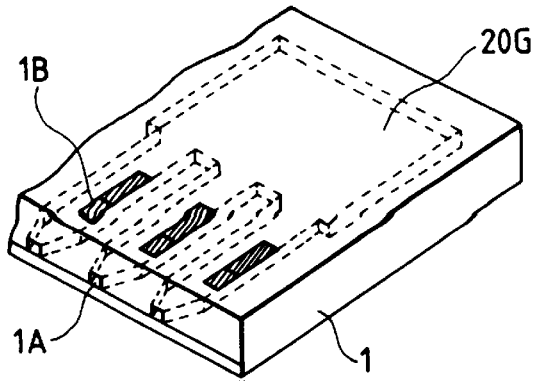
FIG. 9 is a perspective view illustrating the construction of a printing head.
Figure 10:
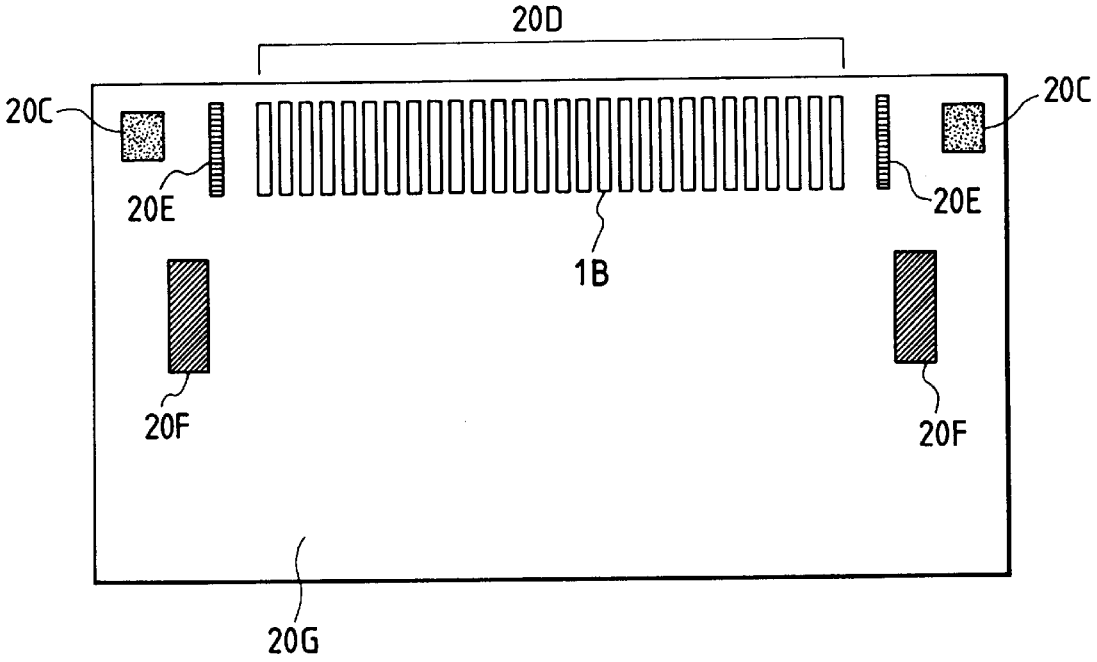
FIG. 10 is a diagram illustrating the interior of a heater board of the printing head.

Now, the recording heads 1 will be detailed below. As illustrated in FIGS. 9 and 10, a plurality of ejection nozzles 1A for ejecting ink droplets are disposed in a row on a heater board 20G of the printing heads and electric thermal transducers (hereinafter referred to as "ejection heaters 1B") for generating thermal energy by use of voltage applied thereto are disposed one each in the ejection nozzles 1A so as to cause ejection of ink droplets through the ejection nozzles 1A. The printing heads, in response to a drive signal exerted thereon, cause the ejection heaters 1B to generate heat and induce the ejection of ink droplets. On the heater board 20G, an ejection heater row 20D having a plurality of ejection heaters 1B arrayed thereon is disposed. Dummy resistors 20E incapable of ejecting ink droplets are disposed one each near the opposite ends of the ejection heater row 20D. Since the dummy resistors 20E are fabricated under the same conditions as the ejection heater 1B, the energy (Watt/hr) formed severally by the ejection heaters 1B in response to the application thereto of a fixed voltage can be detected by measuring the magnitude of resistance produced in the dummy resistors 20E. Since the formed energy of the ejection heaters 1B can be computed as $V^2/R$, wherein V stands for the applied voltage (Volt) and R for the resistance (Ω) of the ejection heaters, the characteristics of the ejection heaters 1B are dispersed similarly to those of the resistors 20E. These resistors 1B and 20E possibly have their characteristics dispersed within a range of ±15%, for example, by reflecting the inconstancy of craftsmanship encountered by them in the process of manufacture. The recording heads are enabled to enjoy an elongated service life and produce images of exalted quality by detecting the dispersion of the characteristics of the ejection heaters 1B and optimizing the drive conditions of the recording heads based on the outcomes of the detection.

Since the ink jet printer of the present type accomplishes the ejection of ink droplets by exerting thermal energy on the ink, the recording heads require temperature control. For the sake of this temperature control, therefore, diode sensors 20C are disposed on the heater board 20G and operated to measure the temperature of the neighborhood of the ejection heaters 1B. The results of this measurement are utilized for controlling the magnitude of the energy which is required for the ink ejection or the temperature control. In the present example, the average of the degrees of temperature detected by the diode sensors 20C forms the detected temperature.

The inks by nature gain in viscosity at low temperatures possibly to the extent of obstructing the ejection. For the purpose of precluding this adverse phenomenon, electric thermal transducers (hereinafter referred to as "sub-heaters 20F") are provided separately of the ink ejection nozzles on the heater board 20G. The energy supplied to the sub-heaters 20F is likewise controlled by the diode sensors 20C. Since the sub-heaters 20F are manufactured under the same conditions as the ejection heaters 1B, the dispersion of the magnitudes of resistance manifested by the sub-heaters 20F can be detected by measuring the magnitudes of resistance of the dummy resistors 20E mentioned above.

Since the components mentioned above are invariably disposed on one and the same substrate as described above, the temperatures of the heads can be detected and controlled with high efficiency and the heads can be miniaturized and manufactured by a simplified process.

Figure 11:
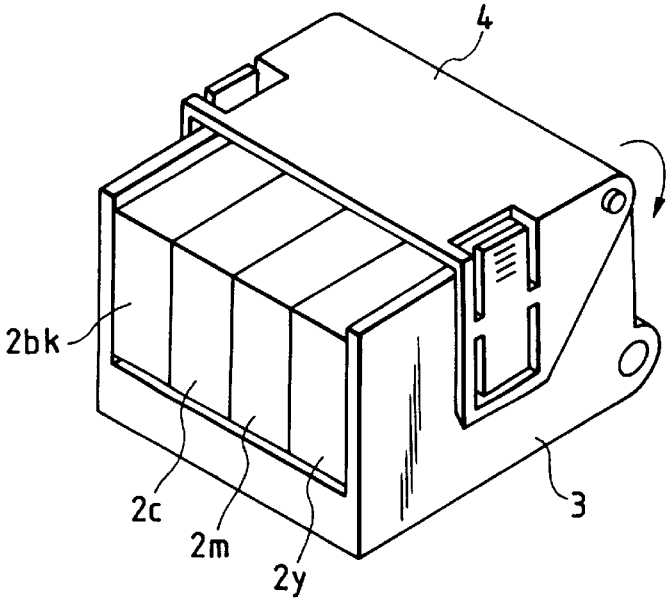
FIG. 11 is a perspective view illustrating a carriage.
Figure 12:
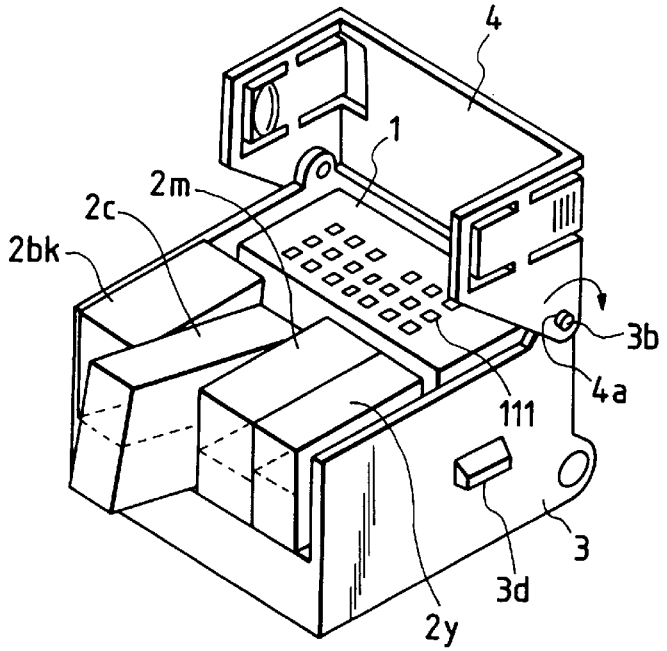
FIG. 12 is a diagram illustrating the appearance of the recording head mounted on the carrier.

Now, the recording heads mounted on the carriage will be described below. As illustrated in FIG. 11 and FIG. 12, the four printing heads (FIG. 9) serving the purpose of ejecting inks of the four colors R, C, M, and Y and ink tanks 2*bk*, 2*c*, 2*m*, and 2*y* for storing and supplying the respective inks are mounted in the carriage 3. These four ink tanks are so constructed as to be attached to and detached from the carriage 3. When they are emptied of their ink supplies, they can be replaced with newly supplied ink tanks.

A recording head fixing lever 4 is intended to position and fix the recording heads 1 on the carriage 3. Bosses 3*b* of the carriage 3 are rotatably inserted into holes 4*a* of the recording head fixing lever 4. The lever 4 which is normally kept in a closed state is opened to allow the operator access to the recording heads 1 and permit their replacement. Further, the engagement of the recording head fixing lever 4 with stoppers 3*d* of the carriage 3 ensures infallible fixation of the recording heads 1 on the carriage 3. Besides, a group of contacts 111 on the recording heads 1 join a group of matched contacts on the unshown recording head fixing lever. Owing to the union of these groups of contacts, the drive signals for driving the ejection heaters and sub-heaters of the printing heads assigned to the four colors and the data of head characteristics and the numerical values as the results of detection of the diode sensors can be transmitted from the recording apparatus proper or rendered detectable.

Now, the algorithm for the computation of head temperatures will be described.

(Outline of Overall Flow of Control)

In the ink jet recording apparatus, the operation of ejection and the amount of ejection can be stabilized and the impartation of high quality to images to be recorded can be attained by controlling the temperatures of the recording heads within a fixed range. The means for computation and detection of the temperatures of the recording heads and the method for controlling the optimum drives for such temperatures which are adopted in the present example for the purpose of realizing stable recording of images of high quality will be outlined below.

(1) Setting of Target Temperature

The control of head drive aimed at stabilizing the amount of ejection which will be described below uses the tip temperature of a head as the criterion of control. To be more specific, the tip temperature of a head is handled as a substitute characteristic to be used for the detection of the amount of ejection per dot of the relevant ink being ejected at the time of detection. Even when the tip temperature is fixed, the amount of ejection differs because the temperature of the ink in the tank depends on the environmental temperature. The tip temperature of the head which is set to equalize the amount of ejection at a varying temperature (namely at a varying ink temperature) for the purpose of eliminating the difference mentioned above constitutes itself a target temperature. The target temperatures are set in advance in the form of a table of target temperatures. The table of target temperatures to be used in the present example are shown in FIG. 19.

(2) Means for Computation of Recording Head Temperature

The algorithm of temperature computation to determine the change of temperature of the recording head is handled as an accumulation of discrete variables per unit time. The change of temperature of the recording head which corresponds to the discrete variables mentioned above is computed and tabulated in advance. The temperature computation is carried out by use of a two-dimensional table which is formed with a two-dimensional matrix representing the magnitude of energy consumed per unit time and the elapsed time. Recording heads formed as a model by assembling a plurality of members differing in thermal conduction time are used as substitutes at a smaller number of heat time constants than actual. The interval of computations required and the duration of retention of data required are separately computed for each model unit (heat time constant). Further, the head temperature is computed by setting a plurality of heat sources, computing the width of temperature rise by the model unit mentioned above for each of the heat sources, and then totaling the widths obtained by the computation (algorithm for computation of a plurality of heat sources). The algorithm allows the change of temperature of the recording head even in an inexpensive recording apparatus to be completely computed and coped with without requiring the otherwise inevitable provision of a temperature sensor on the recording head.

(3) PWM Control

The stabilization of the amount of ejection can be attained when the head under a varying environment is driven at the tip temperature indicated in the table of target temperatures mentioned above. Actually, however, the tip temperature is not constant because it sometimes varies with the printing duty. The means to drive the head by use of the multipulse PWM and control the amount of ejection without relying on temperature for the purpose of stabilizing the amount of ejection constitutes itself the PWM control. In the present example, a PWM table defining the pulses of optimum waveforms/widths at existent times based on the differences between the head temperature and the target temperatures under existent environments are set in advance. The drive conditions for ejection are fixed based on the data of this table.

(4) Control of Sub-Heater Drive

The control which is attained by driving a sub-heater and approximating the head temperature to the target temperature when the PWM drive fails to obtain a desired amount of ejection forms the control of a sub-heater. The sub-heater control enables the head temperature to be controlled in a prescribed temperature range.

(Estimation and Control of Temperature)

The basic formula for the estimation of the temperature of a recording head in the apparatus under discussion conforms with due modifications to the following general formula for thermal formula.

During uninterrupted heating $$\Delta\text{temp}=a\{1-\exp[-m*T]\} \tag{1}$$

During heating switched midway to cooling $$\Delta\text{temp}=a\{\exp[-m(T-T1]-\exp[-m*T]\} \tag{2}$$

wherein temp stands for temperature rise of object, a for temperature of object equilibrated by use of heat source, T for elapsed time, m for heat time constant of object, and T1 for duration of suspended use of heat source.

Theoretically, the tip temperature of the recording head can be estimated by computing the formulas (1) and (2) given above in accordance with the printing duty for a relevant heat time constant, providing that the recording head is handled as a series of lumped constants.

Generally, however, the problem of speed of processing prevents the computations mentioned above to be carried out without modification.

Strictly, the number of necessary arithmetic operations is colossal because all the component members have different time constants and time constants arise among the members.

Generally, the time for the computations cannot be shortened because the exponential operations cannot be performed directly with microprocessor MPU and must rely on approximation or consultation of a conversion table.

The problems cited above are solved by the modeling and the operational algorithm shown below.

Modeling

Figure 20:
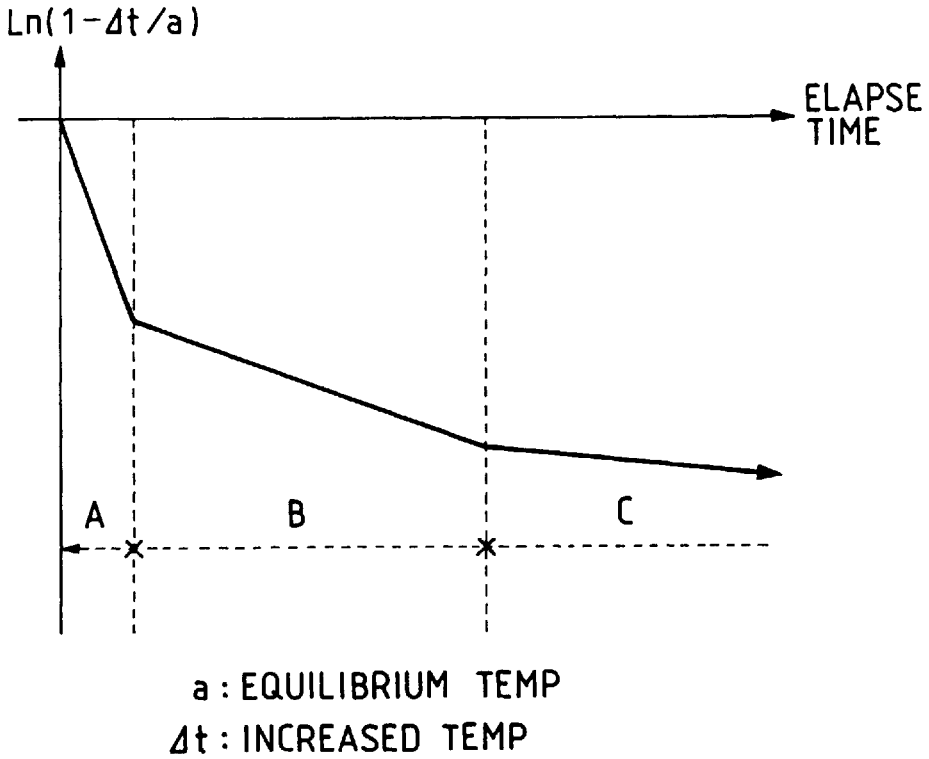
FIG. 20 is a diagram illustrating the process of temperature rise of the recording head in the arithmetic estimation of the temperature of the recording head.

An experiment carried out by feeding energy to the recording head constructed as described above and sampling pertinent data during the rise of temperature of the recording head yielded the results shown in FIG. 20.

Though the recording head constructed as described above results from assembling numerous members differing in time of thermal conduction, this recording head can be practically treated as a single member with respect to thermal conduction so long as the differential value of the functions of elapsed time and data of temperature rise and obtained by the aforementioned logarithmic conversion is constant (namely, within the ranges A, B, and C on FIG. 20 wherein the inclinations are fixed).

In the light of the test results mentioned above, the present examples has elected to handle the recording head with two heat time constants in the model associated with thermal conduction. (Though the results indicate that the regression can be performed more accurately by use of a model having three heat time constants, the present example has elected to model the recording head with two heat time constants by concluding that the inclinations in the areas of B and C of the table are substantially equal and giving a preference to the efficiency of arithmetic operations to be involved.) To be specific, one of the two magnitudes of thermal conduction pertains to a model having a time constant such that the temperature is equilibrated in 0.8 seconds (equivalent to the area of A in FIG. 20) and the other magnitude of thermal conduction pertains to a model having a time constant such that the temperature is equilibrated in 512 seconds (equivalent to the areas of B and C in FIG. 20).

The series of lumped constants is impariably restored to on the assumption that the temperature distribution during the thermal conduction deserves to be disregarded.

Figure 21:
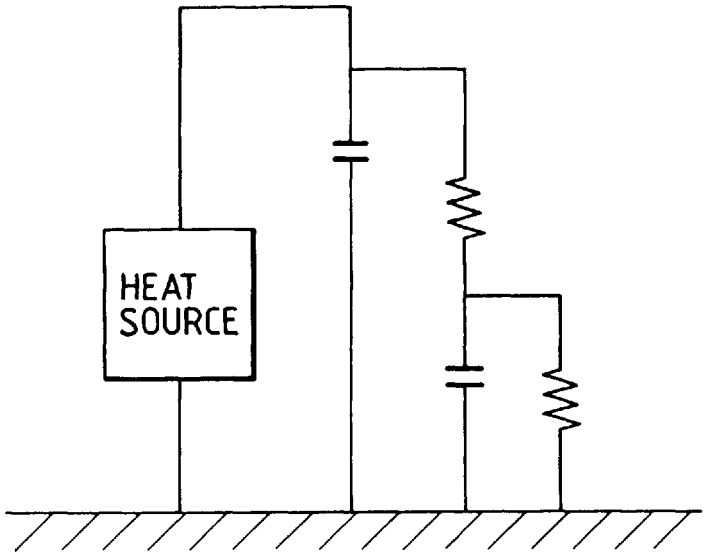
FIG. 21 is a diagram illustrating a model heat conduction equivalent circuit in the arithmetic estimation of the temperature of the recording head.

Two heat sources, i.e. the heat to be used for printing and the heat of the sub-heater, are assumed. FIG. 21 shows an equivalent circuit of model thermal conduction. The diagram depicts the case of using only one heat source. When the use of two heat sources is contemplated, they may be disposed in a series construction.

Algorithm of Arithmetic Operations

The present example computes the head temperature by expanding the aforementioned general formulas on thermal conduction as follows.

<Change of temperature after elapse of nt hours following the start of the power source>

$$a\{1-\exp[-m*n*t]\} \quad \text{<1>}$$

$$=a\{\exp[-m*t]-\exp[-m*t]+\exp[-2*m*t]-\exp[-2*m*t]+\ldots+\exp[-(n-1)*m*t]-\exp[-(n-1)*m*t]+1-\exp[-n*m*t]\}$$

$$=a\{1-\exp[-m*t]\}$$

$$+a\{\exp[-m*t]-\exp[-2*m*t]\}$$

$$+a\{\exp[-2*m*t]-\exp[-3*m*t]\}$$

. . .

$$+a\{\exp[-(n-1)*m*t]-\exp[-n*m*t]\}$$

$$=a\{1-\exp[-mt]\} \quad \text{<2-1>}$$

$$+a\{\exp[-m*(2t-t)]-\exp[-m*2t]\} \quad \text{<2-2>}$$

$$+a\{\exp[-m*(3t-t)]-\exp[-m*3t]\} \quad \text{<2-3>}$$

. . .

$$+a\{\exp[-m*(nt-t)]-\exp[-m*nt]\} \quad \text{<2-n>}$$

The expansion shown above indicates that the formula <1> coincides with <2-1>+<2-2>+<2-3>+ - - - +<2-n>. Here, the formula <2-n> represents the temperature of a given object at the point of time of nt which is found when the object is heated from the point of time of 0 to that of t and the heating is suspended between the point of time of t and that of nt.

The formula <2-2> represents the temperature of the object at the point of time of nt which is found when the object is heated from the point of time of (n-3)t to that of (n-2)t and the heating is suspended between the point of time of (n-2)t and that of nt.

The formula <2-2> represents the temperature of the object at the point of time of nt which is found when the object is heated from the point of time of (n-2)t to that of (n-1)t and the heating is suspended between the point of time of (n-1)t and that of nt.

The formula <2-1> represents the temperature of the object at the point of time of nt which is found when the object is heated between the point of time of (n-1)t and that of nt.

The fact that the sum of the formulas mentioned above equals the formula <1> aptly indicates that the behavior of temperature (rise of temperature) of a given object 1 can be arithmetically estimated by measuring the graduations of drop of the temperature of the object 1 per unit time from the temperature of the object 1 to which the object 1 has been heated by use of energy imparted thereto per unit time (the statement equivalent to each of the formulas <2-1>, <2-2>, - - - <2-n>) and then adopting as an estimate of the existent temperature of the object 1 the sum of the graduations at which the temperature of the object 1 formerly raised per unit time ought to have dropped to the existent temperature (the statement equivalent to the sum of the formula <2-1>+ <2-2>+ - - - <2-n>).

In the light of the foregoing, the present example elects to perform four times (the product; 2 power sources*2 heat time constants) the computation of the tip temperature of the recording head on the basis of the modeling mentioned above.

The intervals necessary for the computation and the durations of retention of data which are to be used for each of the four rounds of computation are shown in FIG. 22.

Tables of arithmetic operations which are two-dimensional matrixes having the magnitudes of energy imparted and the lengths of time elapsed arrayed for the computation of the head temperature mentioned above are shown in FIG. 23 to FIG. 26.

FIG. 23 represents a table for the computation of heat sources; ejection heaters, time constants; and short-range groups of members, FIG. 24 a table for the computation of heat sources; ejection heaters, time constants; and long-range groups of members, FIG. 25 a table for the computation of heat sources; sub-heaters, time constants; and short-range groups of members, and FIG. 26 a table for the computation of heat sources; sub-heaters, time constants; and long-range members of members.

The head temperature at a given time can be computed as hereinbelow. At intervals of 0.05 second, there are conducted the operations of (1) measuring the rise (ΔTmh) of temperature caused in the members of heat time constants represented by the short ranges in consequence of the drive of the heaters for the ejection and (2) measuring the rise (ΔTsh) of temperature caused in the members of heat time constants represented by the short ranges in consequence of the drive of the sub-heaters. Also, at intervals of 1 second, there are conducted the operations of (3) measuring the rise (ΔTmh) of temperature caused in the members of heat time constants represented by the long ranges in consequence of the drive of the heaters for the ejection and (4) measuring the rise (ΔTsh) of temperature caused in the members of heat time constants represented by the long ranges in consequence of the drive of the sub-heaters. The results, ΔTmh, ΔTsh, ΔTmb, and ΔTsb are totalled (=ΔTmh+ΔTsh+ΔTmb+ΔTsb).

As the result of adopting the modeling means of substituting the recording head formed by assembling a plurality of members differing in thermal conduction time with a smaller number of heat time constants than actual as a model, (i) the amount of processing of arithmetic operations can be appreciably decreased without noticeably sacrificing the accuracy of operation as compared with the amount of processing of arithmetic operations performed faithfully with respect to all the heat time constants of the members differing in thermal conduction time and those among the individual members and (ii) the processing of arithmetic operations can be performed with a small number of rounds without a sacrifice of the accuracy of computation on account of the use of time constants as a criterion of determination (in the case of the foregoing example, if the modeling is not effected for each of the time constants, then the intervals of 50 msec to be fixed in the area of A having a small time constant will have to be used for the necessary processing of arithmetic operations and the durations of 512 sec to be fixed in the areas of B and C having a large time constant will have to be used for the retention of the data of discrete variables, with the result that 10240 pieces of data produced theretofore at intervals of 50 msec over a period of 512 second ought to be subjected to a processing of cumulative operations and the number of rounds of processing consequently increased to some hundreds of times of the number required in the present example).

Thus, the change of the temperature of the recording head can be wholly processed by the arithmetic operations as described above.

Further, the PWM drive control intended to control the temperature of the recording head in a stated range as will be described specifically hereinbelow and the control of sub-heaters can be suitably carried out and the stabilization of the operation of ejection and the amount of ejection can be attained and the impartation of high quality to the produced images can be accomplished.

(PWM Control)

Now, the method for controlling the amount of ejection according to the present example will be detailed below with reference to the drawings.

Figure 15:
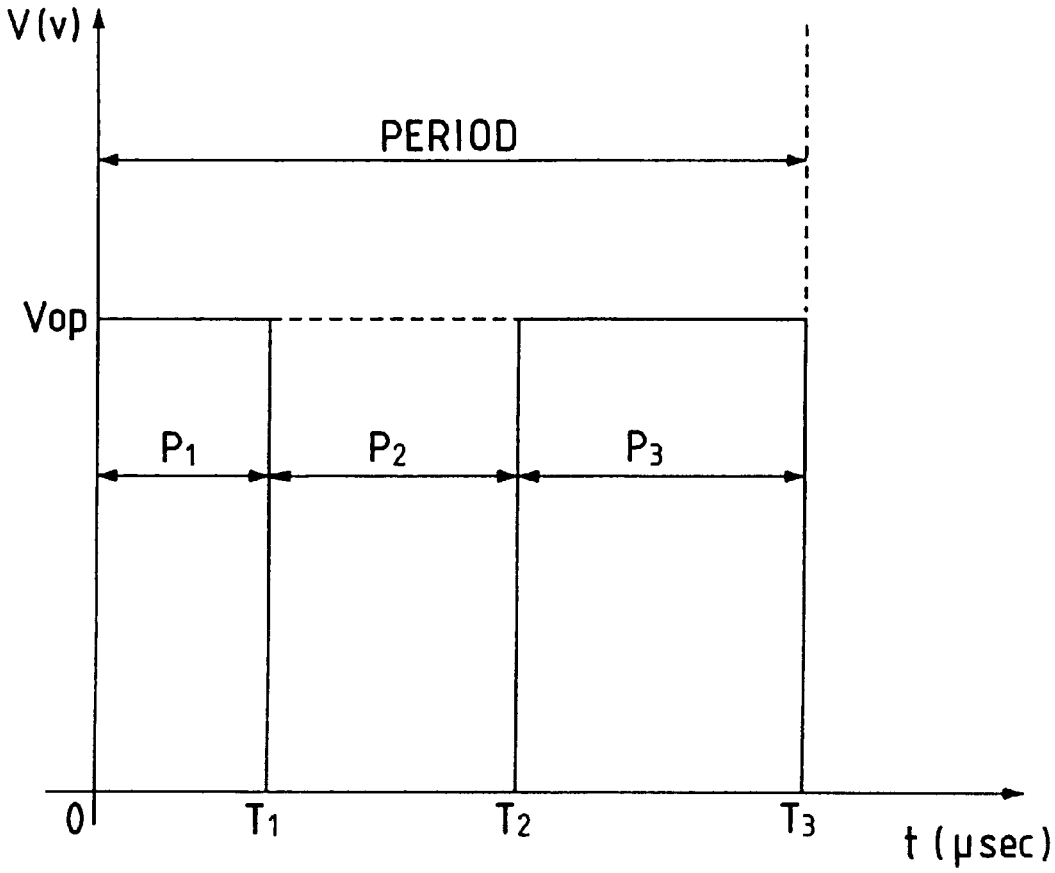
FIG. 15 is an explanatory diagram representing a driving method for split pulse width modulation.

FIG. 15 is a diagram for aiding in the description of split pulses as one embodiment of the present invention. In the diagram, $V_{OP}$ stands for a drive voltage, $P_1$ for the width of the first of a plurality of split heat pulses (hereinafter referred to as a "preheat pulse"), $P_2$ for an interval time, and $P_3$ for the width of the second pulse (hereinafter referred to as a "main heat pulse"), and $T_1$, $T_2$, and $T_3$ stand respectively for lengths of time for fixing $P_1$, $P_2$, and $P_3$. The drive voltage $V_{OP}$ is one of the magnitudes of electric energy necessary for enabling the electric thermal transducer receiving the voltage to induce generation of thermal energy in the inks which are held inside the ink conduits and defined by the heater board and the ceiling board. The magnitude of this drive voltage is determined by the surface area, magnitude of resistance, and film construction of the electric transducer and the liquid conduits of the recording head. The method of driving for modulation of split pulse width consists in successively providing pulses in the widths of $P_1$, $P_2$, and $P_3$. The preheat pulse is intended mainly to control the temperatures of the inks held in the liquid conduits and adapted to discharge an important roll of controlling the amount of ejection in this invention. The width of the preheat pulse is so set that the thermal energy generated by the electric transducer receiving the preheat pulse may avoid inducing the phenomenon of effervescence in the inks.

The interval time is used for the purpose of interposing a fixed time interval between the preheat pulse and the main pulse thereby preventing the two pulses from interfering with each other and for uniformizing the temperature distribution in the inks held in the ink conduits. The main heat pulse serves the purpose of causing effervescence in the inks in the ink conduits and inducing ejection of the inks through the nozzles. The width $P_3$ of the main heat pulse is determined by the surface area, magnitude of resistance, and film construction of the electric transducer and the liquid conduits of the recording head.

Figure 16A:
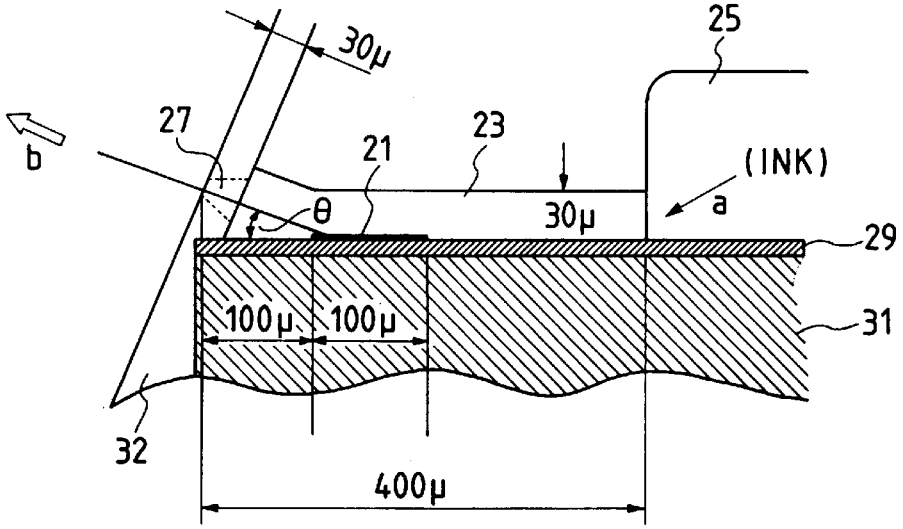
FIGS. 16A and 16B are diagrams illustrating the construction of a printing head.
Figure 16B:
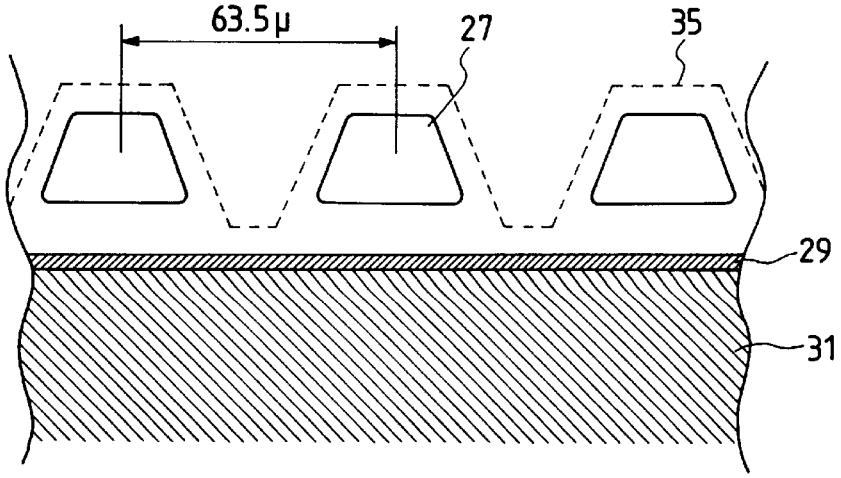

Now, the function of the pre heat pulse in the recording head constructed as illustrated in FIGS. 16A and 16B will be described below. FIGS. 16A and 16B respectively represent a schematic longitudinal cross section taken a long an ink conduit and a schematic front view, jointly illustrating one example of the construction of a recording head capable of utilizing the present invention. In the diagrams, an electric thermal transducer (ejection heater) 21 generates heat on receiving the split pulses mentioned above. This electric thermal transducer 21 is disposed on the heater board in conjunction with electrodes and wiring required for the application of the split pulses thereto. The heater board is formed of silicon 29 and supported by an aluminum plate 31 which serves as the substrate for the recording head. A ceiling board 32 has incised therein grooves 35 which are intended to form ink conduits 23. The union of the ceiling board 32 with the heater board (aluminum plate 31) gives rise to the ink conduits 23 and a manifold chamber 25 serving the purpose of supplying inks to the ink conduits 23. The ceiling board 32 has discharge mouths (or ejection orifices) 27 with which the relevant ink conduits 23 communicate.

Figure 17:
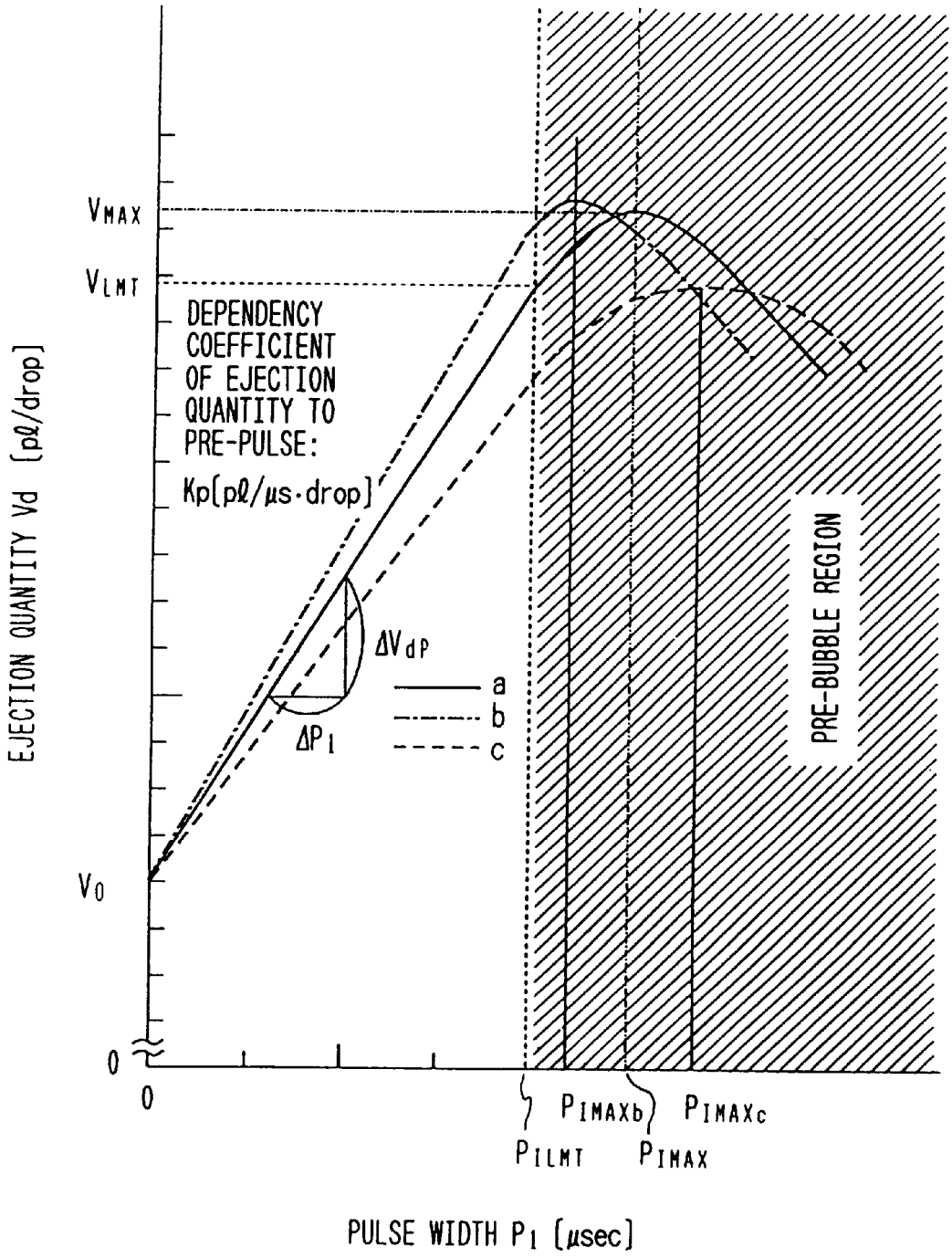
FIG. 17 is a diagram illustrating the dependency of the amount of ejection on the preheat pulse.

FIG. 17 is a diagram illustrating the dependency of the amount of ejection on the preheat pulse. In the diagram, $V_0$ stands for the amount of ejection obtained for $P_1$=0 [μsec] and the magnitude of this amount is determined by the construction of the head illustrated in FIGS. 16A and 16B. It is remarked from the curve of FIG. 17 that the amount of ejection $V_d$ increases with linearity proportionately to the increase of the width $P_1$ of the preheat pulse between 0 and $P_{1LMT}$ and the change of the amount of ejection loses the linearity when the pulse width $P_1$ surpasses $P_{1LMT1}$ and reaches saturation at the pulse width of $P_{1MAX}$.

The range up to the pulse width $P_{1LMT1}$ in which the change of the amount of ejection $V_d$ due to the change of the pulse width $P_1$ manifests the linearity is effectively utilized as the range in which the control of the amount ejection is easily attained by changing the pulse width $P_1$.

When the pulse width is larger than $P_{1MAX}$, the amount of ejection $V_d$ becomes smaller than $V_{MAX}$. When a preheat pulse having a pulse width falling in the aforementioned range is applied to the electric thermal transducer, very minute bubbles are produced on the electric thermal transducer (immediately before film effervescence). A main heat pulse is then applied before the bubbles cease to exist. Then, the amount of ejection is decreased by the fact that the aforementioned very minute bubbles are disturbed by the effervescence caused by the main heat pulse. This area is called a pre-effervescence area. In this area, the control of the amount of ejection through the medium of the preheat pulse is attained with difficulty.

In FIG. 17, if the inclination of the straight line indicating the relation between the amount of ejection and the pulse width in the range of $P_1$=0 to $P_{1LMT}$ [μs] is defined as the coefficient of dependency of the preheat pulse, then this coefficient of dependency of the preheat pulse will be represented as follows.

$$KP=\Delta V_{dp}/\Delta P_1 \ [pl/\mu\text{sec}\cdot\text{drop}]$$

This coefficient KP is determined by the head construction, drive conditions, and physical properties of ink and not by the temperature. To be specific, the curves b and c in FIG. 17 represent the data for other recording head and indicate that the characteristics of ejection are changed when the recording head is changed. The upper limit $P_{1LMT}$ of the preheat pulse $P_1$ varies when the recording head is changed as described above. Whenever the recording head is changed, the control of the amount of ejection is carried out with the upper limit $P_{1LMT}$ which will be newly set for the new recording head.

On the other hand, the temperature of the recording head (the temperature of ink) is another factor which determines the ejection quantity of the ink jet recording head.

Figure 18:
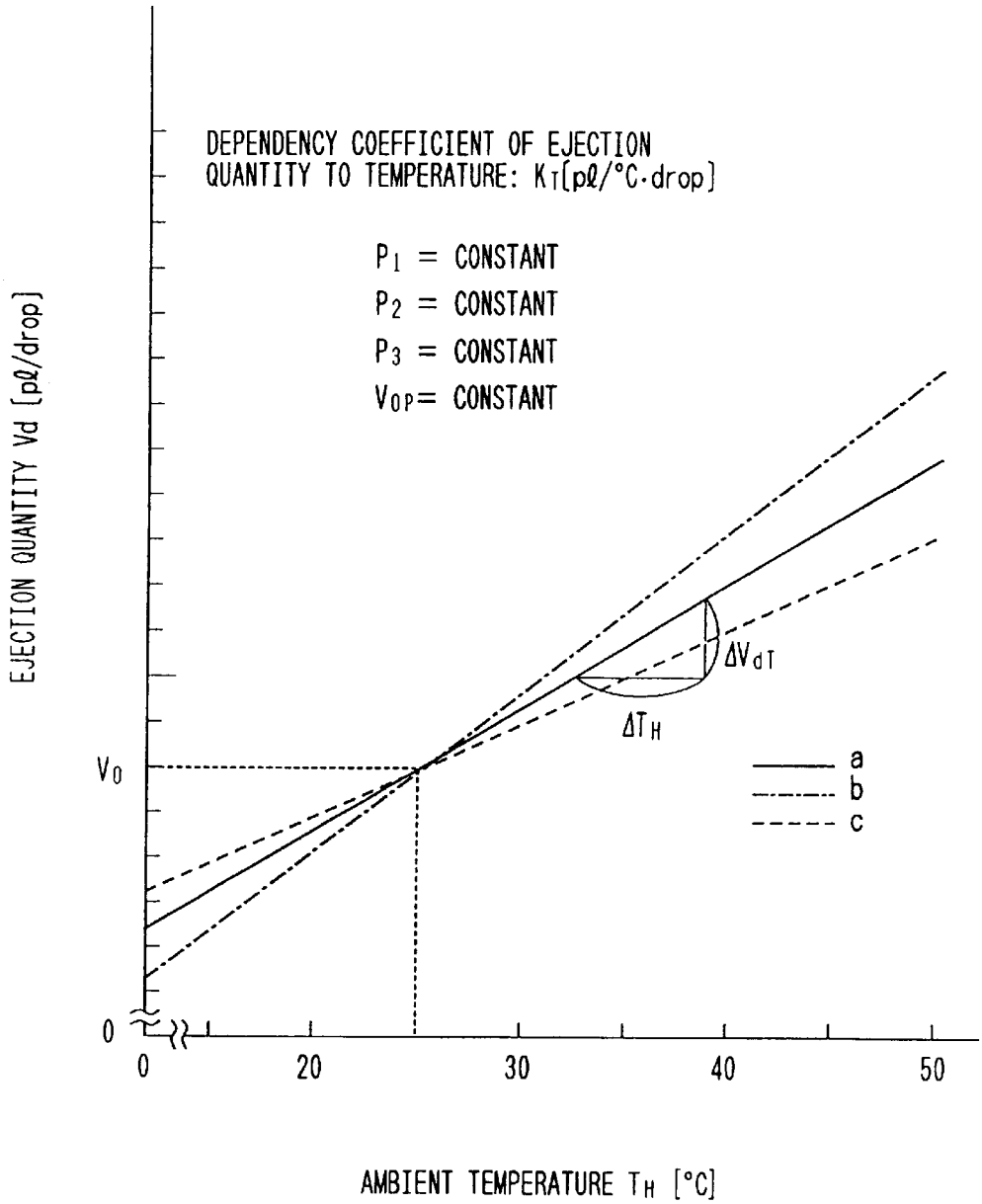
FIG. 18 is a diagram illustrating the dependency of the amount of ejection on the temperature.

FIG. 18 is a graph showing a temperature dependency of the ejection quantity. As shown with a curve a in FIG. 18, the ejection quantity Vd linearly increases along with an increase of the ambient temperature TR of the recording head (=head temperature TH). If this linear gradient is defined as a temperature dependency coefficient, the temperature dependency coefficient is as given below:

$$KT=\Delta VdT/\Delta TH\ [pl/^\circ\ \text{C.}\cdot\text{drop}]$$

This coefficient KT is determined by the construction of the head and properties of ink and not by the drive conditions. Also in FIG. 18, the ejection quantities of other recording heads are shown with curves b and c.

The control of ejection quantity according to the present invention can be carried out by using the relationships shown in FIGS. 17 and 18.

In the above example, PWM drive control with double pulses is described. However, the pulse can be multi-pulses such as, for example, triple pulses and the control can be a main pulse PWM drive system for which the width of the main pulse is modulated with a single pulse.

In this embodiment, the drive is controlled so that the PWM value is primarily set from a difference (ΔT) between the above-described target temperature and the head temperature. The relationship between ΔT and the PWM value is shown in FIG. 27.

In the drawing, "temperature difference" denotes the above ΔT, "preheat" denotes the above P1, "interval" denotes the above P2, and "main" denotes the above P3. "setup time" denotes a time until the above P1 actually rises after a recording instruction is entered. (This time is mainly an allowance time until the rise of the driver and is not a value which shares a principal factor of the present invention.) "weight" is a weight coefficient to be multiplied with the number of print dots to be detected to calculate the head temperature. In printing the same number of print dots, there will be a difference in the rise of head temperature between printing in the pulse width of 7 μs and printing in the pulse width of 4.5 μs. The above "weight" is used as means for compensating the difference of temperature rises along with modulation of the pulse width according to which PWM table is selected.

(Overall Flow Control)

Figure 28:
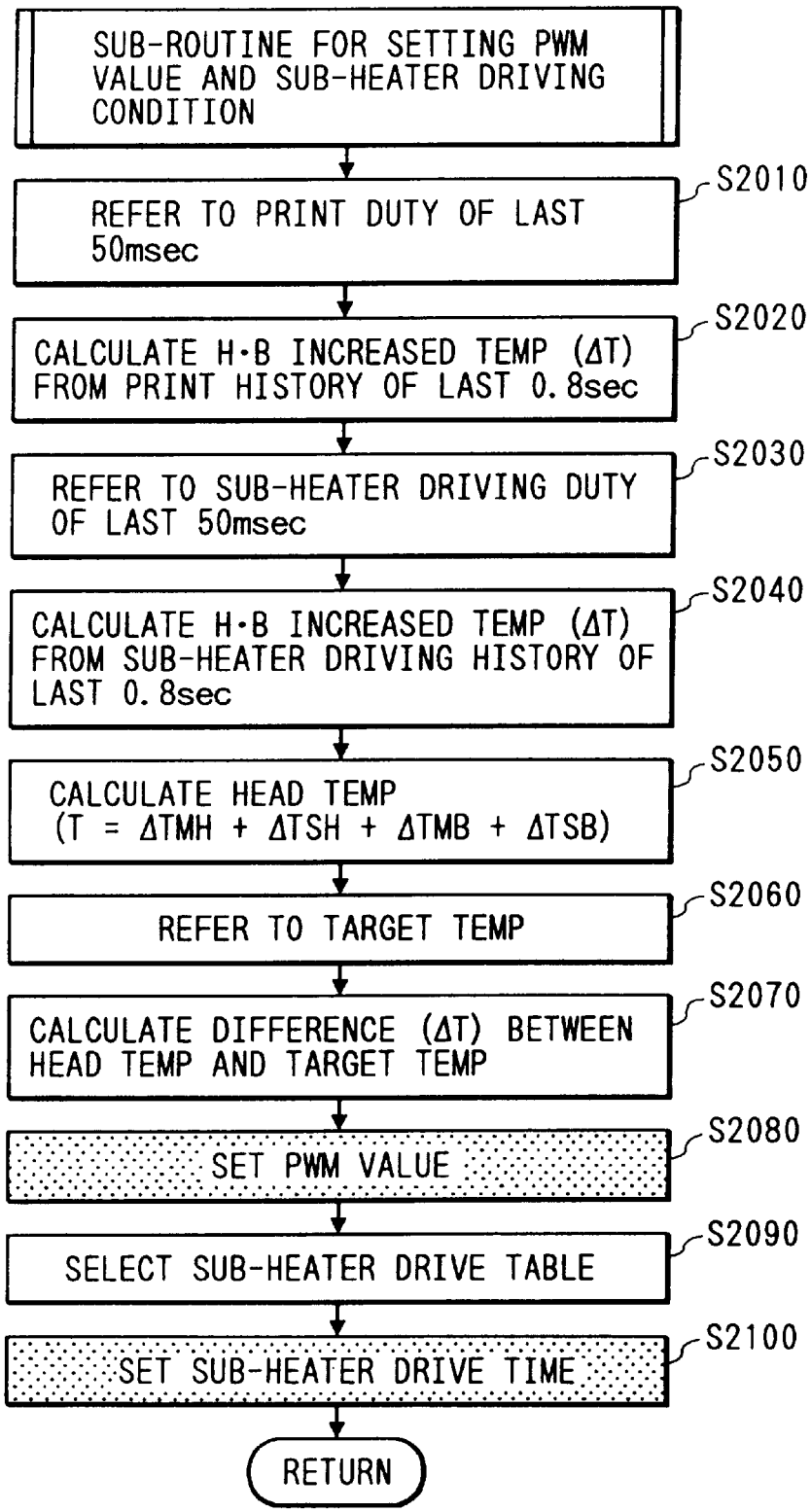
FIG. 28 is a flow chart illustrating a routine for setting the PWM/sub-heater drive conditions.
Figure 29:
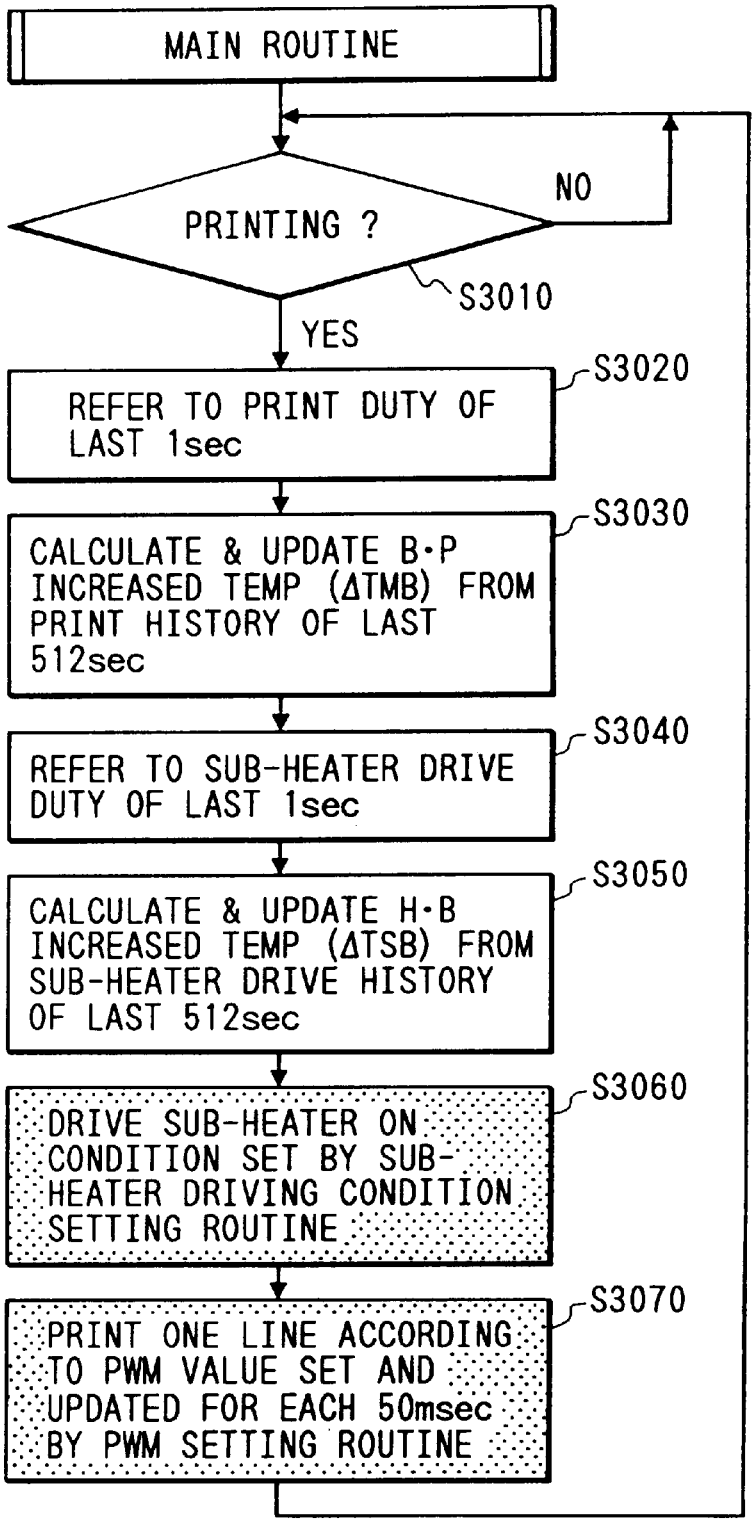
FIG. 29 is a flow chart illustrating a main routine.

The flow of the control system as a whole is described, referring to FIGS. 28 and 29.

FIG. 28 shows an interrupt routine for setting the PWM drive value and a sub-heater drive time for ejection. This interrupt routine occurs every 50 m sec. The PWM value and the sub-heater drive time are always updated every 50 m sec, regardless that the printing head is printing or idling and the drive of the sub-heater is necessary or unnecessary.

If the interrupt of 50 m sec is ON, the printing duty for 50 m sec shortly before the interrupt is referred (S2010). However, the printing duty to be referred to in this case is represented by a value obtained by multiplying the number of dots for which ink has been actually ejected by a weight coefficient for each PWM value as described in (PWM control). From the duty for this 50 m sec and the printing history for the past 0.8 seconds, the temperature rise (ΔTmh) of a group of components for which the heat source is the ejection heater and the time constants are of a short range is calculated (S2020). Similarly, the drive duty of the sub-heater for 50 m sec is referred to (S2030), and the temperature rise (ΔTsh) of a group of components for which the heat source is the ejection heater and the time constants are of a short range is calculated from the drive duty of the sub-motor for 50 m sec and the drive history of the sub-heater for 0.8 seconds (S2040). Then the head temperature is calculated by referring to a temperature rise (ΔTmb) of a group of components for which the heat source is the ejection heater and the time constants are of a long range and a temperature rise (ΔTsb) of a group of components for which the heat source is the sub-heater and the time constants are of a long range, which are calculated in the main routine, and adding up these values of temperature rises (=ΔTmh+ΔTsh+ΔTmb+ΔTsb). (S2050) A target temperature is set from the target temperature table (S2060) and a difference (ΔT) between the head temperature and the target temperature is obtained (S2070). A PWM value which is an optimum head drive condition in response to ΔT is set from the temperature difference ΔT, the PWM table and the sub-heater table (S2080). A sub-heater drive time which is an optimum head drive condition in response to the temperature difference ΔT is set (S2100) according to the selected sub-heater table (S2090). Up to the above, the interrupt routine is finished.

FIG. 29 shows the main routine. When the print instruction is entered in step S3010, the printing duty for the past one second is referred to (S3020). The printing duty is a value obtained by multiplying the number of dots for actual ejection by the weight coefficient for each PWM value as described in (PWM Control). A temperature rise (ΔTmb) of a group of components for which the heat source is the ejection heater and the time constants are of a long range is calculated from the printing history in the duty of one second and the past 512 seconds and stored as updated at a specified location of the memory (S3030) so that it can be easily referred to for the interrupt of every 50 m sec. Similarly, the drive duty of the sub-heater for one second is referred to (S3040), and a temperature rise (ΔTsb) of a group of components for which the heat source is the sub-heater and the time constants are of a long range is calculated from the printing history in the duty of one second and the past 512 seconds. As in the case of the temperature rise ΔTmb, the temperature rise ΔTsb calculated as above is stored as updated at a specified location of the memory so that it can be easily referred to for the interrupt of every 50 m sec (S3050).

Printing and driving of the sub-heater are carried out according to the PWM value and the sub-heater drive time which are updated upon each entry of the interrupt of 50 m sec.

In this embodiment, PWM of double pulse and single pulse are used for controlling ejection quantity and head temperature; PWM of triple pulse or more pulses may be used.

Even when the head is driven at a head chip temperature higher than a printing target temperature and PWM of a small energy, if the head chip temperature is unable to be reduced, the scanning speed for a carriage may be controlled, or the scanning start timing for the carriage may be controlled.

<Measurement of Head Characteristics>

Figure 14:
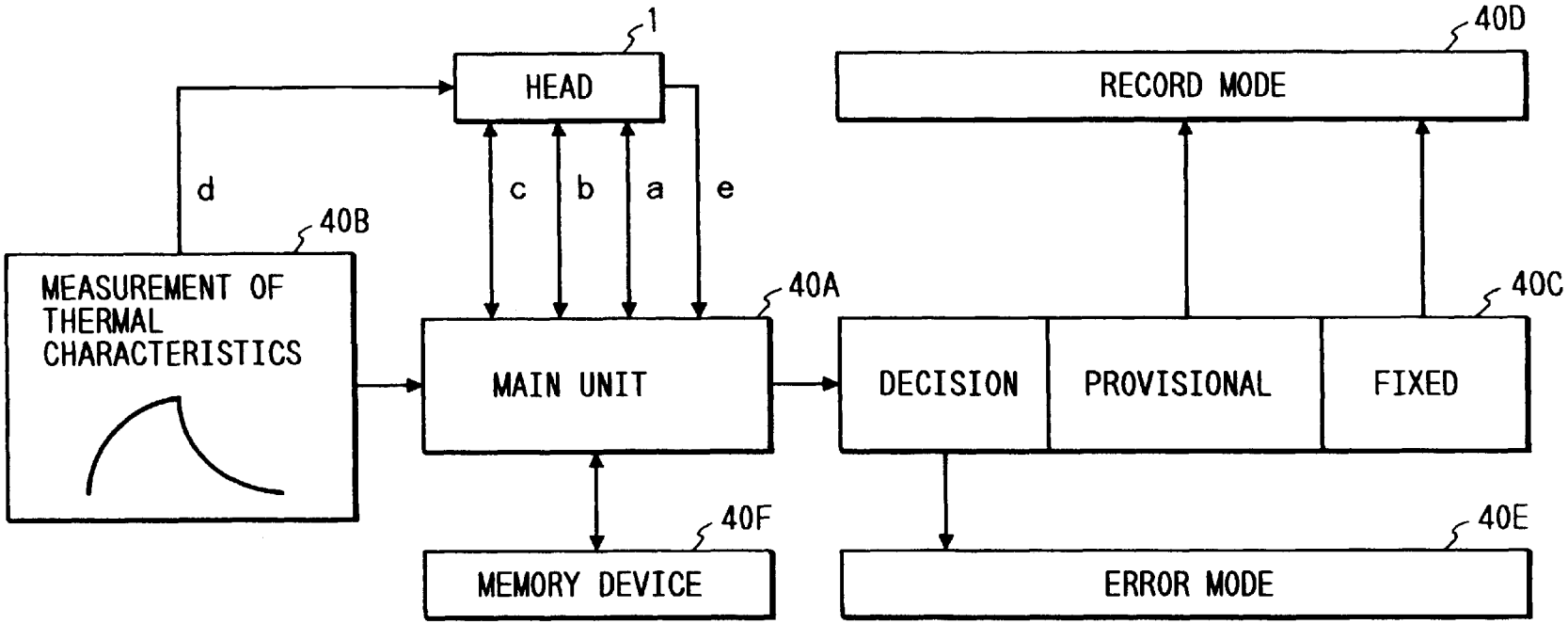
FIG. 14 is a block diagram illustrating the measurement of head characteristics.

For optimum head drive as stated before, the main unit of a recording device should identify various characteristics of a recording head. Moreover, in this embodiment, since a recording head 1 is in a replaceable fashion, the above mentioned head characteristics are measured without fail at head replacement. Items of measurement are the following four:

1) Ejection heater characteristics (dummy heater resistance value)
2) Diode sensor characteristics (diode sensor output)
3) Sub-heater thermal characteristics
4) Ejection heater thermal characteristics FIG. 14 shows a schematic diagram of measurement of head characteristics. This embodiment shows that head characteristics measured by a main unit are the above mentioned four items. In FIG. 14, a represents the measurement of ejection heater characteristics, b represents the measurement of (Di) sensor characteristics, c represents ejection heater characteristics, and d represents sub-heater thermal characteristics. There exist inputs and outputs, such as energy application, the measurement of temperature, etc., between a main unit 40A and a head 1, and a decision 40C on individual head characteristics is made on the basis of the results of the measurement 40B. Then, a definition as provisional or fixed may be made. On completion of deciding head characteristics, a record mode 40D is entered for becoming ready for recording. If the results of measurement of head characteristics are abnormal, an error mode 40E is entered, and the main unit 40A indicates an error. Individual head characteristic values are stored in a memory device 40F. The stored values are used to determine whether a head has been replaced or the same head as that used previously is used.

Individual head characteristics are hereinafter described in detail.

First, for ejection heater characteristics, a dummy resistance 20E (FIG. 10) is measured. When constant-voltage driving is used for driving a print head, how much energy is to be applied is known from the resistance value of an ejection heater. In this embodiment, a drive voltage application time is variable in correspondence with a dispersion in the resistance value of the ejection heater for optimum drive. In other words, a PWM table as shown in FIG. 27 is provided for each ejection heater characteristic (head rank).

Secondly, diode sensor characteristics are measured. An ambient temperature is measured by a thermistor built in the main unit of a recording device. A diode sensor reference output voltage and a temperature-output voltage characteristic (gradient value) at a reference temperature (for example, 25° C.) is previously known. Hence, a diode sensor output voltage at the above mentioned ambient temperature is converted to that at the reference temperature (25° C.), thereby measuring characteristics of a diode sensor by comparison with the diode sensor reference output voltage. Since the output of the diode sensor depends on a head temperature, characteristics of the diode sensor cannot be measured when a recording head is different in temperature from a main unit temperature or when sharp temperature changes exist. In such a case, it is needed to wait until the thermal stability is established.

Thirdly, thermal characteristics of a sub-heater are measured. The sub-heater functions to maintain a head temperature at a constant level (for example, 25° C.) for preventing ink ejection characteristics from deteriorating at low temperatures. As mentioned above in the paragraph of a head temperature calculation algorithm, the main body of the recording device has a calculation table for the sub-heater for temperature calculation. This calculation table contains temperature changes of the print head at a constant interval of time (way of heat transmission as viewed from a Di sensor). In actuality, the way of joining between members of a print head, an ejection quantity, a dispersion in a main unit power supply for heater drive, etc. cause the contents of the calculation table to vary for each print head. In this embodiment, temperature changes are divided into three patterns for easy-to-accumulate-heat print heads through hard-to-accumulate-heat heads, and corresponding three calculation tables mentioned above are provided.

For easy-to-accumulate-heat heads, because of high increased temperatures, values in the table are rather large even when an identical energy (duty) is applied. On the contrary, for hard-to-accumulate-heat heads, because of quick radiation of heat, values in the table are rather small. A center table 2 indicative of central conduction of heat for print heads is provided between a large-temperature-change table 3 (easy to accumulate heat) and a small-temperature-change table 1 (hard to accumulate heat).

Figure 13:
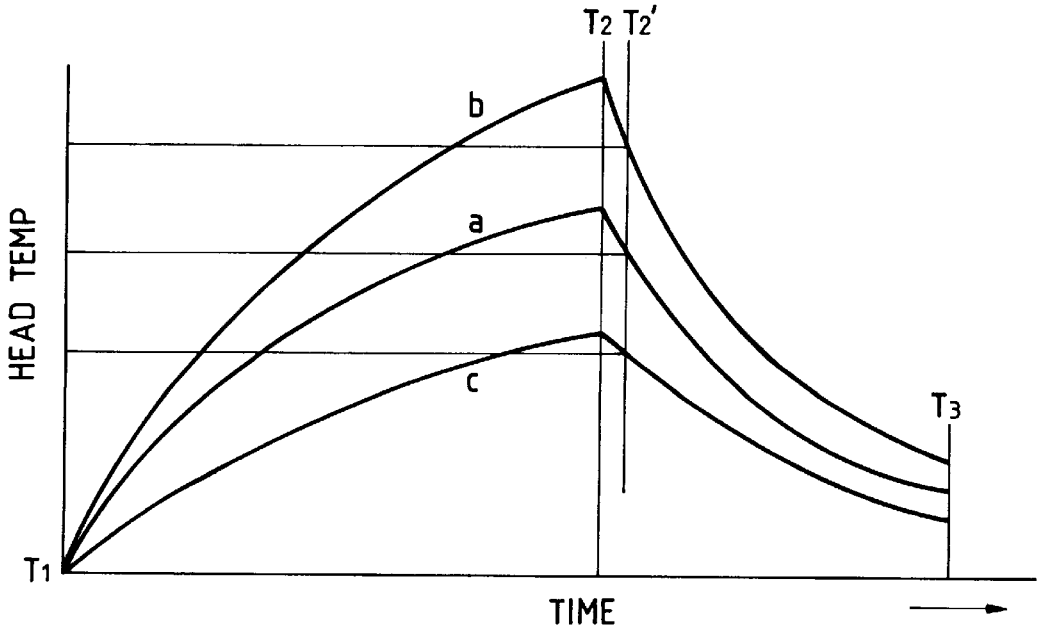
FIG. 13 is a diagram illustrating the rise and the drop of temperature during the measurement of thermal characteristics of a sub-heater.

Measurement of sub-heater thermal characteristics is intended to select a table. FIG. 13 shows an increase/decrease of temperature for each thermal characteristic at application of an identical energy. A diagram a represents a central increase/decrease of temperature, a diagram b represents an increase/decrease of temperature for the case of high increased temperatures due to large accumulation of heat, and a diagram c represents the one for the case of low increased temperatures due to small accumulation of heat. First, temperature is measured at a timing T1 before applying energy. Next, temperature is measured at a timing T2 before/after completion of applying energy. Finally, temperature is measured at a timing T3 after reduction of temperature. At this time, a measurement value for selecting a table is calculated as follows:

$$\text{Measurement value} = 2\times(\text{temperature at } T2) - (\text{temperature at } T1) - (\text{temperature at } T1)$$

When a target print head is easy to accumulate heat, a measurement value will be greater than a threshold 2; hence, the large-temperature-change table 3 is selected as a calculation table. On the contrary, if a measurement value is smaller than a threshold 1, the small-temperature-change table 1 is selected on the assumption that a head is hard to accumulate heat. Also, if the above mentioned measurement value falls between the threshold 1 and the threshold 2, the center table 2 is selected on the assumption that a head is a standard print head.

Table 1: measurement value<threshold 1

Table 2: threshold 1≦measurement value≦threshold 2

Table 3: threshold 2<measurement value

In this embodiment,

T2−T1=T3−T2 is taken, but this is not necessarily the one to stick to, depending on a threshold employed.

As explained above, setting a calculation table for each print head thermal characteristic allows calculation at a higher precision as compared with a method using uniform thermal characteristics, and provides beneficial effects including a low calculation load.

Fourthly, thermal characteristics of an ejection heater are measured. The operation of measurement is identical to that for the above mentioned method for measuring sub-heater thermal characteristics, but what is driven is the ejection heater.

In this embodiment, for measurement items of head characteristics, 1) priority is set,
2) a once measured characteristic value is digitized (divided into ranks) and stored, and
3) a stored characteristic value is compared with a newly measured characteristic value.

As a result, an identification (ID) of a recording head itself can be set, thereby reducing the time of measurement of head characteristics and improving efficiency of measurement.

First, measurement values of an ejection heater and a diode sensor are divided into ranks for management. This method allows the easy handling of measurement values for comparison with previous measurement values and for storing/saving in the main unit of a recording device.

<Ejection Heater Characteristics>

Ejection heater characteristics, as mentioned before, are represented with a dummy resistance 20E. In this embodiment, explained is the case where a dispersion of the dummy resistance 20E is 272.1 Ω±about 15%. As shown in FIG. 3, a dispersion of resistance values is divided into 13 ranks. A center value is taken as rank 7, and the width of a resistance value within one rank is about 8 Ω, about 2.3% of an overall dispersion. Division into finer ranks allows head rank setting at a higher precision, but requires a read circuit of a higher precision on the main unit side of the recording device. After the recording device has read head ranks, when the read head ranks are written to memory members (EEPROM, NVRAM, etc.), the above mentioned numbers 1 to 13 are stored for each of four heads.

<Diode Sensor Characteristics>

As in the case of the aforementioned head ranks, characteristics of a diode sensor (hereinafter referred to as Di sensor) are also divided into ranks for similar reason. Among Di sensors, there exists not so much a dispersion in a coefficient of proportion (hereinafter referred to as gradient) for temperature-output voltage (when used for head temperature management in this embodiment); however, offsets (dispersion of output values at the same temperature) disperse considerably among sensors. Hence, even when an identical output voltage is obtained, an absolute value of a head temperature is unknown unless Di sensor characteristics (ranks) are known.

Figure 4:
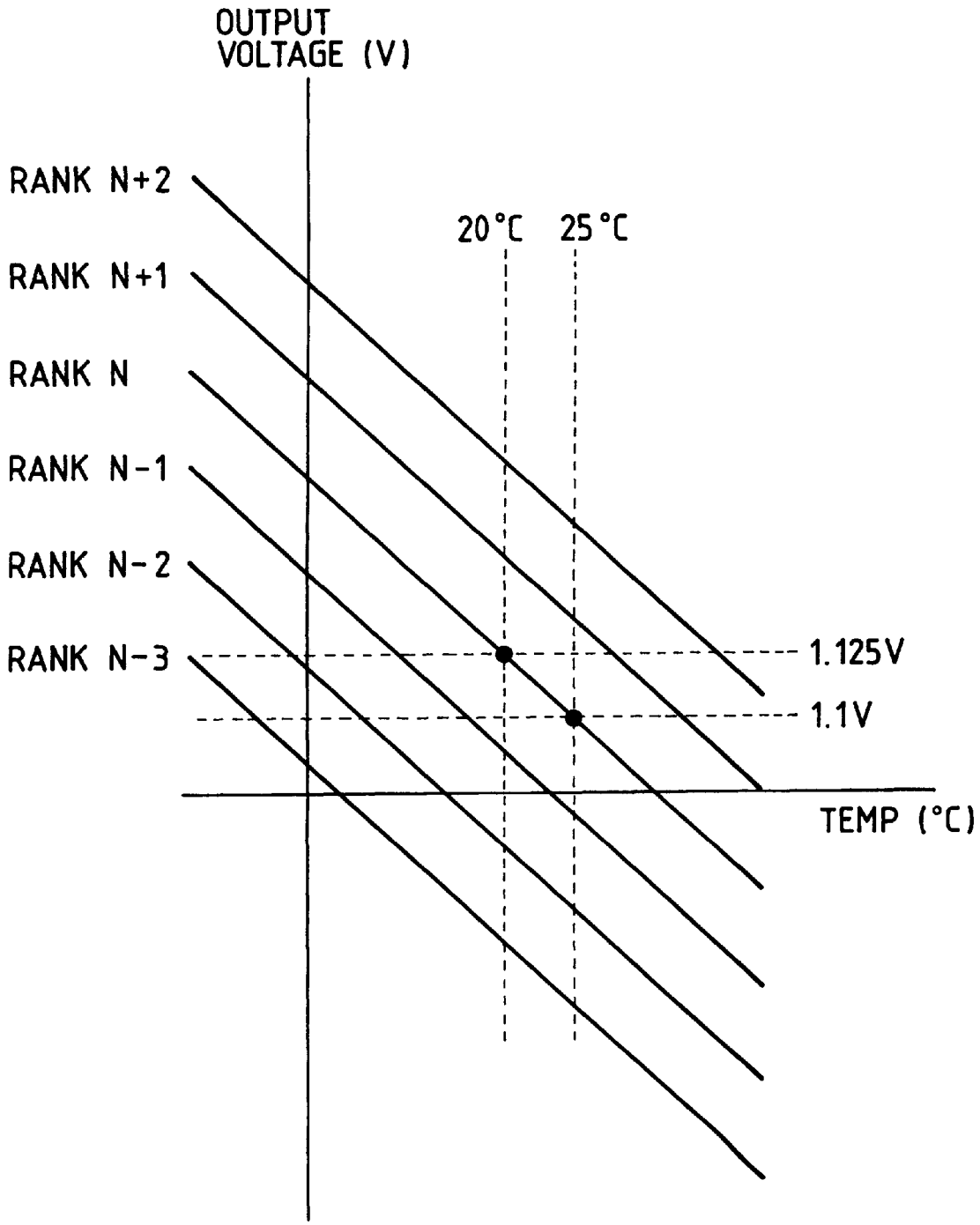
FIG. 4 is a diagram illustrating the relation between the temperature and the output voltage of a Di sensor.

FIG. 4 illustrates Di sensor ranks. Taking temperature along the axis of abscissa and the output voltage of a Di sensor along the axis of ordinate, FIG. 4 diagrams center values of each rank. In actuality, a voltage value having a width is in contact with that of an adjacent rank for each rank. Assume that an output is 1.125 V when the Di sensor of a certain head is at 20° C. (when a thermistor temperature is considered identical to a head temperature, a correction is made so that the thermistor temperature agrees with a Di sensor temperature). As mentioned before, a gradient is substantially constant, and in this embodiment, the gradient is as follows:

$$-5.0\ [\text{mV}/^\circ\ \text{C.}]$$

Hence, an output voltage converted to that at 25° C. is 1.1 V. Thus, the output voltage value of a Di sensor is converted to that at an ambient temperature of 25° C. by using a gradient value, and the converted value is compared with a previously prepared conversion table for determining a rank. Di sensors in this embodiment has the following dispersion of output voltage at 25° C.

$$1.1\pm0.05\ [\text{V}]$$

Hence, from the aforementioned gradient value of −5.0 mV/° C., a dispersion of ±10° C. occurs at the same output voltage. Therefore, with a total number of ranks being set to 10, a temperature dispersion in one rank is 2° C., and with 20 ranks set, the same is 1° C. The above mentioned number of ranks is determined at a precision required for head temperature management. However, as the number of division ranks increases, the detection width for a divided voltage becomes accordingly narrower; hence, the precision of a detection circuit needs to be accordingly higher. Thus, ranks for ranked Di sensors are stored for each color head.

<Sub-Heater/Ejection Heater Characteristics>

For sub-heater/ejection heater characteristic values, aforementioned calculation table numbers are stored as rank values for each heater.

A print head for which ranks have been set as mentioned above, has rank values for an ejection heater and a Di sensor for each color. By arranging and digitizing the above mentioned rank numbers, the above mentioned recording head characteristics can be expressed, for example, like 77672031 (head rank KCMY, Di sensor rank KCMY) to represent information on each color for a 4-color head. Likewise, by digitizing and then storing the results of measurement of sub-heater thermal characteristics and ejection heater thermal characteristics, a numerical string representing recording head characteristics (hereinafter referred to as recording head characteristic number) is generated.

According to the aforementioned description, recording head characteristics are represented, for example, by 7767203122232221 (head rank KCMY, Di sensor rank KCMY, sub-heater thermal characteristic KCMY, ejection heater thermal characteristic KCMY). This embodiment has shown a recording device having four heads; even in a recording device having only a single head or four or more heads, the above mentioned head ID can be handled in sufficiently effective fashion and can be used for head identification.

Here, the order of priority is set for print head characteristics as mentioned before. To give an example, print head characteristics are arranged below in the descending order of priority.

1) Ejection heater characteristics (dummy heater resistance value)
2) Diode sensor characteristics (diode sensor output)
3) Sub-heater thermal characteristics
4) Ejection heater thermal characteristics Measurement items of high priority are measured unconditionally. After print head characteristics have been measured in the above mentioned order, if a print head characteristic value (rank value) is equal to that stored previously, measurement items of lower priority are considered equal to those stored previously with respect to a recording head itself, and measurement of items of lower priority is omitted, taking previously stored values in a recording head characteristic number as those representing characteristics.

Figure 1:
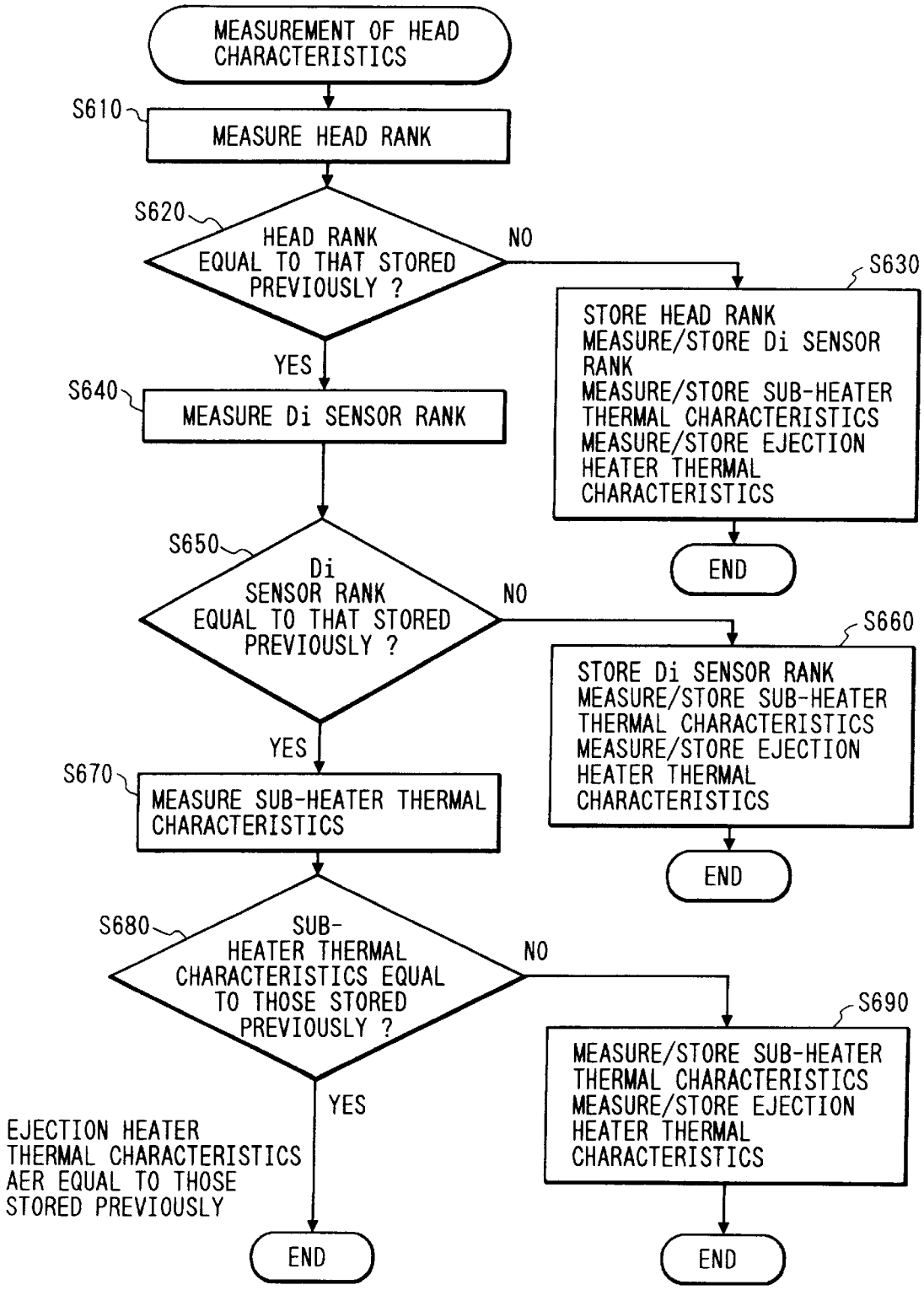
FIG. 1 is a flow chart illustrating the sequence of measurement of head characteristics in Example 1.
Figure 2:
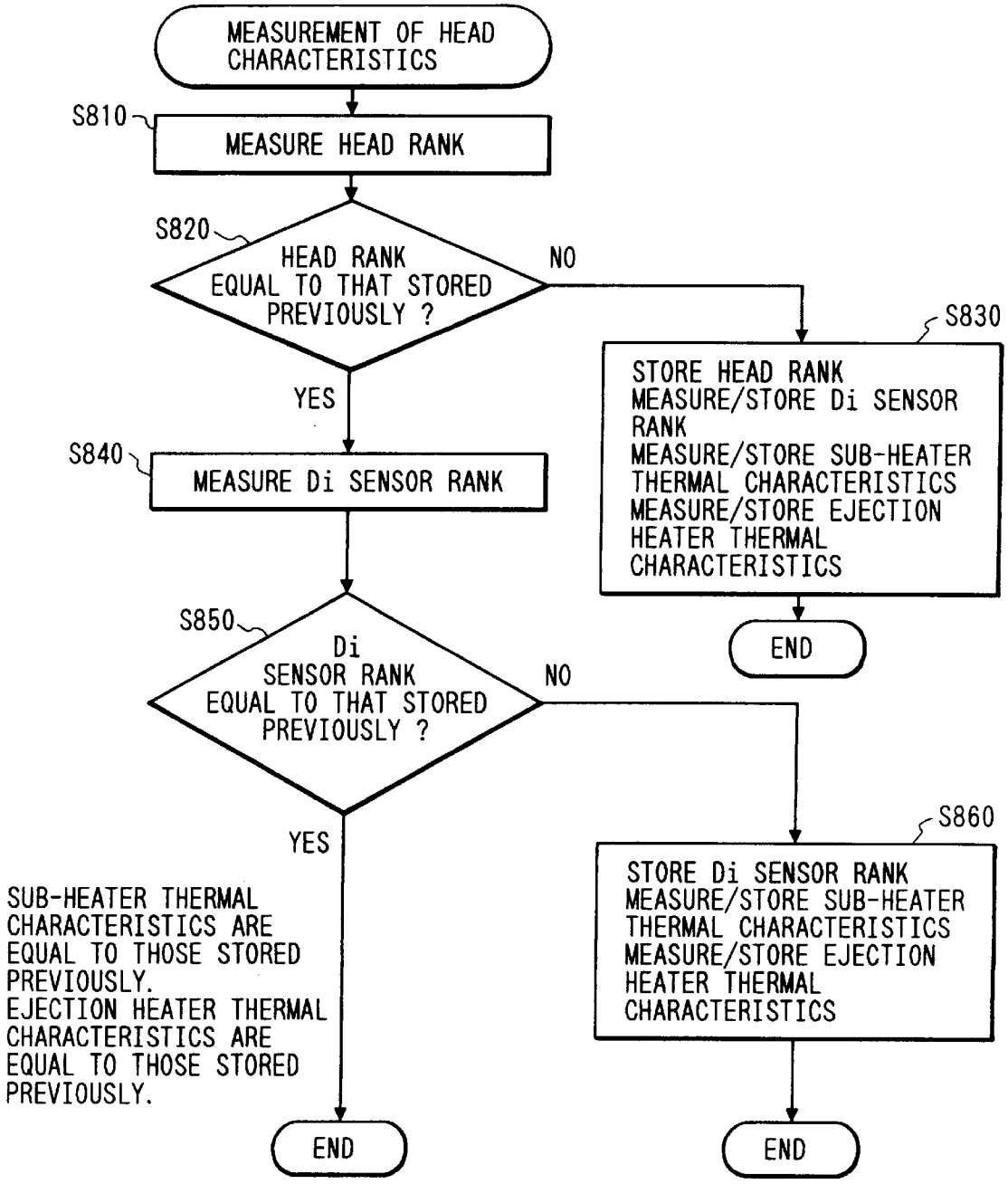
FIG. 2 is a flow chart illustrating a modification of Example 1.

FIG. 1 is a flow chart where characteristics down to sub-heater characteristics are measured at steps S610 to S670, and at step S680, the measured sub-heater thermal characteristics are compared with the above mentioned recording head characteristic number, and if they are equal to each other, ejection heater thermal characteristics are not measured. If unequal to each other, individual characteristics are measured and stored at steps S630, S660, and S690. FIG. 2 shows the case where head characteristics down to Di sensor characteristics are measured at steps S810 to S840, and if the measured characteristics are equal to those in the above mentioned recording head characteristic number, subsequent items are not measured, and corresponding values stored previously are used instead.

As explained above, by digitizing and then storing characteristics of a print head, the stored data can be used as an identification number (hereinafter referred to as an ID number) for a recording head itself. By using this ID number, the time required for measuring recording head characteristics can be reduced.

Since the above mentioned priority depends on the degree of necessity for measurement and a measurement time, the priority shown in this embodiment is not necessarily all about priority. By dividing aforementioned ranks finer for a higher precision, only ejection heater characteristics may be used for determining whether the same head as that used previously is used, for determining recording head characteristics.

Also, in the case of only reading information from the head side, like e in FIG. 14, for example, in a method of counting contacts on the head side or reading head characteristic values from a memory device on a head, the above mentioned idea of ID is applicable.

EXAMPLE 2

In this embodiment, a rank value of a Di sensor is further defined (as provisional/fixed) for simplifying and improving the precision of measurement of recording head characteristics. In this embodiment, only a Di sensor rank is made to differentiate into provisional and fixed. As mentioned before, the measurement of a Di sensor rank is not accurate unless temperature near a Di sensor is free from changes and is constant. For this reason, in the first embodiment, a rank measurement is not made until a Di sensor value becomes constant to a certain extent. Hence, the measurement of head characteristics always takes time.

Figure 5:
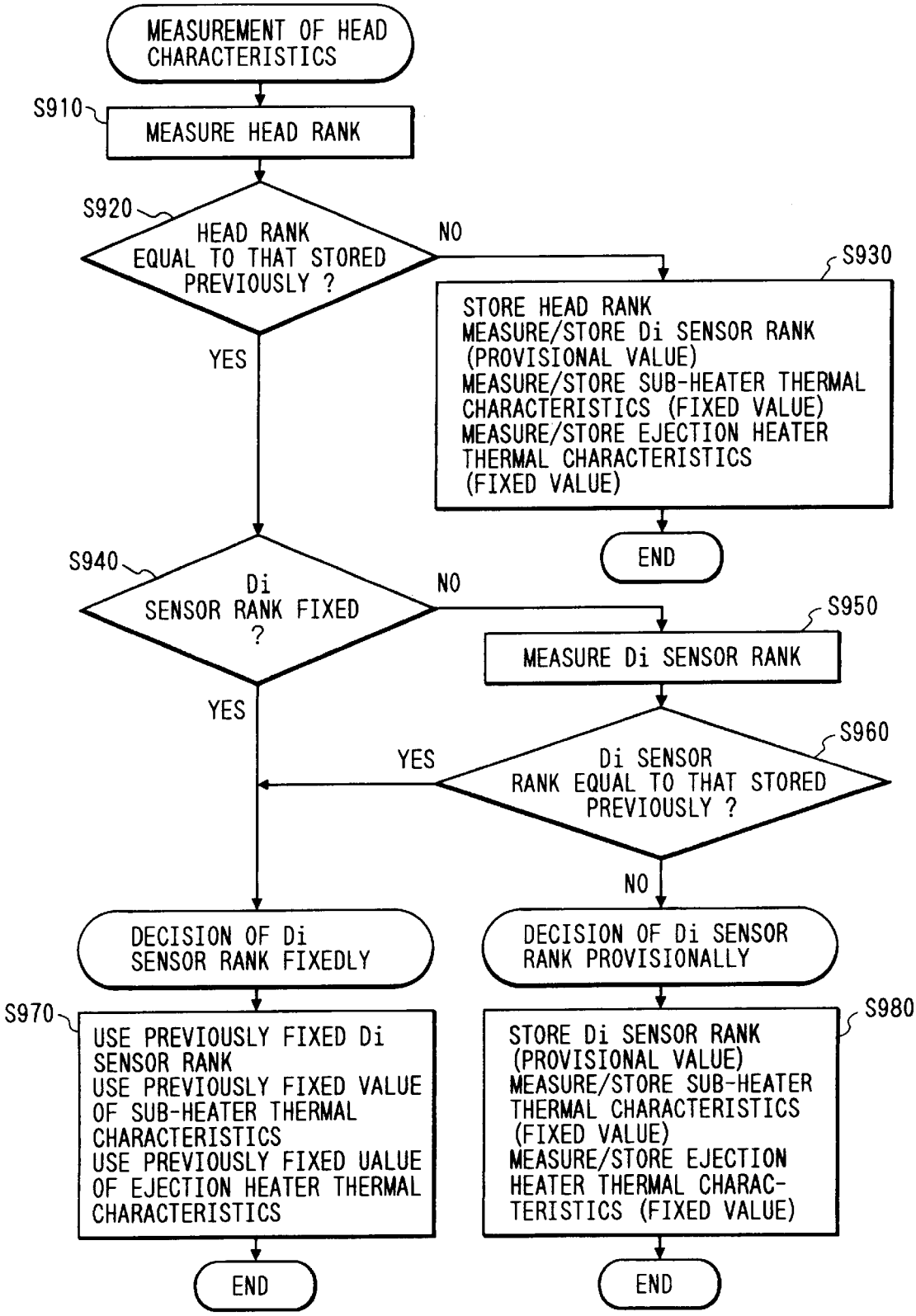
FIG. 5 is a flow chart illustrating the sequence of measurement of head characteristics in Example 2.

For shortening the time of measurement of head characteristics, the measurement of a Di sensor rank is defined as provisional/fixed. FIG. 5 is a flow chart of this embodiment.

Also, in this embodiment, first, a head rank is measured at step S910, and if the measured head rank is different from that stored previously, the measured head is considered a different head, and head characteristics are all measured (steps S920 and S930). At this time, a Di sensor rank is stored as a provisional value because of a first measurement value. At the next measurement of head characteristics, for example, at receptacle ON, a head rank is measured at step S910, and if the measured head rank is found, at step S920, equal to that stored previously, whether or not a Di sensor rank is a fixed value, is checked at step S940. Since the previously stored value is a provisional value, a Di sensor rank is measured again at step S950. If the measured Di sensor rank is equal to the previously stored provisional rank value with respect to all four colors, these rank values are considered correct Di sensor ranks and stored as fixed values at step S970.

On the other hand, at the second measurement, if a measured Di sensor rank is unequal to a previously stored provisional rank value with respect to even one color, the measured Di sensor rank is taken as a provisional value on the assumption that a different head is used, and at step S980, sub-heater thermal characteristics and ejection heater thermal characteristics are measured. This assumes a recording head which is equal in head rank (combination of sheet resistance values), but different in other head characteristics.

In this embodiment, if a measured rank is found equal to that stored previously at two measurements, the measured rank becomes a fixed value; however, setting may be such that if a measured rank is found equal to that stored previously at three or more measurements, the measured rank becomes a fixed value. In this manner, once a Di sensor rank becomes a fixed value, the measurement of items other than a head rank is omitted on the assumption that the same head as that used previously is used; consequently, there is no need for waiting until temperature becomes stable. Thus, once a Di sensor rank is fixed (since a recording head is not so often replaced, a fixed value is soon assumed), the measurement of head characteristics can be completed within a quite short time. Also acceptable is a method that the aforementioned center calculation table is used as a provisional value table.

EXAMPLE 3

Figure 6:
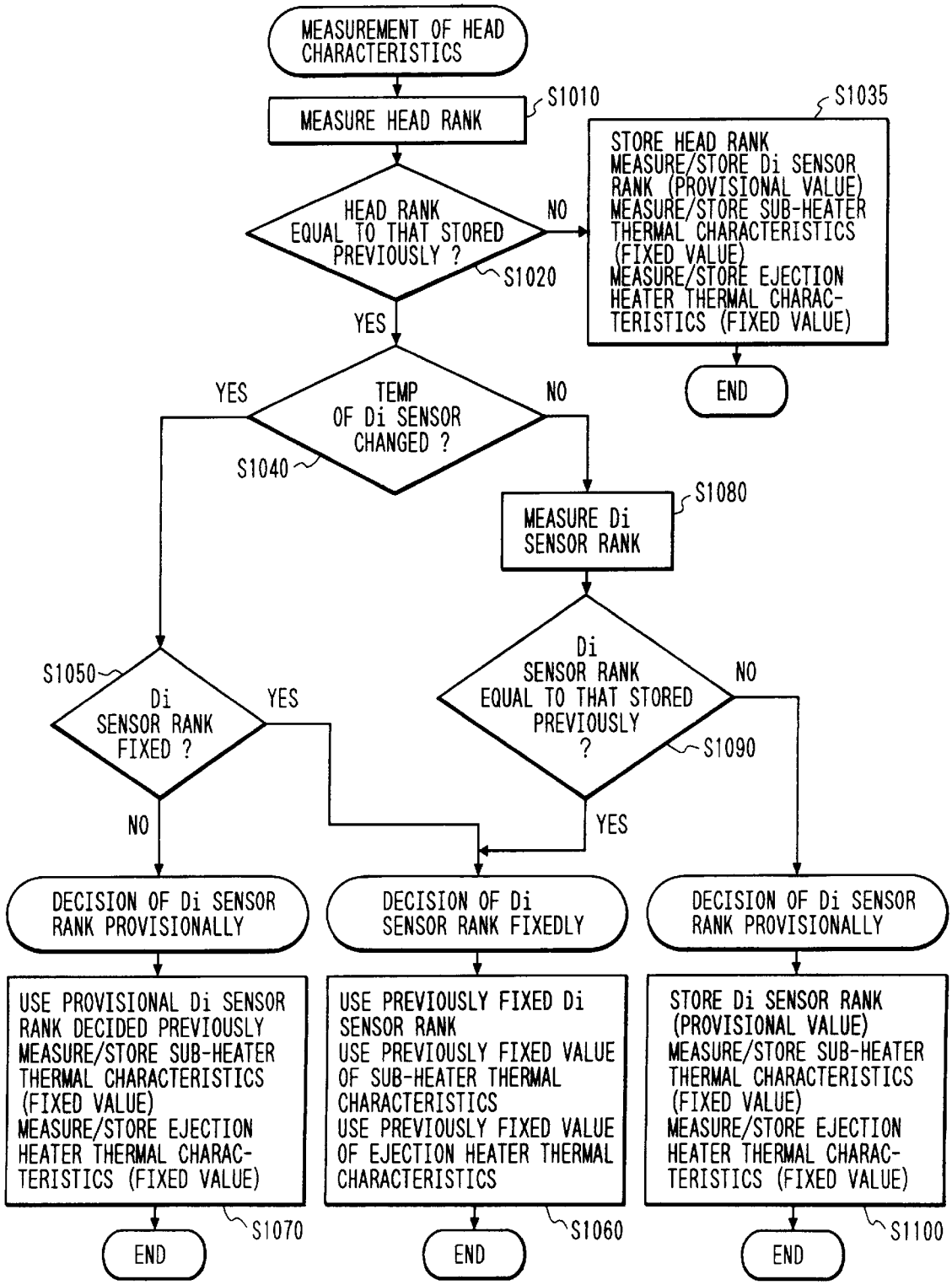
FIG. 6 is a flow chart illustrating the sequence of measurement of head characteristics in Example 3.

This embodiment determines whether there exist temperature changes at measurement of head characteristics. FIG. 6 is a flow chart of this embodiment.

First, a head rank is measured at step S1010, and if the measured head rank is found, at step S1020, unequal to that stored previously, head characteristics are all measured at step S1035 on the assumption of a different head's being mounted, regardless of temperature changes near a Di sensor. However, a Di sensor rank is stored as a provisional value in wait for another measurement (similar to embodiment 2).

Next, when a head rank is found, at step S1020, equal to that stored previously, a Di sensor is checked for temperature changes at step S1040. Since a Di sensor allows temperature changes thereof to be recognized even when a rank value thereof is not determined, whether or not temperature near the Di sensor is stable, is determined by checking temperature changes within a fixed time.

In this embodiment, a temperature change of 0.2° C. or higher within 10 seconds is defined as the presence of temperature changes. If it is determined at step S1040 that there is a change in temperature, this denotes that this condition is unsuited for measuring a Di sensor rank; consequently, the measurement of Di sensor rank (measurement of output voltage) is not conducted, and a previously fixed Di sensor rank value is used at step S1060. At this time, as in embodiment 2, the idea of defining as provisional/fixed is used. When a previously stored Di sensor rank is found to be a fixed value at step S1050, previously stored characteristic values are used on the assumption that a recording head identical to that at the previous measurement of characteristics is mounted.

On the other hand, if a previously stored Di sensor rank is found to be a provisional value at step Sl050, the above mentioned provisional value is used at step S1070. In this embodiment, sub-heater/ejection heater thermal characteristics are remeasured; however, since a Di sensor rank is a provisional value, previously stored values of sub-heater/ejection heater thermal characteristics may be used, or the aforementioned center table may be used as a provisional value table. In such a case, measurement of sub-heater/ejection heater thermal characteristics is not susceptible to the aforementioned change of temperature near a print head. However, because of using provisional values, it is necessary to remeasure head characteristics as soon as possible.

If it is determined at step S1040 that the above mentioned change of temperature is not present, a Di sensor rank can be measured in a short time, and hence, a Di sensor rank is measured at step S1080. The measured Di sensor rank is compared, at step S1090, with that stored previously, and if they are found equal to each other, a Di sensor rank is considered fixed, and previously stored values of sub-heater/ ejection heater thermal characteristics are used at step S1060 on the assumption that the same head as that used previously is used. On the other hand, if at the above mentioned comparison, the measured Di sensor rank is found unequal to that stored previously, the measured Di sensor rank is considered a provisional value, and sub-heater/ejection heater thermal characteristics are remeasured at step S1100 on the assumption that a different head is used.

As explained above, the above mentioned measurement of rank is determined from a change in temperature of a Di sensor before measuring a Di sensor rank, thereby achieving an accurate measurement of rank. In addition, even when measurement of a Di sensor rank is unsuited due to the presence of the above mentioned change in temperature, combined provisional and fixed characteristic values enable rank operations at a high precision. Also, if a head rank is equal to that stored previously and a Di sensor rank is a fixed value, previously stored values of head characteristics may be used regardless of a change in temperature.

EXAMPLE 4

In this embodiment, after completing the aforementioned measurement of head characteristics, the remeasurement of head characteristics is conducted. At ordinary start-up of a recording device (when the aforementioned measurement of head characteristics is to be conducted without fail), central characteristic values like provisional values, etc. are used to shorten the above mentioned start-up time for making the recording device ready to use. Then, the above mentioned remeasurement of head characteristics (hereinafter referred to as correction of head characteristics) is made while the recording device is not used by a user, for deciding more accurate fixed values from head characteristic values used as provisional values, thereby improving the precision of head control.

Figure 7:
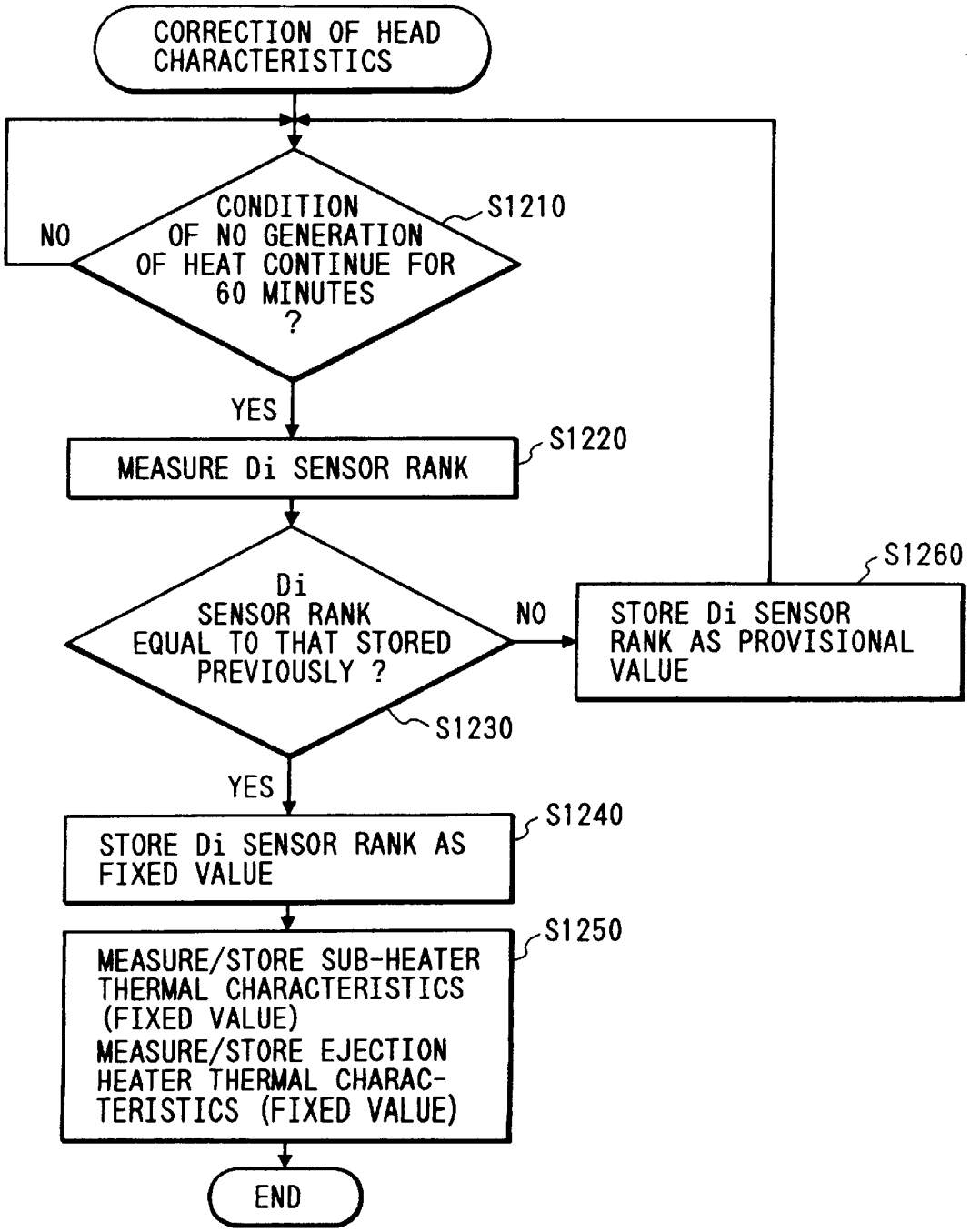
FIG. 7 is a flow chart illustrating the sequence of measurement of head characteristics in Example 4.

This is flow charted in FIG. 7. In this embodiment, a Di sensor rank is measured after no generation of heat has continued for 60 minutes at a recording head of the recording device. This generation of heat is that when an ejection heater or a sub-heater is driven. Hence, when neither of the ejection heater and the sub-heater have been driven for last 60 minutes at step S1210, this is interpreted as no generation of heat, and the measurement of a Di sensor rank is executed at step S1220 on the assumption that there is no change in temperature near a recording head. The reason why this embodiment employs a time of no generation of heat of 60 minutes is, as shown in FIGS. 11 and 12, that a plurality of (four) recording heads are integrated into one unit and that a carriage 3 wherein the recording heads are positioned and fixed, does not have sufficient space to groove for heat radiation. The length of the above mentioned time depends on the form of the heads and the carriage or a required precision of a Di sensor rank.

Next, at step S1230, a measured Di sensor rank value is compared with a previously stored value, and if they are equal to each other, the measured Di sensor rank is stored as a fixed value at step S1240. At step S1250, sub-heater/ejection heater thermal characteristics are remeasured using the fixed value, for storing the measured thermal characteristics as final recording head characteristic values. If the above mentioned measured Di sensor rank is found unequal to that stored previously, the measured Di sensor rank is stored as a provisional value at step S1260, and then, a sequence of waiting for a 60-minute continuation of no generation of heat is again entered.

In FIG. 7, when a Di sensor rank is fixed once and sub-heater/ejection heater thermal characteristics are measured, the above mentioned correction of head characteristics is completed. A routine may be such that after fixing a Di sensor rank and then completing the measurement of sub-heater/ejection heater thermal characteristics, a return to the initial sequence of waiting for a 60-minute continuation of no generation of heat is made for repeating the operation of correction.

Also, in this embodiment, a tolerance is set for a rank, which is a head characteristic value, for determining whether a measured rank is equal to that stored previously and whether the same head as that used previously is used. For example, at measurement of head characteristics as explained in embodiments 1 to 3, top priority is given to the shortening of startup time for putting a recording device ready for use, and a tolerance of ±2 ranks is set for determining whether an identical head is used and whether a measured rank is equal to that stored previously (with respect to Di sensor, sub-heater, and ejection heater). Thus, by setting criteria having a tolerance, a head can be identified as an identical head in spite of involving a dispersion of measurement, etc., thereby shortening the start-up time by using previously stored values. For correction of head characteristics, top priority is given to accuracy, and a tolerance of ±1 rank is set for determining whether a measured rank is equal to that stored previously. In this manner, by narrowing a tolerance, fixed rank values of characteristics become accurate. Such a tolerance for precision is not limited to the above mentioned values, but is variable as needed.

As a modification of the above mentioned case of using rank values at head identification, there is a method that a head is identified as the same head as that used previously if the sum of absolute values of a difference between rank values before and after measurement with respect to each color is smaller than a certain value.

With a stored value before measurement of rank being

6–7–8–7 (head rank KCMY) and a measured value after measurement of rank being

6–6–8–8 (head rank K'C'M'Y'), the sum of absolute values of a difference between rank values before and after measurement with respect to each color is represented by $$|K-K'|+|C-C'|+|M-M'|+Y-Y'| \qquad \text{Expression (1)}$$

specifically, $$|6-6|+|7-6|+|8-8|+|7-8|=2.$$

According to the aforementioned method, a head may be identified as the same head as that used previously for a value of up to 4 calculated by the above expression. According to the method of expression (1), a head can be identified at a high precision. This explanation used head rank values, but a head may be identified by using all or some head characteristic values.

As explained above, according to embodiments 1 to 4, a recording head can be simply identified by using information associated with the determination of driving conditions for heat generation elements for recording, i.e. ejection heater resistance characteristics, temperature sensor characteristics, and ejection heater/sub-heater thermal characteristics, particularly by using ejection heater resistance characteristics.

Also, in the above mentioned embodiments, shortening a start-up time for a recording device and improving a precision of measurement of head characteristics are possible by 1) using head characteristic values as ID for a recording head,
2) defining the idea of provisional/fixed for head characteristics,
3) determining whether to measure head characteristics on the basis of thermal condition of a recording head, and
4) differentiating a rank tolerance at correction of head characteristics from that at ordinary start-up.

According to the above mentioned embodiments, provided can be a method of identifying a recording head as the same recording head as that used previously or a new recording head after replacement, by using information which is used for determining the conditions of driving heat generation elements for ink ejection of an ink jet recording head and is obtained from the recording head. In this manner, by paying attention to information used for determining the conditions of driving heat generation elements for ink ejection, a dispersion and a recording quality during actual drive can be guaranteed, and recording can be started without re-setting new driving conditions when a recording head is replaced with an equivalent one, thus eliminating waste associated with setting and maintaining a high recording quality.

Combining a plurality of pieces of the above mentioned information to make information for identification is preferable in view of improvement of precision of identification. A plurality of pieces of information mentioned above include information on physical characteristics of an ejection heater itself of a recording head and information on physical characteristics of an element itself used for detecting temperature of the recording head, or include information on temperature changes obtained by driving the above mentioned heat generation elements of the recording head and information on temperature changes obtained by driving heating elements used for controlling temperature of the recording head, thereby improving precision of identification. Also, it is preferable to identify a recording head as the same recording head as that used previously or a new recording head after replacement, by using information on temperature changes obtained by driving the first component heat generation element of the recording head and information on physical characteristics of the second component element itself of the recording head, both information being for determining conditions of driving heat generation elements for ink ejection of the ink jet recording head. In particular, a recording head comprising integrated four head portions has an advantage of reducing the number of pieces of information used for the identification.

EXAMPLE 5

This embodiment is identical to the aforementioned embodiment 1 in temperature calculation algorithm, ejection quantity, control method, etc. What is different from embodiment 1, is explained below.

<Measurement of Head Characteristics>

Head characteristics and corresponding drive pulse waveforms, etc. are explained in detail below.

First, for ejection heater characteristics, a dummy resistance 20E (FIG. 10) is measured. When constant-voltage driving is used for driving a print head, how much energy is to be applied is known from the resistance value of an ejection heater. In this embodiment, a drive voltage waveform is variable in correspondence with a dispersion in the resistance value of the ejection heater for optimum drive. In other words, a basic pulse waveform and a PWM table as shown in FIGS. 30 to 32, respectively, are provided for each ejection heater characteristic (head rank). FIG. 32 shows the pulse width of a pre-heat pulse $P_1$, and weight for temperature calculation.

Described here is the basic waveform of drive pulses corresponding to head ranks. (The basic waveform of drive pulses corresponding to head ranks is hereinafter referred to simply as "basic waveform".) The basic waveform of drive pulses is important and used as a basis for driving various recording heads.

As a first objective, printing is driven on the basis of the above mentioned basic waveform. A driving waveform is set according to a head rank, for achieving the stable ejection state of a recording head and the long life of an ejection heater. Hence, under ordinary environmental conditions, the basic waveform may be used for printing unless the recording head has increased temperature thereof by printing at a high duty. In this embodiment, a double-pulse waveform is used as a basic waveform. When a recording head temperature is lower than a predetermined temperature, the above mentioned sub-heater executes temperature control to compensate an ejection quantity. On the contrary, when a recording head temperature is higher than a predetermined temperature, the width of a leading pulse (pre-heat pulse) is relatively modulated in a reducing direction (PWM control) for adjusting an ejection quantity.

As a second objective, a preliminary ejection is driven on the basis of the above mentioned basic waveform. The preliminary ejection is intended to refresh the inside of ejection nozzles of a recording head and does not require the adjustment of an ejection quantity thereof even when the ejection quantity has increased due to an increase in temperature of the recording head. A pre-heat pulse with a maximum pulse width (i.e. basic pulse waveform itself) is used for improving recoverability.

The aforementioned PWM control requires the width of a pre-heat pulse of a basic waveform to be sufficiently long. In other words, in PWM control, as the temperature of a recording head increases, a pre-heat pulse is made shorter; hence, if the width of a pre-heat pulse of the basic waveform is short, a controllable temperature range in PWM control becomes narrow. Thus, setting the width of a pre-heat pulse of the above mentioned basic waveform too short is undesirable.

However, as the resistance value of an ejection heater (i.e. head rank) becomes smaller, the width of a pre-heat pulse needs to become narrower. Otherwise, the pre-heat pulse causes ink to bubble (hereinafter referred to as pre-bubble), causing a failure in stable ejection.

Hence, the set width of a pre-heat pulse of the basic waveform needs to fall in such a range that does not cause the above mentioned problem; the pre-pulse width is not set in proportion to the resistance value of an ejection heater.

Also, a relatively latter pulse of the basic waveform (hereinafter referred to as main heat pulse) needs to be modified according to a head rank for achieving the stable state of ejection; hence, as illustrated in FIG. 32, the setting of a pulse width thereof is such that the pulse becomes longer as a head rank becomes larger.

For the reason mentioned above, the basic waveform is configured as illustrated in FIG. 32.

At printing, control over driving pulses is executed to modulate a pre-pulse as illustrated in FIGS. 30 and 31. At this time, only $P_1$ needs to be modulated, and hence, only a $P_1$ table corresponding to a rank needs to be held.

When ejection heater thermal characteristics are to be measured, pulses are applied to such an extent as not to cause bubbles, but in this embodiment, only pre-pulses are used for driving. Hence, it is not necessary to have another driving pulse table used in measuring thermal characteristics.

Figure 33:
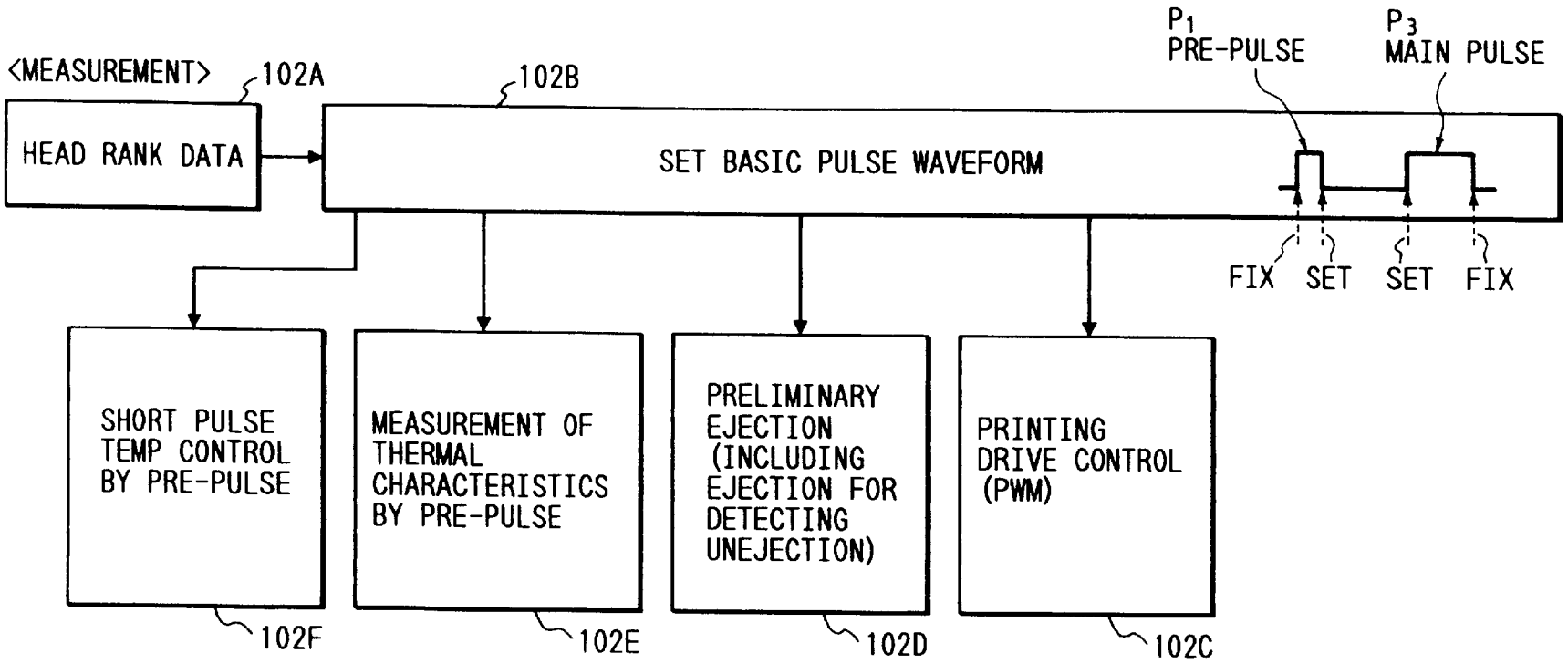
FIG. 33 is a block diagram for aiding in the description of the drive of a recording head in Example 5.

FIG. 33 is a block diagram schematizing what has been described above. As shown in the same figure, first, a dummy resistance on a head is measured for determining a head rank (102A), and a basic pulse waveform is set on the basis of the head rank (102B). Conducted are printing drive control (PWM) (102C) for modulating a pre-pulse on the basis of the basic pulse waveform, preliminary ejection (102D), measurement of thermal characteristics by pre-pulse (102E), and short pulse temperature control by pre-pulse (102C). A drive pulse for detection of unejection is also set as for preliminary ejection.

Secondly, diode sensor characteristics are measured. An ambient temperature is measured by a thermistor built in the main unit of a recording device. Known previously are a diode sensor reference output voltage and temperature-output voltage characteristics (gradient value) at a reference temperature (for example, 25° C.). Hence, a diode sensor output voltage at the above mentioned ambient temperature is converted to that at the reference temperature (25° C.) by using the above mentioned gradient value. Since the diode sensor output varies depending on a head temperature, if a recording head temperature is different from a main unit temperature or if there exists a sharp change in temperature, measurement of diode sensor characteristics is disabled, and it is necessary to wait until thermal stabilization is established.

However, when a head is identified as a new head, a conceivable case is that a previously used recording head has been left at an ambient temperature different from that for a main unit; hence, for measuring a diode rank, it is necessary to wait for a considerable time after the recording head is mounted in the main unit.

Since the new head as a whole has acclimated itself to a previous ambient temperature at which the new head has been left, a thermal time constant thereof is large until the new head acclimates itself to an ambient temperature for the main unit, particularly this tendency is remarkable with a recording head having a large thermal capacity as a whole. For example, for an ink tank and a recording head combined into one unit, it takes time for a head temperature to stabilize because of the large thermal capacity of ink and ink tanks. Also, for an integral head comprising a plurality of recording heads as in this embodiment, since the in-frame air around a plurality of recording heads acts as a large thermal capacity, a head temperature is further hard to stabilize, and in some case, it may take near one hour until the head temperature stabilizes.

Hence, if a diode rank is measured without putting a sufficient time interval, the measured rank value includes a large measurement error, and consequently, the temperature of a recording head may not be obtained at a good precision in some case. As a result, the stable ejection of ink from a recording head and a stable ejection quantity may not be achieved in some case. Accordingly, the temperature of a recording head is presumed by using a change in the value of a diode sensor of a recording head with time and an associated thermistor temperature in a main unit, thereby presuming a diode rank.

Thirdly, sub-heater thermal characteristics are measured. This measurement is similar to that in embodiment 1.

Fourthly, ejection heater thermal characteristics are measured. The operation of measurement is the same as that for the above mentioned method of measurement of sub-heater thermal characteristics, but what is driven, is an ejection heater.

Driving conditions for measurement of ejection heater thermal characteristics are controlled by using a pre-pulse of a basic waveform. Reason for using a pre-pulse here is to prevent an ink bubble from being generated, thereby providing the advantage that the number of tables to be used do not increase because of using the same table.

<Presumption of Diode Sensor Rank>

Figure 34:
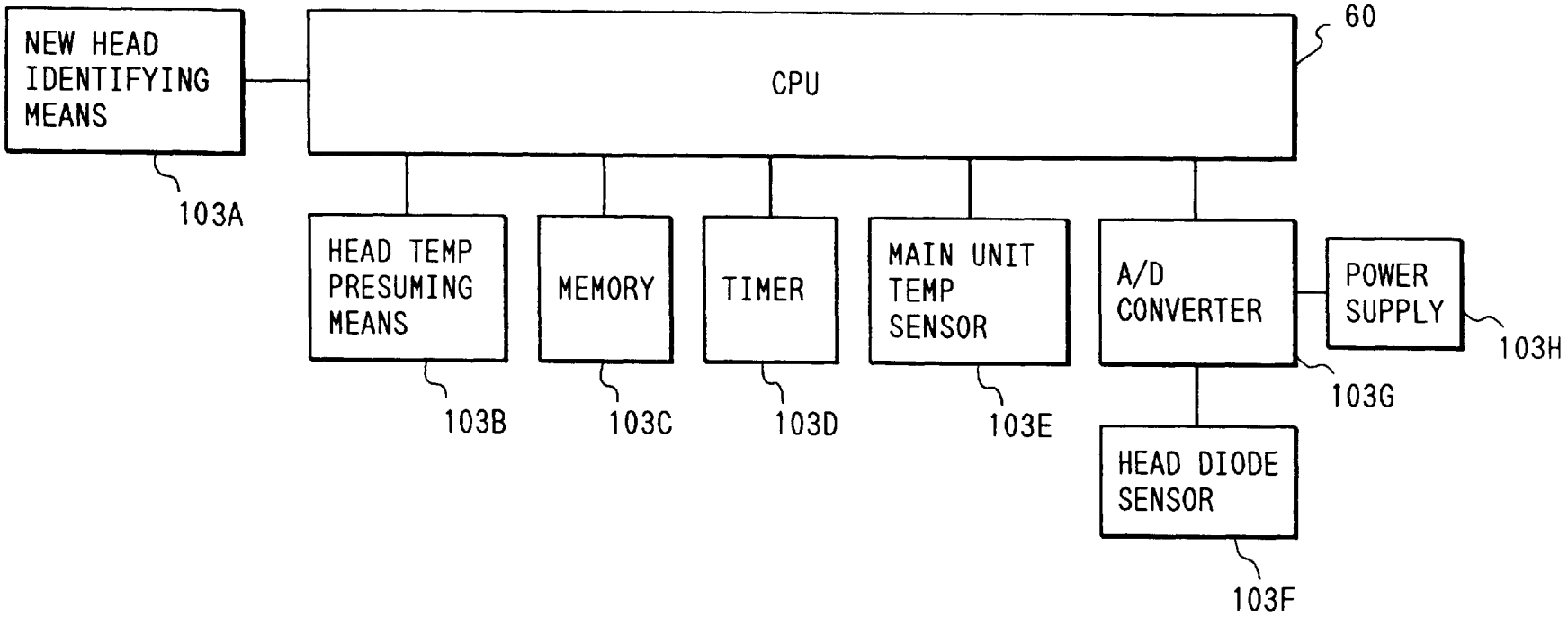
FIG. 34 is a block diagram illustrating the whole construction of the measurement of a diode sensor rank.

FIG. 34 is a conceptual diagram of presuming a diode sensor rank. When a recording head is identified as a newly mounted recording head (103A), diode sensor characteristics are not directly measured, but presumed. Specifically, first, with a diode sensor rank taken as a standard value, a temperature Ts of the recording head is measured and stored (103C, F, G, H). Then, after a predetermined time t (103D), a temperature T of the recording head is measured again. At the same time, a room temperature $T_0$ in a main unit is measured with a thermistor (103E).

Figure 35:
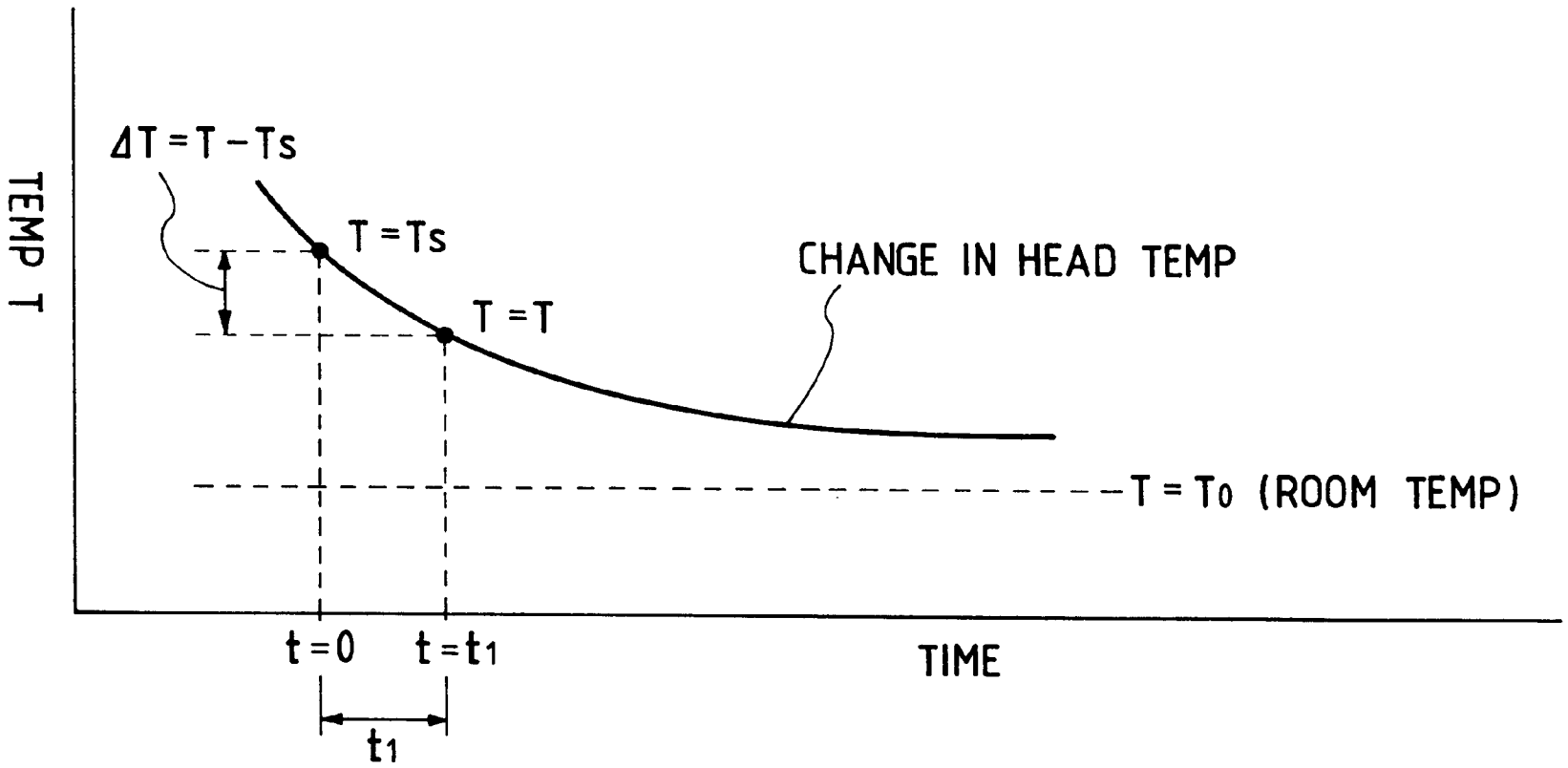
FIG. 35 is a model diagram for aiding in the description of the measurement of a diode sensor rank.

Referring to FIG. 35 for explaining what has been discussed above, a recording head temperature converges exponentially to an ambient temperature (~room temperature) at a certain time constant (expression 1). The temperature of convergence is calculated by (expression 2).

$$T=(Ts-T_0)\cdot\exp(-tl/tj)+T_0 \quad \text{(Expression 1)}$$

$$T_0=(T-Ts)/(1-A)+Ts=\Delta T/(1-A)+Ts \quad \text{(Expression 2)}$$

($\Delta T=T-Ts$, $A=\exp(-tl/tj)$, tj: time constant)

A diode rank is determined such that $T_0$ obtained by expression 2 agrees with a thermistor temperature. For a new head, the time constant tj is larger as compared with that immediately after printing, etc.; in this embodiment, tl=30 sec., A=0.94.

<Sequence Flow of Measurement of Head Characteristics>

Figure 36:
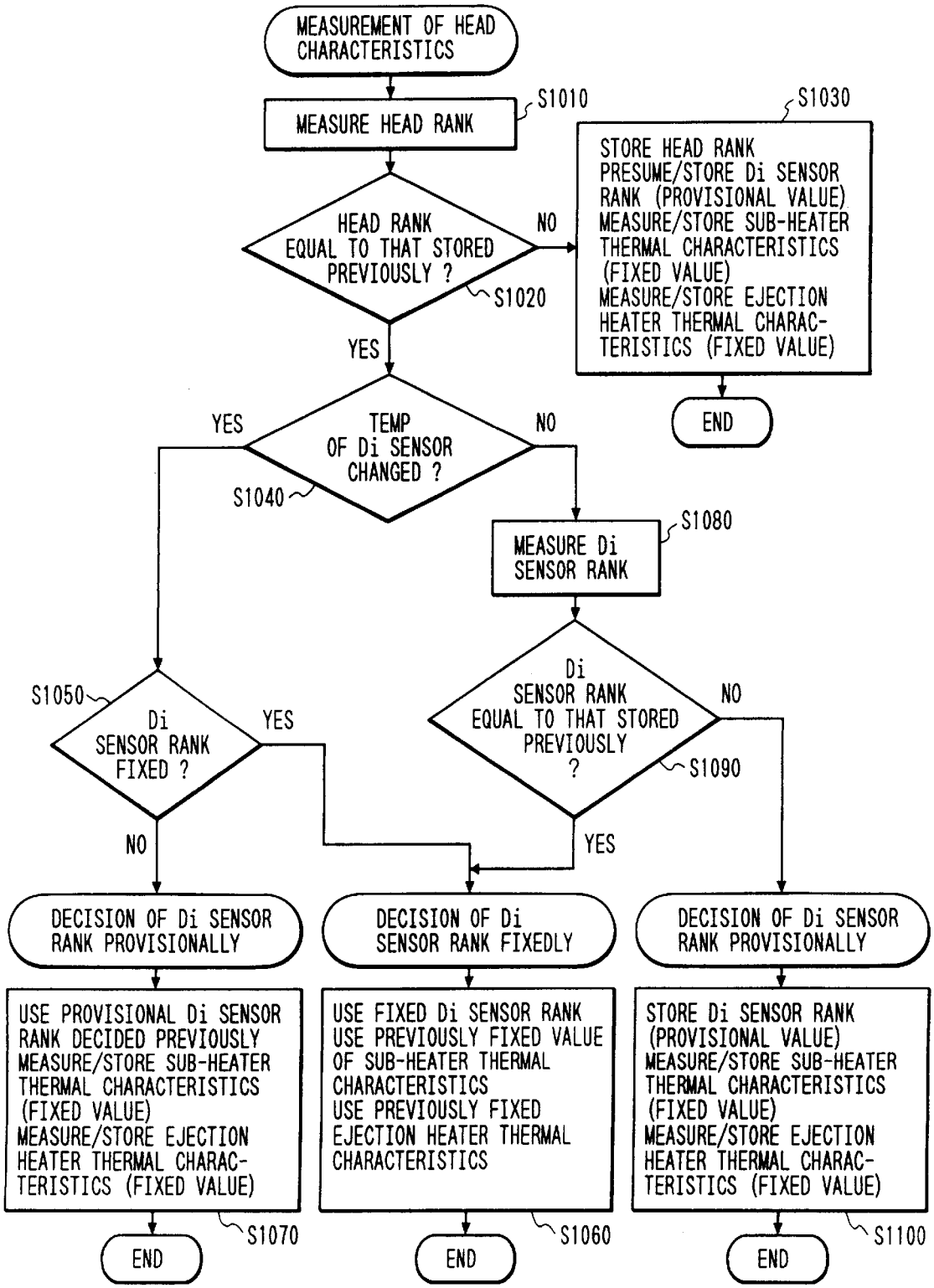
FIG. 36 is a flow chart illustrating the sequence of measurement of the characteristics of the recording head.

FIG. 36 is a sequence flow of measurement of head characteristics in this embodiment. This flow is identical to that in FIG. 6 for embodiment 3 except that step S1030 is different from step S1035 in FIG. 6. In other words, if a head rank is found unequal to that stored previously at step S1020, head characteristics are all measured at step S1030, but in this embodiment, a diode sensor rank is presumed and stored as a provisional value.

As described above, when a recording head is identified as a new recording head, by presuming a diode rank as in this embodiment, a diode rank can be set at a good precision in a relatively short period of time even when the recording head mounted has been brought from a place whose ambient temperature is different from that for a main unit. Hence, even though this diode rank value is a provisional value, the temperature of the recording head becomes a reliable value, not a mere provisional value. Hence, by modifying driving conditions on the basis of a head temperature to be subsequently obtained, the state of ejection of ink from the recording head and an ejection quantity are stabilized.

In this embodiment, after completing the aforementioned measurement of head characteristics, the remeasurement of head characteristics is conducted as explained before in the section of embodiment 4 referring to FIG. 7. At ordinary start-up of a recording device (when the aforementioned measurement of head characteristics is to be conducted without fail), central characteristic values like provisional values, etc. are used to shorten the above mentioned start-up time for making the recording device ready to use. Then, the above mentioned remeasurement of head characteristics (hereinafter referred to as correction of head characteristics) is made while the recording device is not used by a user, for deciding more accurate fixed values from head characteristic values used as provisional values, thereby improving the precision of head control.

EXAMPLE 6

The fifth embodiment has thus been described in conjunction with the case where the basic pulse waveform for driving the ejection heater only by means of the head rank. This embodiment is will be described with reference to FIG. 37 as regards an example of correcting the basic pulse waveform using thermal characteristics of the ejection heater.

The resistance (heat rank) of the ejection heater is judged by means of measuring the dummy resistance in the recording head (104A). The basic pulse waveform and an interim value thereof are set according to that information as in the fifth embodiment (104B). The thermal characteristics of the ejection heater are measured by using pre-pulses for the basic pulse waveform and the interim value thereof (104C). The basic pulse waveform is corrected with this thermal characteristic information (104D) as a fixed value. The PWM control, the preliminary ejection, and the temperature control are performed according to this basic pulse waveform (104E, 104F, 104G).

The term "correction" used herein means adjustment on the pulse widths for the pre-pulse and the main pulse. The pulse widths are shortened when the thermal characteristic information has a larger value than a reference value while are elongated when that information has a smaller value than the reference value. In other words, the thermal characteristic value larger than the reference value indicates that the thermal energy is more likely to be stored. With the normal pulse widths, the energy for discharging the ink is excessively large and thus the pulse width is corrected to be short.

A method of correction may be made by means of adjusting a driving voltage applied to the ejection heater while maintaining the set value for the pulse width. More specifically, this is the method of correcting the driving voltage to a shorter value when the thermal characteristic value is larger than the reference value. This method has an advantage that it is unnecessary to change the table for setting the pulse width.

The off-time (interval time) may be controlled to be shorten when the result of the thermal characteristic measurement is larger than the reference one after the interim basic pulse waveform is set corresponding to the head rank. This is because that it is possible to ensure a desired ink ejection state, in particular amount of ejection without taking sufficient off-time since the degree of thermal storage of the head is large. The off-time is controlled to be long when the result of the thermal characteristic measurement is smaller than the reference one.

As mentioned above, according to this embodiment, the driving conditions are judged according to the characteristic information for each recording head. Accordingly, it becomes possible to eject the ink from the stable recording head regardless of distribution of the characteristics of the recording heads.

In addition, besides to stabilize the ejection, it is possible to elongate the lifetime of the recording heads regardless of the distribution of the characteristics.

A fundamental waveform of a double pulse is judged as the above mentioned driving condition. The resistance of the ejection heater, the thermal characteristic of the recording head, or a combination thereof may be used as the head characteristic information. Means for measuring this information on the recording apparatus itself is also provided.

In addition, the PWM control for various driving pulses, the preliminary ejection, and the short pulse temperature control are performed through control means of, for example, modifying with the above mentioned set fundamental waveform of the double pulse as a reference.

EXAMPLE 7

This embodiment is for detecting unejection with a high accuracy. This embodiment is similar to the fifth embodiment in the structure of the recording apparatus and the fundamental waveform of the driving pulse.

Measurement on the thermal characteristics of the ejection heater:

The thermal characteristics and heat storage characteristics of the recording head greatly affect temperature change such as temperature rise on the recording head due to the idle ejection which is used to detect the unejection of the recording head and temperature fall after completion of the idle ejection. In this embodiment, the ejection heater is driven with the pre-pulse of the above mentioned fundamental waveform for each head rank, and the thermal characteristics of the ejection heater are measured according to a temperature difference in the temperature rise on the recording head thereby as well as to a temperature difference in the temperature fall up to a prejudged time from completion of the pulse generation.

The heat storage characteristics of the recording head differs for each recording head, or between the recording head and the recording apparatus depending on connection between members, the large or small ejection amount, and distribution of the power for the body for use in driving the heater. With the same amount of energy applied to the ejection heater, a recording head which tends to store heat is heated at a high temperature recording while a recording head capable of storing less thermal energy is less heated because it discharges the thermal energy generated.

In addition, heat generating characteristics of the recording heads vary from one to another depending on, for example, distribution of the sheet resistance of the ejection head. Further, the thermal characteristics differ from body to body depending on the distribution of the driving voltages on the heater driving body power for the recording apparatus body.

In this embodiment, the pulses each having the above mentioned fundamental waveform and the pre-pulse width depending on the head rank are applied to the ejection heater at 15 kHz over 1 second. The thermal characteristics of the recording head are judged according to the temperature change before and after application of the pulses.

Figure 38:
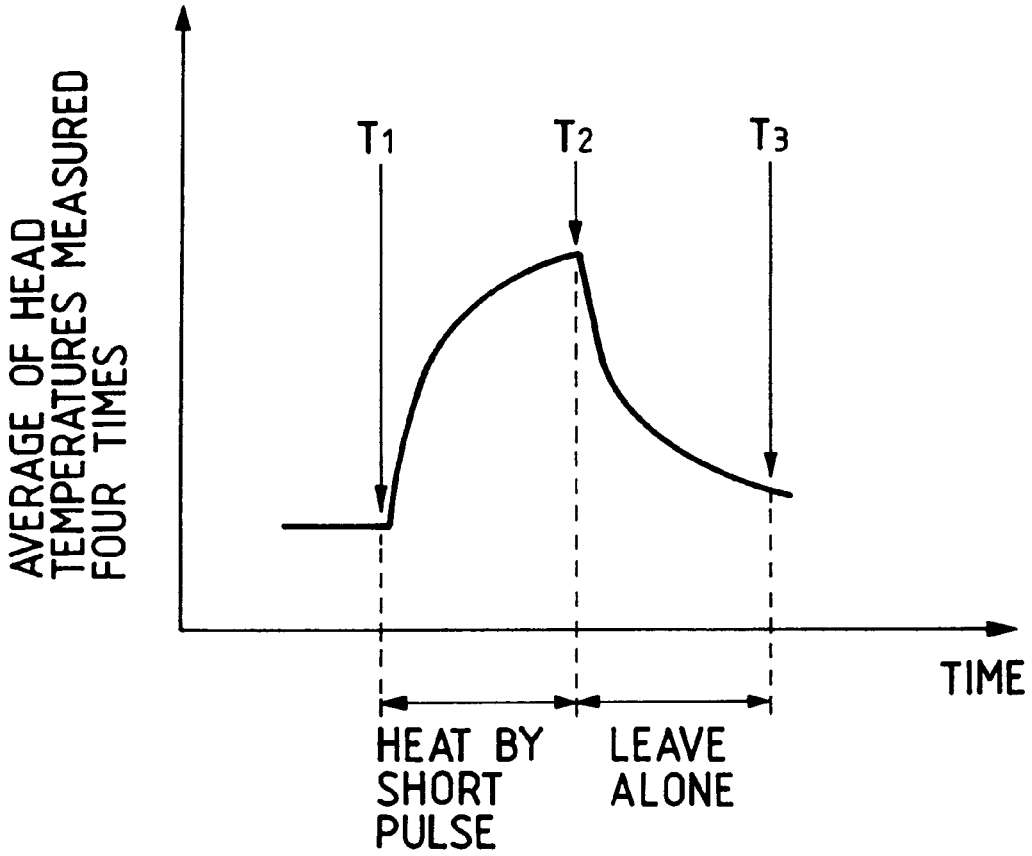
FIG. 38 is a diagram illustrating the measurement of thermal characteristic Δ of the recording head in Example 7.

A method of determining the thermal characteristics is described specifically with reference to FIG. 38. First, a temperature ($T_1$ in the figure) of the recording head before application of the pulse is measured. As mentioned above, the pulses each having the above mentioned fundamental waveform and the pre-pulse width are applied at 15 kHz over 1 second. A temperature ($T_2$ in the figure) of the recording head just before completion of pulse application is measured. Values of the head temperature are collected for every 20 millisecond, and four moving averages are obtained to eliminate any noises.

According to the measurement results so obtained, a value ΔTs representing the thermal characteristic of the recording head is given as follows:

$$\Delta Ts=(T_2-T_1)+(T_2-T_3).$$

The reason the temperature difference in the temperature rise is added to that in the temperature fall is to reduce as hard as possible effects in a case where the temperature of the recording head varies such as after high-duty printing.

The pre-pulse width of the pulse having the above mentioned fundamental waveform is significantly short, and the ink is not discharged as a result of application of the pulse for the thermal characteristic measurement. There is an advantage that only a small number of tables should be prepared by using a table for the fundamental waveform for measuring the thermal characteristic of the recording head.

Detection of Unejection

In this embodiment, the above mentioned driving pulses each having the fundamental waveform depending on the head rank are applied to the ejection heater to measure the temperature differences thereby in the temperature rise and the temperature fall on the recording head, thereby calculating a value ΔTi indicative of the degree of the temperature change. The ΔTi is compared with a threshold value ΔTth for decision which is judged depending on the above mentioned thermal characteristic ΔTs of the ejection heater, thereby determining the unejection of the recording head.

Figure 39:
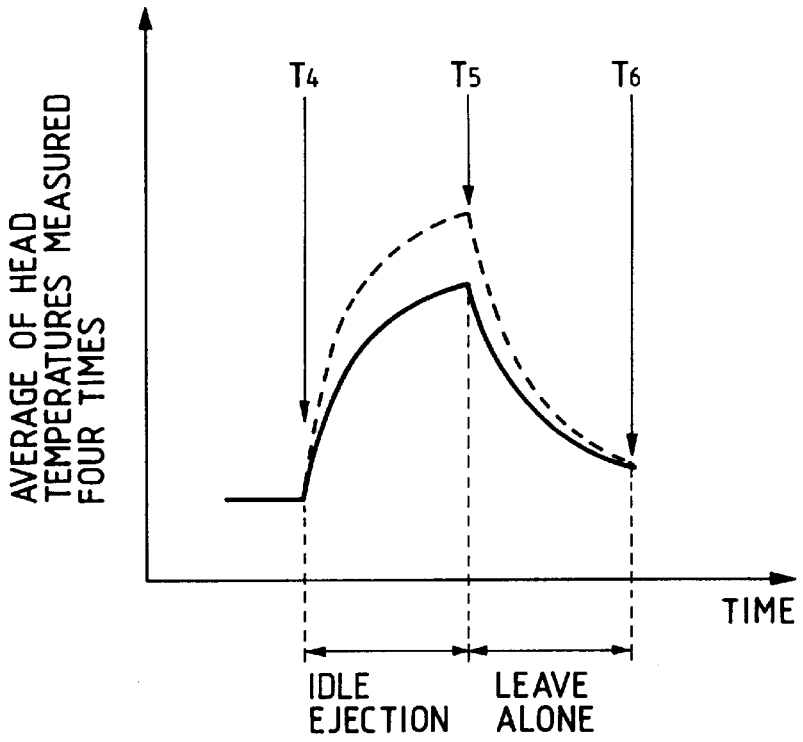
FIG. 39 is a diagram illustrating the measurement of temperature rise and drop ΔTi due to dry ejection in consequence of detection of failure of ejection in Example 7.

Referring to FIG. 39, specifically described is a method of measuring, for detecting the unejection, the value ΔTi indicative of the degree of the temperature change due to the idle ejection. First, the temperature ($T_4$ in the figure) of the recording head before application of the driving pulses is measured. Next, 5,000 (approximately 0.8 seconds) driving pulses each having the above mentioned fundamental waveform depending on the head rank are applied at 6.125 kHz, and the temperature ($T_5$ in the figure) of the recording head just before completion of the application is measured. Subsequently, the temperature ($T_6$ in the figure) of the recording head is measured after elapsing 0.8 seconds from completion of the driving pulse application. Values of the recording head temperature are collected for every 20 millisecond, and four moving averages are obtained to eliminate any noises.

With the measurement result so obtained, the value ΔTi is calculated which indicates the degree of increase and decrease of the temperature on the recording head due to the idle ejection:

$$\Delta Ti=(T_5-T_4)+(T_5-T_6).$$

Figure 40:
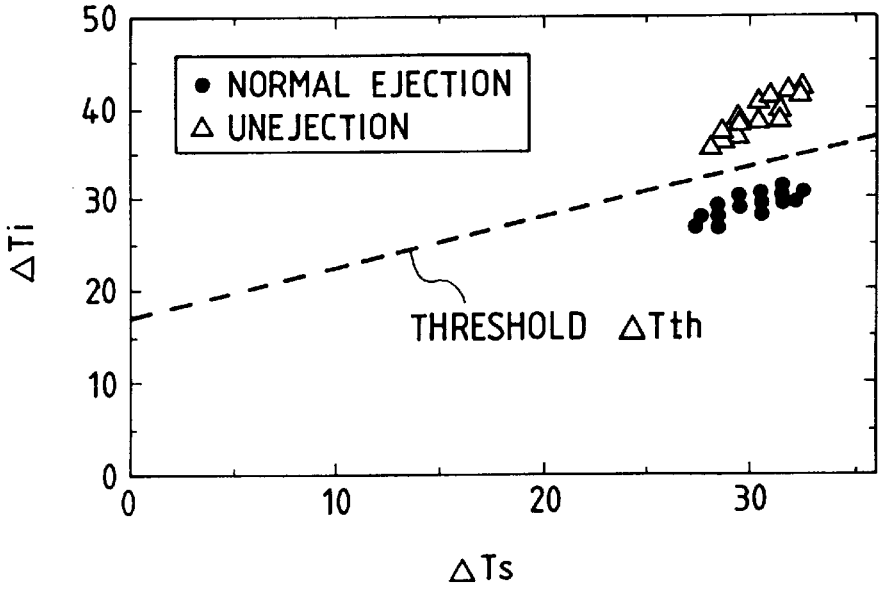
FIG. 40 is a diagram illustrating the relation between ΔTs and ΔTi in Example 7.

FIG. 40 is a graph in which ΔTi is plotted as a function of ΔTs for cases where the recording head is in an unejection state and in a normal ejection state for a plurality of recording heads. When the recording head is in the unejection state, ΔTi is approximately proportional to ΔTs. When the recording head is in the normal ejection state, a change rate of ΔTi relative to ΔTs is small, and they are not in a proportional relation. A probable reason thereof is that the ejection amount is varied depending on ΔTs. More specifically, the larger the ΔTs is, the higher the temperature rises due to the idle ejection for unejection detection, causing the temperature of the heater to increase. As a result, the ejection amount is increased. The thermal energy carried outside the recording head by the ejected ink droplets is thus increased, and ΔTi becomes slightly smaller (than the case where ΔTi is in proportion to ΔTs).

With respect to the above as well as the distribution of ΔTs on the recording heads, the threshold value ΔTth for use in determining the unejection is obtained as follows:

$$\Delta Tth=0.571\cdot\Delta Ts=17.$$

This is shown by a broken line in FIG. 40.

With a relation between the threshold value ΔTth for judgment and the ΔTi measured, judgment is made as follows:

$\Delta Ti \geqq \Delta Tth$ - - - unejection $\Delta Ti < \Delta Tth$ - - - normal ejection.

As apparent from FIG. 40, there is a sufficient margin for determining the unejection.

In this embodiment, improvement on the durability of the recording head as well as protection of the recording head(s) while avoiding excessive temperature rise can be achieved by means of performing the idle ejection for the unejection detection with the driving pulses each having the fundamental waveform depending on the head rank.

When detection of the unejection and correction of the thermal characteristics are carried out by using fixed driving pulses without changing the driving pulses depending on the head rank, the quality of heat generated as a result of the idle ejection for detecting the unejection is small for a recording head having a high sheet resistance, so that a problem may occur that the margin for the unejection detection becomes small. In this embodiment, driving of the idle ejection for the unejection detection and measurement on the thermal characteristics of the recording head(s) are carried out with the driving pulses depending on the rank of the recording head as mentioned above, so that a larger energy is supplied to a recording head having a high sheet resistance. As a result, it becomes possible to ensure a sufficiently large margin for detection.

As mentioned above, in the present embodiment, the thermal energy generated by the idle ejection for the unejection detection and the thermal energy generated by applying the pulses for measuring the thermal characteristics of the recording head are not constant independent of the head rank because of the setting of the fundamental waveform. However, a difference in the thermal energy generated depending on the head rank is remarkably small in driving according to the present invention as compared with a case where the pulse application for measuring the thermal characteristics is made with a fixed drive rather than through the head rank, which is smaller than a distribution due to measurements on ΔTs and ΔTi.

The basic pulse wave form is designed to ensure that, for the thermal energy generated when applying to the recording head of each head rank a drive pulse of the corresponding basic wave form described above, as well as for the thermal energy generated when applying to the recording head of each head rank a pre-pulse of the corresponding basic wave form described above, the thermal energy ratio between head ranks is kept as constant as possible (at 6% or less in this example of embodiment of the invention). If, between recording heads of different head ranks, there is not the least difference in any other characteristics than error in measurement and head rank, then ΔTs and ΔTi as measured on these recording heads should be a little greater for the recording head of higher head rank than for that of lower head rank.

However, the difference in value of the ΔTs and ΔTi which is caused by difference in generated thermal energy due to difference in head rank has a dispersion in almost the same direction as the difference in value of ΔTs and ΔTi due to thermal characteristics (ΔTs) of recording head as shown in FIG. 40. This is because, for example in the case of normal ejection, the ejection quantity increases as the produced thermal energy increases and, to be more precise, because the difference in generated thermal energy has practically the same effect in phenomenon on the temperature rise of recording head as the difference in thermal characteristics of recording head. It is therefore obvious that the difference in generated thermal energy between head ranks will hardly reduce the unejection judgment margin.

In this example of embodiment of the invention, the thermal characteristics (ΔTs) of recording head were measured by using a preheat pulse of basic wave form and the magnitude of temperature rise or drop (ΔTi) due to idle ejection was measured by driving using a basic wave form, but the invention is not limited to this makeup. A table by head rank of drive pulse wave forms for measurement of ΔTs and ΔTi may be provided. (For measurement of ΔTi, a preheat pulse in such table is used). Such table may be provided for measurement of ΔTs and for measurement of ΔTi, respectively, or a calculation formula may be provided to calculate the drive pulse wave form.

In this example of embodiment of the invention, the drive pulse wave form was changed according to the head rank, but the invention is not limited to this makeup. Operational voltage of drive pulse or number of drive pulses may be changed as far as the durability of the recording head permits. This example of embodiment of the invention is intended to perform the highly presice detection of unejection while ensuring the protection of the recording head by controlling, according to the head rank, the amount of heat generated in the recording head by detection of unejection or the recording head input energy.

In this example of embodiment of the invention, the threshold value (ΔTth) for unejection judgment was calculated as a linear function of ΔTs, but the invention is not limited to this makeup. ΔTth may be determined from a curve of higher degree, or an appropriate threshold value may be selected from a table according to the value of ΔTs.

In this example of embodiment of the invention, the measurement of ΔTs and ΔTi was made by using the temperature difference observed in both the temperature rise by ejection heater driving and the temperature drop after such driving, but the invention is not limited to this makeup. For instance, only if the head temperature is stable, ΔTs and ΔTi can be measured with good precision from either the temperature rise or the temperature drop.

In this example of embodiment of the invention, in order to widen the temperature range controllable by PWM control, the table of drive pulse wave forms by head rank (basic wave forms) was not set in such manner that the input energy is kept constant irrespective of the head rank, as described above. However, in a recording device wherein the temperature rise by printing is a matter of no great concern because, for example, of low drive frequency, a table corresponding to the wave forms of this example of embodiment of the invention may be designed in such manner that the input energy or the amount of generated heat is kept constant irrespective of the head rank. In this case, an advantage that the head rank has no influence on ΔTi is obtained.

On the contrary, if the amount of heat generated during measurement of ΔTs and ΔTi widely varies according to the head rank, the threshold value for unejection judgment may be corrected according to not only ΔTs, but also the head rank.

In a recording device wherein recording heads of two or more different types are used simultaneously or interchangeably, it is effectual to change various conditions according to the characteristics of each type of recording head. In this way, in recording heads of different types, unejection can be detected by settings suitable for each type of recording head.

EXAMPLE 8

In the example 8 of embodiment of the invention, idle ejection for detection of unejection is performed by using a drive pulse of the above-mentioned basic wave form according to the head rank. In addition, the number of shots of idle ejection is changed according to the thermal characteristics of the recording head. Thus, the precision of detection of unejection is increased. In this example of embodiment of the invention, the makeup of a recording device used, the measurement of ejection heater characteristics (head rank) and the basic wave forms of drive pulses are identical to those of the example 7 of embodiment of the invention.

Detection of Unejection

In the makeup of the example 7 of embodiment of the invention, a recording head of smaller value of ΔTs, of which temperature rise by ejection is smaller as shown in FIG. 40, has a relatively small unejection judgment margin as compared with a recording head of greater value of ΔTs. In this example 8 of embodiment of the invention, in order to keep the unejection judgment margin larger than a certain level irrespective of the head rank, the number of shots of idle ejection is changed according to the thermal characteristics of the ejection heater. On the other hand, for a recording head which has a greater value of ΔTs and hence an unejection judgment margin larger than necessary, the number of shots of idle ejection for detection of unejection is reduced to prevent the input of useless energy and unnecessary temperature rise of the recording head.

Figures 41, 42:
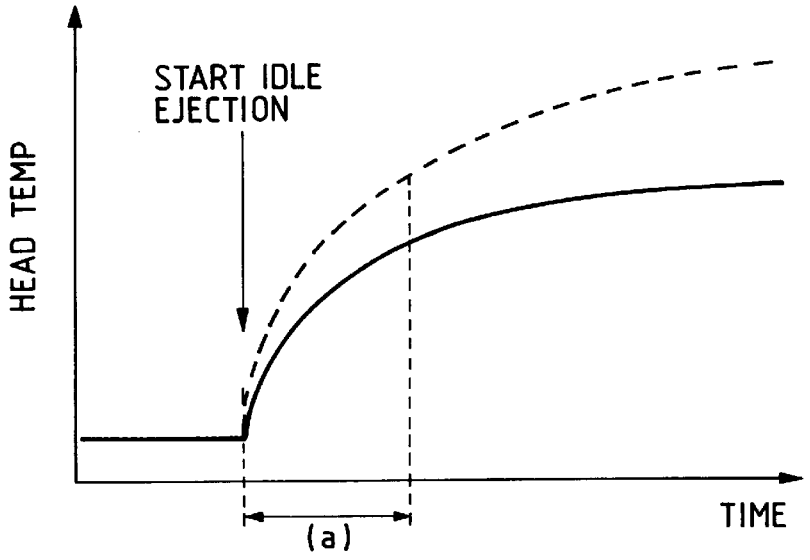
FIG. 41 is a diagram illustrating the correspondence between ΔTs and number of occasions of dry ejection in Example 8.
FIG. 42 is a model diagram illustrating the characteristic of recording head manifested in temperature rise in Example 8.

A table for selecting the number of shots of idle ejection for detection of unejection according to ΔTs of the recording head is shown in FIG. 41. As the number of shots of idle ejection is increased or reduced, the time required for idle ejection varies, and the time interval between end of idle ejection and measurement of $T_6$ is changed accordingly (cf. FIG. 39). Except that the time intervals between measurements of $T_4$ and $T_5$ and between measurements of $T_5$ and $T_6$ vary according to ΔTs, the concrete procedure of measurement of ΔTi is identical to that described in the example 7 of embodiment of the invention.

According to the setting of number of shots of idle ejection in this example of embodiment of the invention, whether the recording head is in normal ejection condition or in unejection condition, ΔTi is practically constant irrespective of head rank and ΔTs. Therefore, the threshold value for unejection judgment (ΔTth) is fixed as follows:

$$\Delta Tth = 32(^\circ\ C.)$$

Like in the example 7 of embodiment of the invention, the judgment criteria are as follows:

$$\Delta Ti \geq \Delta Tth \ldots \text{Unejection}$$

$$\Delta Ti < \Delta Tth \ldots \text{Normal ejection}$$

An increase in number of shots of idle ejection results in an increase of unejection judgment margin. This fact is explained with reference to FIG. 42 which shows temperature change of the recording head as observed when the recording head having its temperature stabilized at the room temperature is subjected to continous idle ejection. In the figure, the solid line represents the case where the recording head is in normal ejection condition and the broken line, the case where it is in unejection condition. When idle ejection is started, the temperature of the recording head begins to rise, and this temperature rise is gradually saturated according as the number of shots of idle ejection increases (that is, the idle ejection time becomes longer in the figure).

As is shown in the figure, at the level of 5,000 shots of idle ejection (at (a) in the figure), the temperature rise is not yet saturated, and according as the number of shots increases, the temperature difference between the case where the recording head is normal ejection condition and the case where it is in unejection condition increases. Thus, if the number of shots of idle ejection is changed, the degree of temperature rise by idle ejection is changed and the unejection judgment margin is also changed.

As aforementioned, ΔTs is reflective mainly of the heat accumulation characteristics of the recording head in the makeup of this example of embodiment of the invention. In a recording head of smaller value of ΔTs, the radiation of heat generated in the ejection heater is quicker. Therefore, even if the number of shots of idle ejection is increased to generate more thermal energy, this hardly leads to damage of the recording head by excessive temperature rise. On the other hand, a recording head of greater value of ΔTs is apt to accumulate the heat. As is shown in FIG. 40 in the example 7 of embodiment of the invention, the temperature rise of such recording head is considerable. Therefore, the reduction in number of shots of idle ejection serves to prevent unnecessary temperature rise and hence to protect the recording head.

In the present embodiment, the margin for unejection judgment is ensured to be approximately constant by means of setting change of the number of the idle ejection for the unejection detection. There is, however, no problem occurred in practice with the margin for the unejection judgment of larger than a certain value. For example, the number of the idle ejection for the unejection detection may be increased by the number required for obtaining essential margins only for the recording head having ΔTs of smaller than a prejudged value. In such a case, the threshold value ΔTth of the unejection judgment may be corrected on ΔTs, or both ΔTs and the head rank, thereby permitting the unejection detection with a high accuracy.

In this embodiment, the judgment margin covering a certain level is obtained by means of, rather than the thermal characteristics, changing the number of the idle ejection for the unejection detection with the thermal characteristic value ΔTs of the recording head. However, the structure of the present invention is not limited to those described above. The driving voltage for the idle ejection may be changed with ΔTs, and alternatively the driving pulse may be changed therewith. This means that the present embodiment is directed to ensure the margin for the unejection detection covering a certain level without using ΔTs by means of changing the applied energy for the unejection detection with ΔTs in a range causing no trouble on the durability of the recording head.

EXAMPLE 9

In the ninth embodiment, the idle ejection for the unejection detection is performed by means of driving of a fixed pulse waveform. In addition, a judgment condition for judging the unejection is corrected according to the above mentioned head rank and the above mentioned thermal characteristic of the recording head. The recording apparatus and the method of collecting the thermal characteristics of the recording heads are similar to those described in the seventh embodiment.

In this embodiment, the idle ejection for the unejection detection is carried out by using the driving pulse waveform corresponding to the head rank 7 of the above mentioned fundamental waveform (FIG. 31), and the value ΔTi is obtained which indicates the degree of increase and decrease of the temperature. The threshold value ΔTth for the unejection judgment is determined as follows according to the head rank and the thermal characteristic of the recording head:

$$\Delta Tth = 0.571 \cdot \Delta Ts + b_{HR} + 14.$$

In the above formula, $b_{HR}$ is a value determined according to the head rank. A table for use in determining the $b_{HR}$ according to the head rank is shown in FIG. 43.

In the seventh and eighth embodiments, control is made to change the driving pulses for use in the idle ejection for the unejection detection according to the head rank or the like. The control may be simplified as in this embodiment by means of carrying out the idle ejection with the fixed pulses when the recording head has a sufficient durability and when there is less or no possibility of disadvantages where the durability is deteriorated by the above mentioned driving of the ejection heater.

In addition, distribution of ΔTi due to the heat generating characteristics (mainly the head rank) of the recording head differs from the distribution thereof due to the heat storage characteristics or the like (the thermal characteristics according to the present embodiment reflect the heat storage characteristics as described above). The whole distribution of ΔTi may be spread with a combination thereof. In such a case, to correct for each cause of the distribution as in the present embodiment is useful to improve the accuracy of the unejection judgment.

While the present embodiment has thus been described in conjunction with the case the thermal characteristic of the recording head is corrected by using the formula and the correction with the head rank is made by means of selecting a value from the table, the present invention is not limited to those specific structures. For example, the present invention may have a structure of correcting the threshold value of judgment by using a formula for both the correction with the thermal characteristics and the correction with the head rank.

The heater provided in the recording apparatus may be driven before the unejection detection. This is effective when the ink has a high viscosity and thus it is hard to achieve normal discharge when the ejection heater is driven with no measure, but to increase the ink temperature permits easy discharge thereof. With the structure in this embodiment, it is effective to warm the recording head before the unejection detection by means of driving a sub-heater 20F that is a heater for temperature control for the recording apparatus. The sub-heater is so designed as not to contact directly with the ink in the recording head. The reason is to avoid troubles of foam generation in the recording head due to the foam in the ink even when a large energy is applied during a short period of time.

In addition, to wait the unejection detection during an interval required to stable the temperature of the recording head at a certain degree after driving of the sub-heater before the unejection detection is also effective to improve the accuracy of the unejection judgment.

(Tenth Embodiment)

In the tenth embodiment, unejection detection is corrected according to the characteristics of the recording apparatus itself. In this embodiment, as an example thereof, correction is made on the distribution of the driving voltages of the power supply for the heater driving body of the recording apparatus. A supply voltage is measured upon manufacturing the recording apparatus and is stored in information storing means (such as an electrically erasable programmable read-only memory (EEPROM) or NVRAM) in the recording apparatus. In the seventh embodiment, the head rank is determined according to the sheet resistance of the recording head, with which the measurement of the thermal characteristic value ΔTs of the ejection heater and the driving of the idle ejection for use in detecting the unejection of the recording head are selected from the above mentioned fundamental waveforms. On the contrary, in this embodiment, the correction is made upon selection of the driving waveform from the above mentioned fundamental waveforms depending on the distribution of the supply voltages for the recording apparatus. As a result, it becomes possible to correct the amount of the energy applied and the heat generation even when there is distribution of the supply voltages for the recording apparatus. This makes it possible to detect the unejection with a higher accuracy.

More specifically, a correction value is selected upon manufacturing the recording apparatus which the value corresponds to the degree of the distribution of the above mentioned supply voltages. The selected value is stored in the EEPROM on the recording apparatus. FIG. 44 shows the supply voltages and the associated correction values. A driving pulse waveform is selected that corresponds to a value obtained by adding the correction value to the head rank in selecting a waveform of the driving pulse from the table of the above mentioned fundamental waveforms to measure the thermal characteristic value of the ejection heater or to perform the idle ejection for the unejection detection.

With the driving pulse waveform so selected, measurement of the thermal characteristic value of the ejection heater and the idle ejection of for the unejection detection are performed. The subsequent specific thermal characteristic values of the ejection heater, the method of the unejection detection, and the method of unejection judgment are similar to those described in the seventh embodiment.

While in the present embodiment the selection on the driving condition from the fundamental waveforms is corrected depending on the distribution of the driving voltages for the recording apparatus, the structure of the present invention is not limited to those described above. ΔTs and ΔTi may be corrected depending on the distribution of the driving voltages for the recording apparatus, or may be corrected by means of changing the conditions for the unejection judgment.

While the present embodiment has thus been described in conjunction with the case where the driving condition is correction depending on the distribution of the driving voltages for the recording apparatus, the correction of the distribution of the power supply for the recording apparatus is also effective for printing with the recording apparatus, and the idle ejection for improvement of the reliability, with which it becomes possible to control the energy applied with a higher accuracy. This contributes to improvement of the durability of the recording head, stability of the ejection amount, and stability of the ejection state.

While in the seventh through tenth embodiments, the ejection heater characteristic (head rank) is measured out of the resistance value of the dummy resistance provided on the recording head, the present invention is not limited to those specific structures regarding on the measurement of the head rank. For example, the head rank may be measured upon manufacturing the head. In this event, information storing means may be provided in the recording head to store the head rank information. The stored information may be read by the recording apparatus itself. In addition, the head rank may be measured by any other adequate means rather than by means of measuring the resistance value of the heater provided on the recording head. For example, printing may be made with the recording head which is not heated, and the head rank may be determined according to the printed density on the printed matter. However, to provide the information storing means on the recording head more or less increases the costs.

In the seventh through tenth embodiments, the thermal characteristic of the ejection heater is measured by means of driving the ejection heater actually. However, the present invention is not limited to that specific structure. For example, the thermal characteristic may be measured by using sub-heater 20F for the temperature control on the recording head provided on the heater board 20G having the structure described in the first embodiment. In such a case, however, it may be necessary to carry out a certain correction if that data is used as the data for the ejection heater. In addition, the thermal characteristic may be measured previously upon manufacturing the recording head and be stored in information storing means provided on the recording head. It is noted that the method of obtaining the thermal characteristic value by means of driving the ejection heater on the recording apparatus as in the present embodiment, there is an advantage of permitting a flexible action to the change of the characteristic of the recording head by means of collecting the thermal characteristic values for every predetermined interval when the characteristic of the recording head varies as a result of a long-term driving with, for example, change in state or condition of the surface of the ejection heater.

According to the seventh through tenth embodiments, it becomes possible to detect the unejection of the recording head with a high accuracy while protecting the recording head from an excessive temperature increase by means of detecting the unejection of the recording head according to the characteristic information for the recording head or the recording device, changing the driving condition on the thermal characteristic measurement, or changing the judgment condition for the unejection judgment according to the characteristic information of the recording head or the recording device.

The present invention is particularly suitably usable in an ink jet recording head and recording apparatus wherein thermal energy by an electrothermal transducer, laser beam or the like is used to cause a change of state of the ink to eject or discharge the ink. This is because the high density of the picture elements and the high resolution of the recording are possible.

The typical structure and the operational principle are preferably the ones disclosed in U.S. Pat. Nos. 4,723,129 and 4,740,796. The principle and structure are applicable to a so-called on-demand type recording system and a continuous type recording system. Particularly, however, it is suitable for the on-demand type because the principle is such that at least one driving signal is applied to an electrothermal transducer disposed on a liquid (ink) retaining sheet or liquid passage, the driving signal being enough to provide such a quick temperature rise beyond a departure from uncleation boiling point, by which the thermal energy is provided by the electrothermal transducer to produce film boiling on the heating portion of the recording head, whereby a bubble can be formed in the liquid (ink) corresponding to each of the driving signals. By the production, development and contraction of the bubble, the liquid (ink) is ejected through an ejection outlet to produce at least one droplet. The driving signal is preferably in the form of a pulse, because the development and contraction of the bubble can be effected instantaneously, and therefore, the liquid (ink) is ejected with quick response. The driving signal in the form of the pulse is preferably such as disclosed in U.S. Pat. Nos. 4,463,359 and 4,345,262. In addition, the temperature increasing rate of the heating surface is preferably such as disclosed in U.S. Pat. No. 4,313,124.

The structure of the recording head may be as shown in U.S. Pat. Nos. 4,558,333 and 4,459,600 wherein the heating portion is disposed at a bent portion, as well as the structure of the combination of the ejection outlet, liquid passage and the electrothermal transducer as disclosed in the above-mentioned patents. In addition, the present invention is applicable to the structure disclosed in Japanese Laid-Open Patent Application No. 59-123670 wherein a common slit is used as the ejection outlet for plural electrothermal transducers, and to the structure disclosed in Japanese Laid-Open Patent Application No. 59-138461 wherein an opening for absorbing pressure wave of the thermal energy is formed corresponding to the ejecting portion. This is because the present invention is effective to perform the recording operation with certainty and at high efficiency irrespective of the type of the recording head.

The present invention is effectively applicable to a so-called full-line type recording head having a length corresponding to the maximum recording width. Such a recording head may comprise a single recording head and plural recording head combined to cover the maximum width.

In addition, the present invention is applicable to a serial type recording head wherein the recording head is fixed on the main assembly, to a replaceable chip type recording head which is connected electrically with the main apparatus and can be supplied with the ink when it is mounted in the main assembly, or to a cartridge type recording head having an integral ink container.

The provisions of the recovery means and/or the auxiliary means for the preliminary operation are preferable, because they can further stabilize the effects of the present invention. As for such means, there are capping means for the recording head, cleaning means therefor, pressing or sucking means, preliminary heating means which may be the electrothermal transducer, an additional heating element or a combination thereof. Also, means for effecting preliminary ejection (not for the recording operation) can stabilize the recording operation.

As regards the variation of the recording head mountable, it may be a single corresponding to a single color ink, or may be plural corresponding to the plurality of ink materials having different recording color or density. The present invention is effectively applicable to an apparatus having at least one of a monochromatic mode mainly with black, a multi-color mode with different color ink materials and/or a full-color mode using the mixture of the colors, which may be an integrally formed recording unit or a combination of plural recording heads.

Furthermore, in the foregoing embodiment, the ink has been liquid. It may be, however, an ink material which is solidified below the room temperature but liquefied at the room temperature. Since the ink is controlled within the temperature not lower than 30° C. and not higher than 70° C. to stabilize the viscosity of the ink to provide the stabilized ejection in usual recording apparatus of this type, the ink may be such that it is liquid within the temperature range when the recording signal is the present invention is applicable to other types of ink. In one of them, the temperature rise due to the thermal energy is positively prevented by consuming it for the state change of the ink from the solid state to the liquid state. Another ink material is solidified when it is left, to prevent the evaporation of the ink. In either of the cases, the application of the recording signal producing thermal energy, the ink is liquefied, and the liquefied ink may be ejected. Another ink material may start to be solidified at the time when it reaches the recording material. The present invention is also applicable to such an ink material as is liquefied by the application of the thermal energy. Such an ink material may be retained as a liquid or solid material in through holes or recesses formed in a porous sheet as disclosed in Japanese Laid-Open Patent Application No. 54-56847 and Japanese Laid-Open Patent Application No. 60-71260. The sheet is faced to the electrothermal transducers. The most effective one for the ink materials described above is the film boiling system.

The ink jet recording apparatus may be used as an output terminal of an information processing apparatus such as computer or the like, as a copying apparatus combined with an image reader or the like, or as a facsimile machine having information sending and receiving functions.

While the invention has been described with reference to the structures disclosed herein, it is not confined to the details set forth and this application is intended to cover such modifications or changes as may come within the purposes of the improvements or the scope of the following claims.

What is claimed is:

1. A recording apparatus on which a plurality of recording heads will be mounted to record images by using thermal energy, comprising:

means for measuring a plurality of characteristics of at least one element of the recording heads to obtain information for defining a drive condition of the recording heads which have been mounted;

means for storing the plurality of characteristics of the at least one element of the recording heads measured by said measuring means as identification information of the recording heads; and determining means for determining whether a mounted recording head has replaced one of the prior recording heads based upon the identification information stored in said means for storing.

2. An apparatus as set forth in claim 1, wherein said measuring means measures a characteristic of heating elements for recording of said recording head.

3. An apparatus as set forth in claim 2, wherein said measuring means measures a resistance characteristic of the heating elements for recording of said recording head.

4. An apparatus as set forth in claim 2, wherein said measuring means measures a thermal characteristic of the heating elements for recording of said recording head.

5. An apparatus as set forth in claim 1, wherein said measuring means measures a characteristic of temperature sensors of said recording head.

6. An apparatus as set forth in claim 5, wherein said measuring means measures a temperature characteristic of temperature sensors of said recording head.

7. An apparatus as set forth in claim 1, wherein said measuring means measures a characteristic of heating elements for temperature adjustment of said recording head.

8. An apparatus as set forth in claim 7, wherein said measuring means measures a thermal characteristic of heating elements for temperature adjustment of said recording head.

9. An apparatus as set forth in claim 1, wherein said recording head ejects ink by using thermal energy.

10. An apparatus according to claim 1, wherein said characteristic is inherent in the recording head.

11. An apparatus according to claim 1, wherein each of said measuring means, storing means and determining means executes when said apparatus is not in a record mode.

12. An apparatus according to claim 1, wherein said storing means stores the characteristic non-volatilely.

13. A recording apparatus on which a recording head will be mounted to record images by using thermal energy, comprising:

measuring means for measuring a plurality of characteristics of a plurality of elements of the recording head to obtain information for defining a drive condition of the recording head which has been mounted;

storing means for storing the plurality of the characteristics of the plurality of elements of said recording head measured by said measuring means as identification information of the recording head; and determining means for determining whether a mounted recording head has replaced a prior recording head based upon the identification information stored in said means for storing.

14. An apparatus as set forth in claim 13, wherein said measuring means measures at least two of the characteristics of the heating elements for recording, the thermal sensors, and the heating elements for temperature adjustment of said recording head.

15. An apparatus as set forth in claim 13, wherein said measuring means measures at least two of the resistance and thermal characteristics of the heating elements for recording of said recording head, the temperature characteristic of the temperature sensors, and the thermal characteristic of the heating elements for temperature adjustment.

16. An apparatus as set forth in claim 13, wherein said recording head ejects ink by using thermal energy.

17. An apparatus according to claim 13, wherein said characteristic is inherent in the recording head.

18. An apparatus according to claim 13, wherein each of said measuring means, storing means and determining means executes when the apparatus is not in a record mode.

19. An apparatus according to claim 13, wherein said storing means stores the characteristics non-volatilely.

20. A recording head recognizing method, comprising the steps of:

measuring and numerizing respective head characteristics of at least one element of a recording head to be mounted;

storing the values as information for discriminating the recording head; and determining whether a mounted recording head has replaced a prior recording head based upon the identification information stored in said storing step.

21. A recording head recognizing method as set forth in claim 20, further comprising the steps of:

giving an order of priority to respective head characteristics of the recording head; and determining whether a mounted head is identical with a previous one by comparing the characteristics of the mounted head with those of a stored head from characteristics of a head having highest priority.

22. A recording head recognizing method as set forth in claim 20, further comprising the step of determining whether or not a mounted head is identical with a previous one, without measuring characteristics of heads each having a priority lower than a certain level.

23. A recording head recognizing method as set forth in claim 22, wherein, if a difference between a previously stored value and a latest measured value is within a head characteristic allowable range in said determining step, the mounted head is considered as an identical head.

24. A recording head recognizing method as set forth in claim 23, wherein the head characteristic allowable range for determination of the identical head depends on a status under a head characteristic measurement at starting a recording apparatus or other head characteristic measurement.

25. A recording head recognizing method as set forth in claim 20, wherein, in said measuring step, the respective head characteristics of the recording head are defined as provisional or fixed ones, and said head characteristic measurement is repeated at a certain timing until they become fixed values.

26. A recording head recognizing method as set forth in claim 25, wherein said measurement is performed when there is no temperature change substantially in a vicinity of the recording head.

27. A method according to claim 20, wherein said characteristic is inherent in the recording head.

28. A method according to claim 20, wherein each of said measuring/numerizing step, storing step and determining step is executed when a recording apparatus mounting therein the recording head is not in a record mode.

29. A method according to claim 20, wherein said storing step stores the characteristics non-volatilely.

30. A recording head recognizing method, comprising the steps of:

determining whether or not a recording head has been used continuously or has just replaced an old one by using at least a plurality of units of information obtained from the recording head; and determining drive conditions for driving heating elements for ink ejection of the ink jet recording head by using the information obtained from the recording head.

31. A recording head recognizing method as set forth in claim 30, wherein said plural units of information include information about physical characteristics of ejection heaters of the recording head and about physical characteristics of elements used for detecting temperatures of the recording head.

32. A recording head recognizing method as set forth in claim 30, wherein said plural units of information include temperature change information obtained by driving said heating elements of the recording head and by driving heat elements used for temperature adjustment of the recording head.

33. A method according to claim 30, wherein said information in inherent in the recording head.

34. A method according to claim 30, wherein each of said two determining steps is executed when a recording apparatus mounting therein the recording head is not in a record mode.

35. A method according to claim 30 wherein said information is stored non-volatilely.

36. A recording head recognizing method, comprising the steps of:

driving first heating elements of a recording head to obtain temperature change information used for determining drive conditions for driving heating elements for ink ejection from the recording head; and determining whether or not the recording head has been used continuously or has just replaced an old one by using the temperature chance information obtained in said driving step and physical characteristics of second heating elements of the recording head.

37. A recording head recognizing method as set forth in claim 36, wherein the recording head includes a plurality of ink ejecting portions to eject a plurality of ink colors and the first and second heating elements include elements in the plurality of ink ejecting portions.

38. A method according to claim 36, wherein said characteristic is inherent in the recording head.

39. A method according to claim 36, wherein each of said driving step and said determining step is executed when a recording apparatus mounting therein the recording head is not in a record mode.

40. A method according to claim 36, wherein said information is stored non-volatilely.

41. An ink jet recording apparatus on which recording heads are mounted, comprising:

a measuring means for measuring a value of resistance of ejection heaters of said recording head as head characteristic information; and a drive condition setting means for setting a drive condition of said recording head according to the head characteristic information measured by said measuring means.

42. An ink jet recording apparatus as set forth in claim 41, wherein said measuring means measures thermal characteristics of said recording head.

43. An ink jet recording apparatus as set forth in claim 42, wherein said head characteristic information is a combination of a value of resistance of said ejection heaters and thermal characteristics of said recording head.

44. An ink jet recording apparatus as set forth in claim 42, wherein said drive condition is a basic waveform of a double pulse and said measuring means measures thermal characteristics by using a pre-pulse in this basic waveform.

45. An ink jet recording apparatus as set forth in claim 41, wherein said drive condition is a basic waveform of a double pulse.

46. An ink jet recording apparatus as set forth in claim 45, wherein are set the last transition of a basic waveform of a double pulse and the first transition of the main pulse.

47. An ink jet recording apparatus as set forth in claim 41, wherein said drive condition is a basic waveform of a double pulse, further comprising a driving means for preliminary ejection and printing on a basis of the basic waveform.

48. An ink jet recording apparatus as set forth in claim 41, wherein said drive condition is a basic waveform of a double pulse, further comprising a drive means for temperature adjustment with a pre-pulse in this basic waveform.

49. An ink jet recording apparatus as set forth in claim 41, wherein a provisional recording head drive condition is set according to a single head characteristic and a fixed recording head drive condition is set according to other head characteristic information measured based on the provisional recording head drive condition.

50. An ink jet recording apparatus as set forth in claim 49, wherein said provisional recording head drive condition is a basic waveform of a double pulse and said fixed recording head drive condition is a change of a fall time of a pre-pulse in said basic waveform.

51. An ink jet recording apparatus as set forth in claim 49, wherein said fixed recording head drive condition is a change of a drive voltage for said provisional recording head drive condition.

52. An ink jet recording apparatus as set forth in claim 49, wherein said provisional recording head drive condition is a basic waveform of a double pulse and said fixed recording head drive condition is a change of an interval time for said basic waveform.

53. An ink jet recording apparatus as set forth in claim 41, wherein said recording head ejects ink by using thermal energy.

54. An apparatus according to claim 41, wherein said information is inherent to the recording head.

55. An apparatus according to claim 41, wherein each of said measuring means and said drive condition setting means executes when said apparatus is not in a record mode.

56. A recording apparatus according to claim 1, having four said recording heads, and wherein the means for measuring measures at least one of an ejection heater characteristic, a diode sensor characteristic, a sub-heater thermal characteristic and an ejection heater thermal characteristic for each of the four heads.

57. A recording apparatus according to claim 1, wherein said identification information comprises, for each measured characteristic, four digits corresponding to the four heads.

58. A recording apparatus according to claim 1, further comprising generating means for generating a rank of the identification information based upon the measured characteristics.

59. A recording apparatus according to claim 13, wherein the means for measuring measures at least one of an ejection heater characteristic, a diode sensor characteristic, a sub-heater thermal characteristic and an ejection heater thermal characteristic for the recording head.

60. A recording apparatus according to claim 13, wherein said identification information comprises four digits.

61. A recording apparatus according to claim 13, further comprising generating means for generating a rank of the identification information based upon the measured characteristics.

62. A recording head recognizing method according to claim 20, wherein the measuring is measuring of at least one of an ejection heater characteristic, a diode sensor characteristic, a sub-heater thermal characteristic and an ejection heater thermal characteristic.

63. A recording head recognizing method according to claim 20, wherein said identification information comprises, for each measured characteristic, four digits corresponding to the head.

64. A recording head recognizing method according to claim 20, further comprising the step of generating a rank of the identification information based upon the measured characteristics.

65. A recording head recognizing method according to claim 30, wherein the units of information include at least one of an ejection heater characteristic, a diode sensor characteristic, a sub-heater thermal characteristic and an ejection heater thermal characteristic.

66. A recording head recognizing method according to claim 30, wherein said information comprises, for each measured characteristic, four digits corresponding.

67. A recording head recognizing method according to claim 30, further comprising the step of generating a rank of the information based upon the measured characteristics.

68. A recording head recognizing method according to claim 36, wherein the temperature change information involves at least one of an ejection heater characteristic, a diode sensor characteristic, a sub-heater thermal characteristic and an ejection heater thermal characteristic.

69. A recording head recognizing method according to claim 36, wherein said temperature change information comprises four digits.

70. A recording head recognizing method according to claim 36, further the step of generating a rank of the temperature change information based upon the measured characteristics.

71. An ink jet recording apparatus according to claim 41, having four said recording heads, and wherein the measuring means measures at least one of an ejection heater characteristic, a diode sensor characteristic, a sub-heater thermal characteristic and an ejection heater thermal characteristic for each of the four heads.

72. An ink jet recording apparatus according to claim 41, wherein said characteristic information comprises, for each measured characteristic, four digits corresponding to the four heads.

73. An ink jet recording apparatus according to claim 41, further comprising generating means for generating a rank of the characteristic information based upon the measured characteristics.

* * * * *

UNITED STATES PATENT AND TRADEMARK OFFICE

CERTIFICATE OF CORRECTION

PATENT NO. : 6,224,182 B1
DATED : May 1, 2001
INVENTOR(S) : Shigeyasu Nagoshi et al.

It is certified that error appears in the above-identified patent and that said Letters Patent is hereby corrected as shown below:

Title page,
Item [74] *Attorney, Agent, or Firm*-:
"Fitzpatrick, Cellla, Harper & Scinto" should read
-- Fitzpatrick, Cella, Harper & Scinto --.

Figure 37:
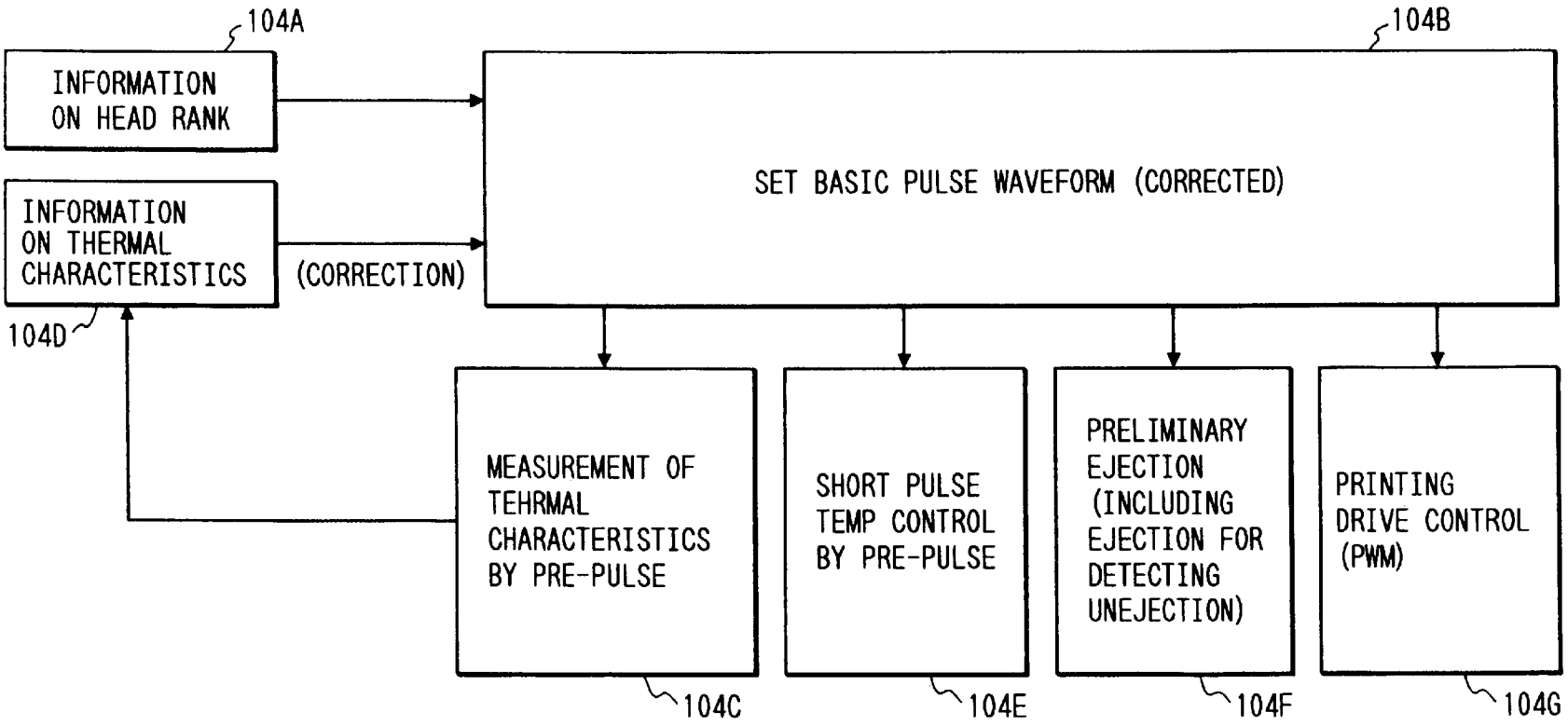
FIG. 37 is a block diagram for aiding in the description of the drive of the recording head in Example 6.

Drawings,
Sheet 5 of 37, FIG. 5, "UALUE" should read -- VALUE --; and
Sheet 33 of 37, FIG. 37, "TEHRMAL" should read -- THERMAL --.

Column 5,
Line 15, "other" should read -- another --.

Column 7,
Line 38, "motion." should read -- motion --.

Column 10,
Line 22, "PWM" should read -- pulse width modulation (PWM) --; and
Line 55, "MPU" should read -- (MPU) --.

Column 14,
Line 9, "pre heat" should read -- preheat --;
Line 12, "a long" should read -- along --;
Line 40, "$P_{ILMTI}$" should read -- $P_{ILMT}$ --; and
Line 42, "$P_{ILMTI}$" should read -- $P_{ILMT}$ --.

Column 16,
Line 22, "(S2050) A target" should read -- (S2050) ¶A target --.

Column 17,
Line 19, "(Di)" should read -- diode (Di) --.

Column 19,
Line 62, "has" should read -- have --.

Column 22,
Line 21, "a" should be deleted.

UNITED STATES PATENT AND TRADEMARK OFFICE

CERTIFICATE OF CORRECTION

PATENT NO. : 6,224,182 B1
DATED : May 1, 2001
INVENTOR(S) : Shigeyasu Nagoshi et al.

It is certified that error appears in the above-identified patent and that said Letters Patent is hereby corrected as shown below:

Column 29,
Line 32, "are" should read -- they are --;
Line 47, "shorten" should read -- shortened --;
Line 50, "that" should be deleted; and
Line 51, "particular" should read -- particular, an --.

Column 31,
Line 61, "is," should read -- are, --.

Column 35,
Line 3, "continous" should read -- continuous --.

Column 37,
Line 38, "of" should be deleted;
Line 54, "correction" should read -- corrected --; and
Line 67, "on" should be deleted.

Column 40,
Line 3, "is" (first occurrence) should read -- of --.

Column 45,
Line 2, "further" should read -- further comprising --.

Signed and Sealed this

Fifth Day of March, 2002

*Attest:*

*Attesting Officer*

JAMES E. ROGAN
*Director of the United States Patent and Trademark Office*